US008247143B2

(12) United States Patent
Egawa et al.

(10) Patent No.: US 8,247,143 B2
(45) Date of Patent: Aug. 21, 2012

(54) PHOTORECEPTOR, IMAGE FORMATION METHOD, IMAGE FORMING APPARATUS AND PROCESS CARTRIDGE

(75) Inventors: Kazuhiro Egawa, Numazu (JP); Yukio Fujiwara, Numazu (JP); Hidetoshi Kami, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 263 days.

(21) Appl. No.: 12/614,113

(22) Filed: Nov. 6, 2009

(65) Prior Publication Data

US 2010/0119260 A1 May 13, 2010

(30) Foreign Application Priority Data

Nov. 7, 2008 (JP) ..... 2008-286102

(51) Int. Cl.
*G03G 5/147* (2006.01)

(52) U.S. Cl. ..... 430/66; 430/58.7; 430/59.6; 399/159

(58) Field of Classification Search ..... 399/159; 430/58.7, 59.6, 66
See application file for complete search history.

(56) References Cited

U.S. PATENT DOCUMENTS

2004/0197689 A1* 10/2004 Landa et al. ..... 430/67
2005/0266328 A1* 12/2005 Yanagawa et al. ..... 430/66
2007/0218384 A1* 9/2007 Matsumoto et al. ..... 430/108.1
2007/0231720 A1* 10/2007 Mori et al. ..... 430/58.7

FOREIGN PATENT DOCUMENTS

| | | |
|---|---|---|
| JP | 60-9259 | 3/1985 |
| JP | 2-139566 | 5/1990 |
| JP | 4169726 | 8/2008 |
| JP | 4194973 | 10/2008 |

* cited by examiner

*Primary Examiner* — Peter Vajda
(74) *Attorney, Agent, or Firm* — Cooper & Dunham LLP

(57) ABSTRACT

A photoreceptor including an electroconductive substrate, a photosensitive layer located overlying the electroconductive substrate, and a surface layer located overlying the photosensitive layer, wherein the surface layer is a cross linked surface layer comprising filler particulates on which linear scar is formed along the circumference direction, and the filler particulates form concave portions on a groove formed by the linear scar, and wherein the ten point average roughness Rz along the direction of the rotation axis of the photoreceptor measured on the circumference surface thereof is from 0.17 to 2.00 μm and the average distance Sm of concavities and convexities along the direction of the rotation axis of the photoreceptor measured on the circumference surface thereof is from 20 to 500 μm, and the ten point average roughness Rz along the circumference direction of the photoreceptor measured on the circumference surface thereof is from 0.13 to 0.50 μm and the average distance Sm of concavities and convexities along the circumference direction of the photoreceptor measured on the circumference surface thereof is from 10 to 40 μm.

12 Claims, 6 Drawing Sheets

$$Rz = \frac{|Zp1+Zp2+Zp3+Zp4+Zp5| + |Zv1+Zv2+Zv3+Zv4+Zv5|}{5}$$

PHOTORECEPTOR, IMAGE FORMATION METHOD, IMAGE FORMING APPARATUS AND PROCESS CARTRIDGE

BACKGROUND OF THE INVENTION

1. Field of the Invention

The present invention relates to a photoreceptor, an image formation method, an image forming apparatus, and process cartridge.

2. Discussion of the Background

Recently, organic photoconductors (photoreceptors) have been used in place of inorganic photoreceptors for a photocopier, a facsimile machine, a laser printer and a multifunctional device thereof in light of performances and advantages. Specific reasons for this replacement are, for example, (1) good optical characteristics, for example, width of the range of optical absorption wavelength and size of the amount of absorption of light; (2) electric characteristics, for example, high sensitivity and stable chargeability; (3) a wide selection of materials; (4) ease of manufacturing; (5) inexpensive cost; and (6) toxic-free property.

In addition, the trend of the size reduction of an image forming apparatus has accelerated the size reduction of an image bearing member (photoreceptor). Therefore, with the advancement of high speed performance and maintenance-free, an image bearing member having high durability has been desired. From this point of view, an organic photoconductor is soft in general and easy to wear down because the surface layer thereof is mainly made of a low molecular weight charge transport material and an inert polymer. Thus, an organic photoconductor repetitively used in the electrophotography process tends to be abraded under mechanical stress by a developing system or a cleaning system. Such abrasion of a photoreceptor causes deterioration of electric characteristics, for example, the sensitivity and the chargeability, resulting in production of abnormal images having, for example, low image density and background fouling. Local abrasion damage to a photoreceptor causes streaks on an image due to bad cleaning performance on the photoreceptor.

However, an organic photoconductor (photoreceptor) having a hardened surface or a protective layer containing a filler has been used in recent years, which has drastically improved the anti-abrasion property and anti-damage property of the organic photoconductor.

However, a photoreceptor having an improved anti-abrasion property is vulnerable to a problem such as vibration and turning inward or outward of a cleaning blade in the cleaning process.

The circumference surface of a photoreceptor is cleaned in the cleaning process among the electrophotography processes in which residual toner remaining on the photoreceptor after the transfer process is removed to obtain vivid and clear images.

In a cleaning method taking such a system, the residual toner remaining on the photoreceptor after transfer is scraped by a cleaning blade, which is provided to fill the gap between the photoreceptor and the cleaning blade by making the cleaning blade in contact with the photoreceptor to prevent the toner from slipping through the gap. This cleaning method is dominant in terms of cost, ease of designing, etc.

The vibration of a cleaning blade is a phenomenon in which the cleaning blade vibrates due to an increase of the friction between the cleaning blade and the surface of the photoreceptor. Turning inward or outward of a cleaning blade is a phenomenon in which the cleaning blade turns over along the moving direction of the photoreceptor.

Currently, increasing the contact pressure between the cleaning blade and the photoreceptor and the rubber hardness of the cleaning blade is inevitable to deal with size reduced toner demanded for production of quality images. Thus, the problems of vibration and turning inward or outward of a cleaning blade are highlighted.

A known method of reducing the vibration and turning inward or outward of the cleaning blade is to reduce the friction resistance between the cleaning blade and the photoreceptor by suitably roughening the surface of a photoreceptor to decrease the contact area between the cleaning blade and the surface of the photoreceptor.

Unexamined published Japanese patent application No. (hereinafter referred to as JOP) S52-026226 describes a technology of roughening the surface of a photoreceptor by containing particles in the surface layer.

In addition, JOP H02-139566 describes another technology of grinding the surface layer of a photoreceptor with polishing material having a film form to roughen the surface.

These technologies are effective to solve the vibration and turning inward or outward problem of a cleaning blade mentioned above but face a new problem that toner easily slips through the cleaning blade because the surface of the photoreceptor is roughened.

Slipping through of toner is a phenomenon in which toner slips through between the cleaning blade and the photoreceptor. JOP 2005-99688 describes a technology in which filler particulates are dispersed in the surface layer of the photosensitive layer of a photoreceptor and the surface layer is a cross linked resin layer formed by curing a radical polymerizable monomer having three or more functional groups without a charge transport structure, and a radical polymerizable monomer having a charge transport structure.

However, the contact area between the cleaning blade and the photoreceptor is large in this technology, which involves the problem of the vibration and/or turning inward or outward of the cleaning blade.

In addition, JOP 2006-11047 describes a technology in which a myriad of linear scars crossing each other are evenly formed on the surface of the photoreceptor.

Although the vibration and turning inward or outward of the cleaning blade can be prevented, toner tends to slip through, which causes bad cleaning performance. As described above, having a good combination of prevention measures against vibration or turning inward or outward of a cleaning blade and slipping through of toner is difficult.

SUMMARY OF THE INVENTION

Because of these reasons, the present inventors recognize that a need exists for a photoreceptor having a high durability and stabilizing the quality of images by which the problem on the vibration and/or turning inward or outward of a cleaning blade is remedied and slipping-through of toner hardly occurs, and a method of forming images, an image forming apparatus and a process cartridge using the photoreceptor.

Accordingly, an object of the present invention is to provide a photoreceptor having a high durability and stabilizing the quality of images by which the problem on the vibration and/or turning inward or outward of a cleaning blade is remedied and slipping-through of toner hardly occurs, and a method of forming images, an image forming apparatus and a process cartridge using the photoreceptor.

As a result of the intensive studies, the present inventors found that, the problems described above with regard to the photoreceptor having a photosensitive layer are remedied by a photoreceptor having linear scar along the circumference direction of the surface, a specific surface roughness, and filler particulates dispersed in the surface layer, and thus have made the present invention.

It will become readily apparent that these objects and other objects of the present invention as hereinafter described can be attained by a photoreceptor including an electroconductive substrate, a photosensitive layer located overlying the electroconductive substrate, and a surface layer located overlying the photosensitive layer, wherein the surface layer is a cross linked surface layer including filler particulates on which linear scar is formed along the circumference direction, and the filler particulates form concave portions on a groove formed by the linear scar, and wherein the ten point average roughness Rz along the direction of the rotation axis of the photoreceptor measured on the circumference surface thereof is from 0.17 to 2.00 μm and the average distance Sm of concavities and convexities along the direction of the rotation axis of the photoreceptor measured on the circumference surface thereof is from 20 to 500 μm, and the ten point average roughness Rz along the circumference direction of the photoreceptor measured on the circumference surface thereof is from 0.13 to 0.50 μm and the average distance Sm of concavities and convexities along the circumference direction of the photoreceptor measured on the circumference surface thereof is from 10 to 40 μm.

It is preferred that, in the photoreceptor mentioned above, the filler particulates have an average primary particle diameter of from 0.1 to 1.0 μm.

It is still further preferred that, in the photoreceptor mentioned above, the surface layer is formed by curing a radical polymerizable monomer having no charge transport structure and a radical polymerizable monomer having a charge transport structure and the radical polymerizable monomer having no charge transport structure has at least three radical polymerizable functional groups.

It is still further preferred that, in the photoreceptor mentioned above, the surface layer is formed by curing a radical polymerizable monomer having no charge transport structure and a radical polymerizable monomer having a charge transport structure and the radical polymerizable monomer having a charge transport structure has one radical polymerizable functional group.

It is still further preferred that, in the photoreceptor mentioned above, the surface layer is formed by curing a radical polymerizable monomer having no charge transport structure and a radical polymerizable monomer having a charge transport structure of a triaryl amine structure.

It is still further preferred that, in the photoreceptor mentioned above, the surface layer is formed by curing a radical polymerizable monomer having no charge transport structure and a radical polymerizable monomer having a charge transport structure, both of which have an acryloyloxy group or a methacryloyloxy group as a radical polymerizable functional group.

It is still further preferred that, in the photoreceptor mentioned above, the photoreceptor has a laminate structure comprising an undercoating layer, the photosensitive layer comprising a charge generation layer and a charge transport layer, and the cross linked surface layer.

As another aspect of the present invention, an image formation method is provided which includes charging the photoreceptor mentioned above, irradiating the photoreceptor to form a latent electrostatic image on the surface thereon, developing the latent electrostatic image to obtain a visualized image, transferring the visualized image to a recording medium; and cleaning the surface of the photoreceptor after the visualized image is transferred.

It is preferred that, in the image formation method mentioned above, the latent electrostatic image is developed with toner having a spherical form.

As another aspect of the present invention, an image forming apparatus is provided which includes a charging device that charges the photoreceptor mentioned above, an irradiation device that irradiates the surface of the photoreceptor to obtain a latent electrostatic image, a development device that develops the latent electrostatic image to obtain a visualize image, a transfer device that transfers the visualized image to a recording medium, and a cleaning device that cleans the surface of the photoreceptor after the visualized image is transferred to the recording medium.

As another aspect of the present invention, a process cartridge is provided which includes the photoreceptor mentioned above, and at least one device selected from the group consisting of a charging device, a development device, a transfer device, a cleaning device, and a discharging device. The process cartridge is detachably attachable to an image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention is described in detail below with reference to accompanying drawings. The present invention includes a photoreceptor with a structure having at least a photosensitive layer provided on or overlying an electroconductive substrate, and a cross linked surface layer in which filler particulates are dispersed. In addition, linear scar is formed along the circumference direction of the photoreceptor, and concave portions are formed by the filler particulates in the groove formed by the linear scar.

Figure 1:
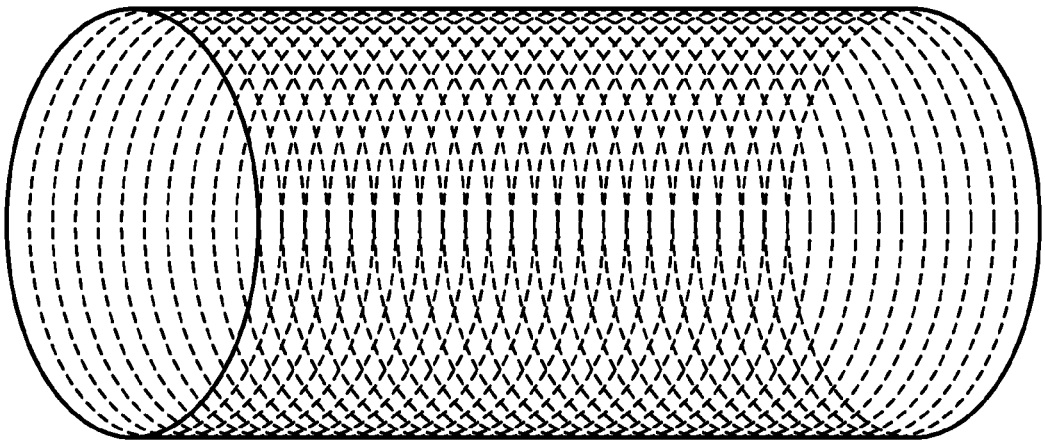
FIG. 1 is a diagram illustrating a state in which linear scar is formed on the surface of a photoreceptor.

The linear scar (refer to FIG. 1) in the present invention is a streak groove the cross section of which is a convex form.

Hit scar is not effective. Linear scar is the key. In the present invention, the linear scar is formed only along the circumference direction of the photoreceptor to reduce the contact area between the surface of the photoreceptor and the cleaning blade.

The contact area between the photoreceptor and the blade is reduced by forming the linear scar along the circumference direction, which reduces the friction force between the photoreceptor and the cleaning blade.

As a result, drawing-in of the blade edge decreases so that problems of the vibration and turning inward or outward can be restrained. On the other hand, linear scar formed along the rotation axis of the photoreceptor does not demonstrate such an effect.

A photoreceptor having a smooth surface, i.e., without linear scar, has a large contact area between the cleaning blade and the surface of the photoreceptor. Thus, the friction resistance between the cleaning blade and the surface of the photoreceptor increases, which easily causes the vibration and/or turning inward or outward of the cleaning blade.

On the other hand, a photoreceptor having linear scar on the surface thereof has a smaller contact area between the cleaning blade and the photoreceptor than a photoreceptor having a smooth surface free from scar. Thus, the linear scar is expected to prevent vibration and/or turning inward or outward of the cleaning blade.

In the present invention, there is no specific limit to the method of forming multiple linear scars along the circumference direction of the photoreceptor. For example, a specific method is that, after a surface having filler particulates dispersed therein is formed on the photoreceptor, linear scar is formed by rubbing the surface of the surface layer with polishing material having a film form. In addition, the cleaning property of toner having a spherical form (including significantly spherical form in the present invention) significantly deteriorates in the image formation process, which causes a problem in terms of practical usage. As described above, rolling of toner is not sufficiently restrained only by the linear scar formed on the surface of a photoreceptor so that a satisfying cleaning property is not obtained.

Figure 2:
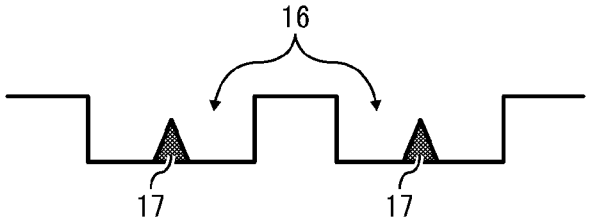
FIG. 2 is a diagram illustrating a state of linear scar formed on the surface of a photoreceptor, and the convex portion formed by filler particulate in the groove formed by the linear scar.

Thus, in the present invention, since the filler particulates are dispersed in the surface layer of the photoreceptor, convex portions are formed in the linear scar formed on the surface of the photoreceptor by the filler particulates as illustrated in FIG. 2.

Since the convex portions which are smaller than the roughened portion are formed on the photoreceptor, spherical toner, which is hardly removed, is stuck in the smaller convex portions. Thus, rolling of the spherical toner during the cleaning process is prevented. Thereby, the toner slipping through is reduced, which leads to significant improvement on the cleaning property of the toner. The existence of the convex portions by the filler formed on the linear scar can be confirmed by cross-section observation by a scanning electron microscope (SEM).

In the present invention, filler particulates are contained in the cured surface layer. Specific examples of such filler particulates include, but are not limited to, the following.

Specific examples of the organic filler material include, but are not limited to, powder of fluorine resin such as polytetrafuloroethylene, silicone resin powder, and carbon particulates.

Carbon particulates represent particles having a structure mainly formed of carbon.

Specific examples of such particles include, but are not limited to, amorphous carbon, diamond, graphite, fullerene, Zeppelin, carbon nanotube, and carbon nanophorn.

Among these structures, diamond form carbon having hydrogen, or particulates having amorphous carbon structures are suitable in terms of mechanical and chemical durability.

The diamond form carbon having hydrogen or amorphous carbon particles represent particulates in which structures having similarity such as the diamond structure having an sp3 orbit, graphite structure having an sp2 orbit, and an amorphous carbon structure are present in mixture.

The diamond form carbon or amorphous carbon particulates may include hydrogen, oxygen, nitrogen, fluorine, boron, phosphorous, chloride, bromine, iodine, and others. Specific examples of inorganic fillers include, but are not limited to, powder of metal such as copper, tin, aluminum and indium, metal oxides such as tin oxide, zinc oxide, titanium oxide, indium oxide, antimony oxide, and bismuth oxide, and inorganic material such as potassium titanate.

Among these, the inorganic material is suitable in terms of hardness of the filler particulates. The metal oxides are particularly suitable, and silicon oxide, aluminum oxide and titanium oxide are more suitable.

In addition, particulates such as colloidal silica, and colloidal aluminum are preferably used. In addition, the average primary particle diameter of the filler particulates is preferably from 0.1 to 1.0 μm in terms of optical transmittance and durability of the surface layer.

When the average primary particle diameter of the filler particulates is too small, rolling of toner entrapped in the groove of the linear scar tends to be not sufficiently prevented.

In addition, this may lead to deterioration of friction durability and/or dispersability.

When the average primary particle diameter of the filler particulates is too large, the height of the convex portion of the filler particulates tends to be high, which accelerates attrition of the edge of the cleaning blade. This leads to deterioration of the cleaning property over an extended period of time.

In addition, such filler particulates tend to accelerate precipitation in the liquid dispersion or cause filming of toner. The particle diameter of the filler particulates can be measured by a particle size distribution analyzer using photosedimentation with gravitational and centrifugal acceleration (CAPA-700, manufactured by Horiba).

The particle diameter of the filler particulates can be also measured by observing a cross section of the photosensitive layer (film) with a scanning electron microscope (SEM).

Anti-abrasion property is improved as the filler material density in the surface layer increases. However, a filler material density that is too high tends to rise a residual voltage and degrade the transmission factor of writing light for the surface layer, which may cause side-effects. Therefore, the filler material density is generally not greater than 50% by weight, and preferably not greater than 30% by weight based on all the solid portion Furthermore, these filler particulates can be subject to surface treatment with at least one surface treatment agent, which is preferable in terms of the dispersion property of the filler particulates. When a filler is poorly dispersed in the surface (protective) layer, the following problems may occur.

These are: (1) the residual potential of a resultant photoreceptor increases; (2) the transparency of a resultant protective layer decreases; (3) coating defects occur in a resultant surface (protective) layer; and, (4) the anti-abrasion property of the surface (protective) layer deteriorates. These possibly develop into greater problems with regard to the durability of a resultant photoreceptor, and the quality of the images produced thereby. Suitable surface treatment agents include known surface treatment agents. Among these, surface treatment agents which do not degrade the insulation property of a filler are preferred. For example, titanate coupling agents, aluminum coupling agents, zircoaluminate coupling agents, higher fatty acids, combinational use of these agents with a silane coupling agent, and $Al_2O_3$, $TiO_2$, $ZrO_2$, silicones, aluminum stearate, and combinational use thereof, are preferable in terms of the dispersion property of filler particulates and prevention of production of blurred images.

Treatment on filler particulates by a silane coupling agent has an adverse impact with regard to production of blurred images. However, a combinational use of the surface treatment agent specified above and a silane coupling agent may lessen this adverse impact. The content of a surface treatment agent depends on the average primary particle diameter of the filler, but is preferably from 3 to 30% by weight, and more preferably from 5 to 20% by weight based on the weight of the treated filler.

A content of the surface treatment agent that is too small tends not to improve the dispersion property of the filler. In contrast, a content of the surface treatment agent that is too large tends to significantly increase the residual potential of the photoreceptor.

These filler particulate materials can be used alone or in combination.

The photoreceptor of the present invention has a structure in which linear scar is formed along the circumference direction and the ten point average roughness Rz along the mother line direction (which is the rotation axis direction of the photoreceptor) from 0.17 to 2.00 μm and the average distance Sm of concavities and convexities along the mother line direction is from 20 to 500 μm.

That an Rz measured along the rotation axis direction of the photoreceptor is large represents that the linear scar is deep. Therefore, foreign material is easily trapped in the concave portion of the linear scar and difficult to remove. This easily leads to filming of toner, or image deficiency because of this foreign material. Furthermore, output images tend to have rough portions ascribable to the roughness of the surface of the photoreceptor and the cleaning blade does not effectively prevent the toner from slipping therethrough. An Rz along the rotation axis of the photoreceptor that is within the range mentioned above keeps the cleaning performance good while causing no side effects ascribable to the factors mentioned above. By contrast, an Rz along the rotation axis of the photoreceptor that is excessively small tends to lessen the reduction effect on the friction force between the cleaning blade and the photoreceptor obtained by roughening the surface of the photoreceptor. A photoreceptor having an Sm along the direction of the rotation axis of the photoreceptor that is outside the range mentioned above tends to degrade the cleaning performance, etc.

The photoreceptor of the present invention has a ten point average roughness Rz along the circumference direction of the photoreceptor measured on the circumference surface of the photoreceptor of from 0.13 to 0.50 μm and an average distance Sm of concavities and convexities along the circumference direction measured on the circumference surface of the photoreceptor of from 10 to 40 μm. An Rz along the circumference direction that is too large tends to cause bad cleaning performance, and increase local friction resistance against the cleaning blade, and may lead to breakage of the edge portion of the cleaning blade particularly when the cleaning blade is repetitively used over an extended period of time. A photoreceptor having an Sm along the circumference direction of the photoreceptor that is outside the range mentioned above tends to degrade the cleaning performance, etc.

In contrast, when the Rz along the circumference direction is excessively small, the height of the convex portion formed by the filler particulates tends to be insufficient, which may result in failure of reducing rolling of toner. Next, the material forming the cross linked surface layer for use in the present invention is described.

Figure 3:
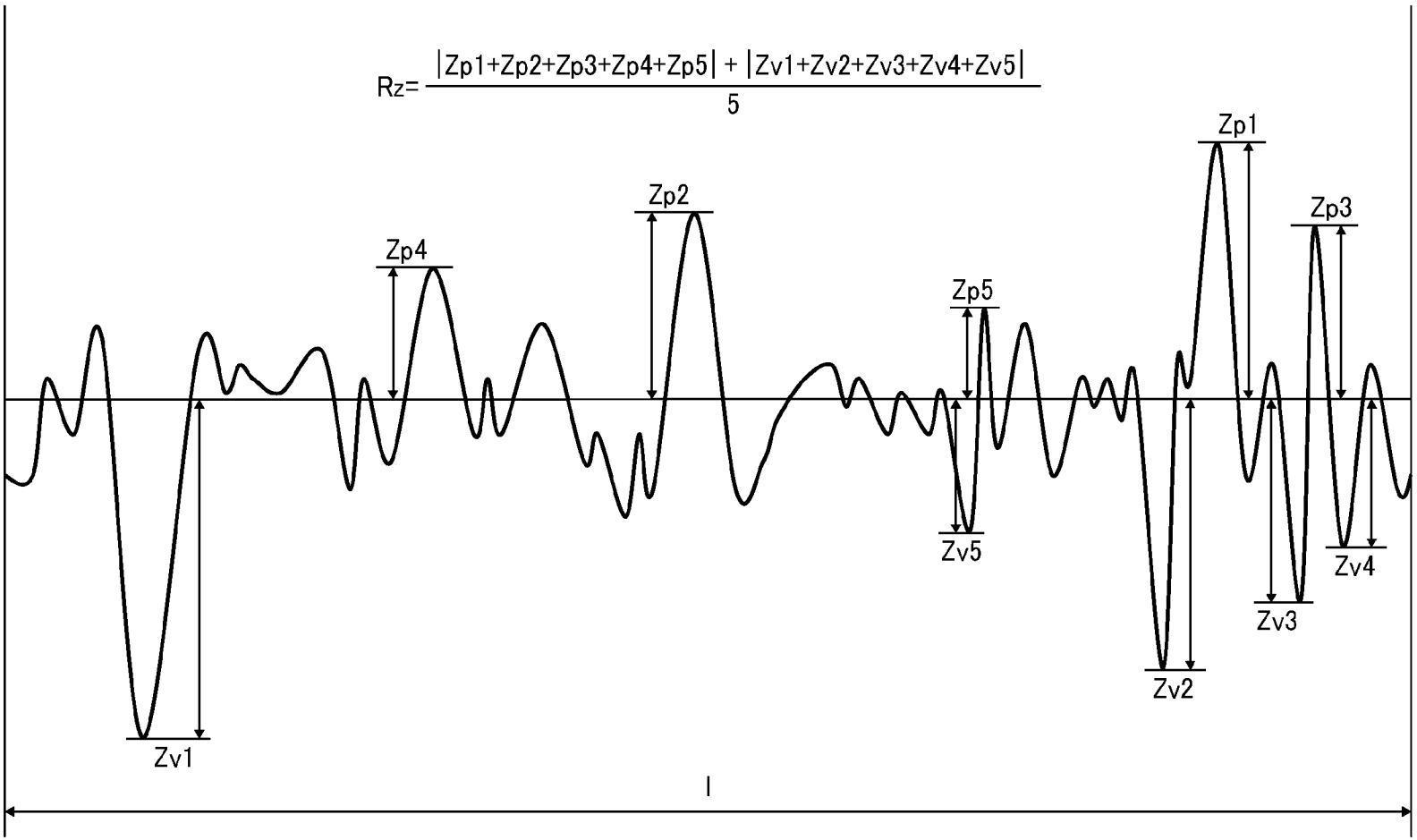
FIG. 3 is a diagram for use in explaining the ten point average roughness Rz.

Typically, the ten point average roughness Rz is measured as follows (refer to FIG. 3): extract the reference length 1 from a target curve (contour); calculate the average of absolute values of the 5 highest peaks ($Zp_1$ to $Zp_5$) and the average of the absolute values of the 5 lowest bottoms ($ZV_1$ to $ZV_5$); and add up the two averages to obtain Rz. Rz is represented by the following relationship:

$$Rz = \frac{|Zp_1 + Zp_2 + Zp_3 + Zp_4 + Zp_5| + |Zv_1 + Zv_2 + Zv_3 + Zv_4 + Zv_5|}{5}$$

Figure 4:
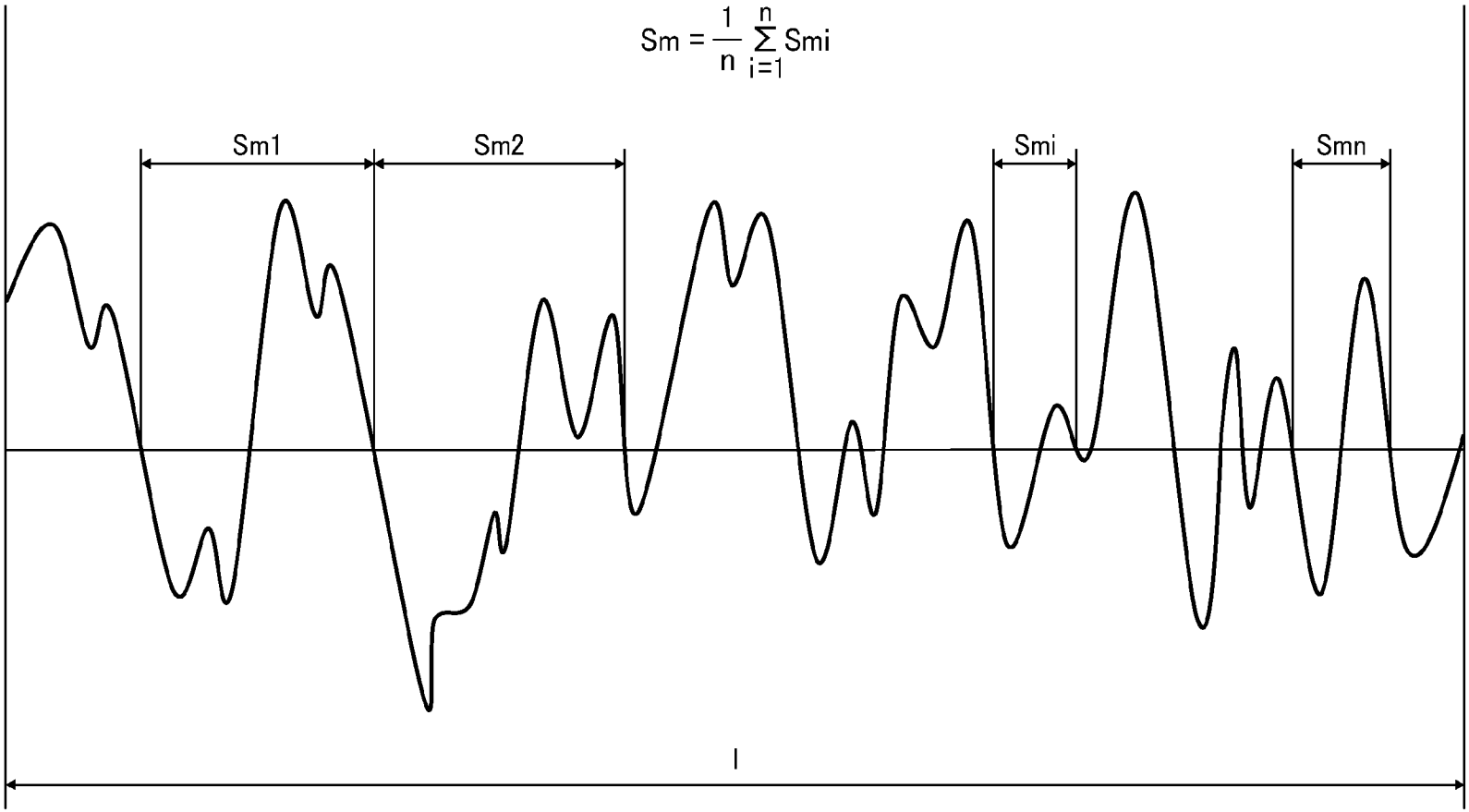
FIG. 4 is a diagram for use in explaining the average distance Sm of concavities and convexities.

Typically, the average distance Sm of concavities and convexities is measured as follows (refer to FIG. 4): extract the reference length 1 from a target curve along the direction of the average line of the rough curve; aggregate the average line corresponding to one convex portion and its adjacent concave portion; and obtain the arithmetic mean for the distance between the concavities and convexities as Sm. Sm is represented by the following relationship:

$$Sm = \frac{1}{n}\sum_{i=1}^{n} Smi$$

In the present invention, the Rz and Sm along the rotation axis of the photoreceptor are measured for a contour obtained when the photoreceptor is severed along the rotation axis of the photoreceptor, and, the Rz and Sm along the circumference direction of the photoreceptor, for a curve obtained by removing the surface heave component longer than a desired wavelength from the contour by a phase compensation type high pass filter.

The radical polymerizable monomer without having a charge transport structure represents a monomer having a radical polymerizable functional group without a positive hole structure such as triaryl amine, hydrazone, pyrazoline, or carbazole, or an electron transport structure such as condensed polycyclic quinone, diphenoquinone or an electron absorbing aromatic ring having a cyano group or a nitro group.

The radical polymerizable functional group is any radical polymerizable functional group which has a carbon-carbon double bond. The number of the polymerizable functional groups of the radical polymerizable monomer having no charge transport structure is preferably at least 3.

For example, 1-substituted ethylene functional groups and 1,1-substituted ethylene functional groups are suitably used as radical polymerizable functional groups.

A specific example of 1-substituted ethylene functional groups is the functional group represented by the following chemical formula 1.

$CH_2{=}CH{-}X_1{-}$ Chemical formula 1

In the chemical formula 1, $X_1$ represents a substituted or non-substituted phenylene group, an arylene group such as a naphthylene group, a substituted or non-substituted alkenylene group, —CO—, —COO—, —CON($R_1$) (wherein, $R_1$ represents hydrogen, an alkyl group such as methyl group and ethylene group, an aralkyl group such as benzyl group, naphthyl methyl group, and phenethyl group, and an aryl group such as phenyl group and naphthyl group), or —S—.

Specific examples of such functional groups include, but are nor limited to, vinyl group, styryl group, 2-methyl-1,3-butadienyl group, vinyl carbonyl group, acryloyloxy group, acryloyl amide group, and vinylthio ether group.

A specific example of 1,1-substituted ethylene functional groups is the functional group represented by the following chemical formula 2.

$CH_2{=}C(Y){-}(X_2)_d{-}$ Chemical formula 2

In the chemical formula 2, Y represents a substituted or non-substituted alkyl group, a substituted or non-substituted aralkyl group, a substituted or non-substituted phenyl group, an aryl group such as naphtylene group, a halogen atom, cyano group, nitro group, an alkoxy group such as methoxy group and ethoxy group, —$COOR_2$ ($R_2$ represents hydrogen atom, an alkyl group such as a substituted or non-substituted methyl group or ethyl group, an aralkyl group such as a substituted or non-substituted benzyl group and phenylhyl group, an aryl group such as substituted or non-substituted phenyl group and naphtyl group or —$CONR_3R_4$ ($R_3$ and $R_4$ independently represent a hydrogen atom, an alkyl group such as a substituted or non-substituted methyl group or ethyl group, an aralkyl group such as a substituted or non-substituted benzyl group, naphthyl methyl group, and phenethyl group, or an aryl group such as substituted or non-substituted phenyl group and naphtyl group). $X_2$ represents the same substitution group as $X_1$, or an alkylene group and d represents 0 or 1. At least one of Y and $X_2$ is an oxycarbonyl group, cyano group, an alkenylene group and an aromatic ring.

Specific examples of these functional groups include, but are nor limited to, α-cyanoacryloyloxy group, methacryloyloxy group, α-cyanoethylene group, α-cyanoacryloyloxy group, α-cyanophenylene group and methacryloyl amino group.

Specific examples of substitution groups further substituted to the substitution groups of $X_1$, $X_2$ and Y include, but are not limited to, a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group.

Among these radical polymerizable functional groups, acryloyloxy group, and methacryloyloxy group are particularly suitable. A compound having at least three acryloyloxy groups is obtained by performing ester reaction or ester conversion reaction using, for example, a compound having at least three hydroxyl groups therein and an acrylic acid (salt), a halide acrylate and an ester of acrylate. A compound having at least three methacryloyloxy groups is obtained in the same manner. In addition, the radical polymerizable functional groups in a monomer having at least three radical polymerizable functional groups can be the same or different from each other.

The radical polymerizable monomer having at least three functional groups without having a charge transport structure include the following compounds, but are not limited thereto. Specific examples of the radical polymerizable monomers mentioned above for use in the present invention include, but are not limited to, trimethylol propane triacrylate (TMPTA), trimethylol propane trimethacrylate, HPA modified trimethylol propane triacrylate, EO modified trimethylol propane triacrylate, PO modified trimethylol propane triacrylate, caprolactone modified trimethylol propane triacrylate, HPA modified trimethylol propane triacrylate, pentaerythritoltriacrylate, pentaerythritol tetra acrylate (PETTA), glycerol triacrylate, ECH modified glycerol triacrylate, EO modified glycerol triacrylate, PO modified glycerol triacrylate, tris (acryloxyrthyl) isocyanulate, dipenta erythritolhexacrylate (DPHA), caprolactone modified dipenta erythritol hexacrylate, dipenta erythritol hydroxyl dipenta acrylate, alkalized dipenta erythritol tetracrylate, alkalized dipenta erythritol triacrylate, dimethylol propane tetracrylate (DTMPTA), pentaerythritol ethoxy tetracrylate, EO modified phosphoric acid triacrylate, and 2,2,5,5-tetrahydroxy methyl cyclopentanone tetracrylate. These can be used alone or in combination.

In addition, the radical polymerizable monomer having three functional groups without having a charge transport structure for use in the present application preferably has a ratio (molecular weight/the number of functional groups) of the molecular weight to the number of functional groups in the monomer not greater than 250 to form a dense cross linking bondage in a cross linked surface layer.

Furthermore, when the ratio (molecular weight/the number of functional groups) is too large, a cross linked surface layer formed of such a monomer is soft and thus the anti-abrasion property of the cross linked surface layer tends to deteriorate. Therefore, among the monomers mentioned above, usage of a monomer having an extremely long modified (e.g., HPA, EO, PO modified) group is not suitable.

In addition, the content ratio of the radical polymerizable monomer having at least three functional groups without having a charge transport structure is from 20 to 80% by weight and preferably from 30 to 70% by weight based on the total weight of a cross linked surface layer. When the monomer content ratio is too small, the density of three-dimensional cross-linking bondage in a cross-linked surface layer tends to be small. Therefore, the anti-abrasion property thereof is not drastically improved in comparison with a case in which a typical thermal plastic binder resin is used.

A monomer content ratio that is too large means that the content of charge transport compound decreases, which may cause deterioration of the electric characteristics. Desired electric characteristics and anti-abrasion property vary depending on the process used. Therefore, it is difficult to jump to any conclusion but considering the balance of the characteristics and the property, the range of from 30 to 70% by weight is preferred. The radical polymerizable monomer having a charge transport structure represents a monomer having a radical polymerizable functional group, and a positive hole structure such as triaryl amine, hydrazone, pyrazoline, or carbazole, or an electron transport structure such as condensed polycyclic quinone, diphenoquinone or an electron absorbing aromatic ring having a cyano group or a nitro group.

As the radical polymerizable functional group, the radical polymerizable functional group mentioned in the radical polymerizable monomer mentioned above can be suitably used. Among these, acryloyloxy group and methacryloyloxy group are particularly suitable.

The number of the radical polymerizable functional groups in one molecule is one or more and preferably one. In addition, a triaryl amine has a highly effective structure as the charge transport structure. Among these, a compound having the structure represented by the following chemical formula I or II suitably maintains the electric characteristics such as sensitivity and residual voltage good during repetitive use.

Chemical formula I

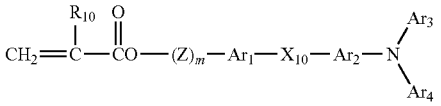

Chemical formula II

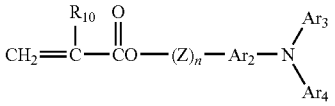

In the Chemical formulae I and II, $R_{10}$ represents hydrogen atom, a halogen atom, an alkyl group, an aralky group, an aryl group, a cyano group, a nitro group, an alkoxy group, —$COOR_{11}$, wherein $R_{11}$ represents hydrogen atom, a halogen atom, an alkyl group, an aralkyl group or an aryl group, a halogenated carbonyl group or $CONR_{12}R_{13}$, wherein $R_{12}$ and $R_{13}$ independently represent hydrogen atom, a halogen atom, an alkyl group, an aralkyl group or an aryl group, $Ar_1$ and $Ar_2$ independently represent an arylene group. $Ar_3$ and $Ar_4$ independently represent an aryl group. $X_{10}$ represents a single bond, an alkylene group, a cycloalkylene group, an alkylene ether group, oxygen atom, sulfur atom, or vinylene group. Z represents an alkylene group, an alkylene ether group or an alkyleneoxy carbonyl group. m and n represent an integer of from 0 to 3.

Specific examples of the substitution groups in the chemical formulae I and II include, but are not limited to, the following.

In the Chemical formulae I and II, as the substitution groups of $R_{10}$, specific examples of the alkyl groups of $R_{10}$ include, but are not limited to, methyl group, ethyl group, propyl group, and butyl group. Specific examples of the aryl groups of $R_{10}$ include, but are not limited to, phenyl group and naphtyl group. Specific examples of the aralkyl groups of $R_{10}$ include, but are nor limited to, benzyl group, phenthyl group, naphtyl methyl group. The alkoxy group $R_{10}$ include, but are nor limited to, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group.

Among these substitution groups for $R_{10}$, hydrogen atom and methyl group are particularly preferred.

$Ar_3$ and $Ar_4$ represent a substituted or non-substituted aryl group. Specific examples thereof include, but are not limited to, condensed polycyclic hydrocarbon groups, non-condensed ring hydrocarbon groups and heterocyclic groups.

Specific examples of the condensed polycyclic hydrocarbon groups include, but are not limited to, a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include, but are not limited to, a single-valent group such as carbazol, dibenzofuran, dibenzothiophene, oxadiazole, and thiadiazole. The aryl groups represented by $Ar_3$ and $Ar_4$ can have a substitution group. Specific examples thereof are as follows:

(1) a halogen atom, cyano group, and nitro group; (2) an alkyl group; Preferably a straight chained or side chained alkyl group having 1 to 12, more preferably 1 to 8 and furthermore preferably from 1 to 4 carbons. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methyl group, ethyl group, n-butyl group, 1-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) an alkoxy group (—$OR_{14}$); $R_{14}$ is the same alkyl group as specified in (2).

Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxy group, and trifluoromethoxy group;

(4) an aryloxy group;

Specific examples of the aryl group of the aryloxy group include, but are not limited to, phenyl group, and naphtyl group.

These can contain an alkoxy group having 1 to 4 carbon atoms, an alkyl group having a 1 to 4 carbon atoms, or a halogen atom as a substitution group.

Specific examples include, but are not limited to, phenoxy group, 1-naphtyloxy group, 2-naphtyloxy group, 4-methoxyphenoxy group, and 4-methylphenoxy group;

(5) an alkyl mercapto group or an aryl mercapto group; Specific examples thereof include, but are not limited to, methylthio group, ethylthio group, phenylthio group, and p-methylphenylthio group;

(6)

Chemical formula 3

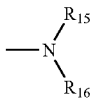

In Chemical formula 3, $R_{15}$ and $R_{16}$ independently represent a hydrogen atom, the alkyl group defined in (2), or an aryl group.

Specific examples of the aryl groups include, but are not limited to, phenyl group, biphenyl group, or naphtyl group. These can contain an alkoxy group having 1 to 4 carbon atoms, an alkyl group having 1 to 4 carbon atoms or a halogen atom as a substitution group.

$R_{15}$ and $R_{16}$ can share a linkage to form a ring.

Specific examples thereof include, but are not limited to, amino group, diethyl amino group, N-methyl-N-phenyl amino group, N,N-diphenyl amino group, N,N-di(tolyl) amino group, dibenzyl amino group, piperidino group, morpholino group, and pyrrolidino group;

(7) an alkylene dioxy group or an alkylene dithio such as methylene dioxy group and methylene dithio group; and (8) a substituted or non-substituted styryl group, a substituted or non-substituted β-phenyl styryl group, diphenyl aminophenyl group, ditolyl aminophenyl group, etc.

The arylene groups represented by $Ar_1$ and $Ar_2$ are divalent groups derived from the aryl group represented by $Ar_3$ and $Ar_4$ mentioned above. $X_{10}$ represents a single bond, an alkylene group, a cycloalkylene group, an alkylene ether group, oxygen atom, sulfur atom, or a vinylene group. A straight chained or side chained alkyl group having 1 to 12, more preferably 1 to 8 and furthermore preferably from 1 to 4 carbons is preferably specified. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms. Specific examples thereof include, but are note limited to, methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylpheny ethylene group, and 4-biphenyl ethylene group.

Specific examples of the substituted or non-substituted cycloalkylene groups include, but are not limited to, cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms.

Specific examples thereof include, but are not limited to, cyclohexylidene group, cyclohexylene group, and 3,3-dimethyl cyclohexylidene group.

Specific examples thereof include, but are not limited to, $—CH_2CH_2O—$, $—CH_2CH_2CH_2O—$, $—(OCH_2CH_2)_h—O—$, and $—(OCH_2CH_2CH_2)_1—O—$. In the groups specified above, h and i represent an integer of from 1 to 4.

The alkylene group of the alkylene ether group may include a substitution group such as hydroxyl group, methyl group and ethyl group.

Vinylene group is represented by the following chemical formula 4.

Chemical formula 4

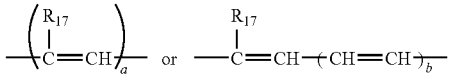

In chemical formula 4, $R_{17}$ represents hydrogen or an alkyl group (the same as the alkylene groups defined in (2)) and a represents 1 or 2 and b is an integer of from 1 to 3. Z represents an alkylene group, an alkylene ether group or an alkyleneoxy carbonyl group.

Specific examples of the alkylene group are the same as the alkylene group specified for X.

Specific examples of the alkylene ether group are the same as the alkylene ether group specified for $X_{10}$.

A specific example of the alkyleneoxy carbonyl group is caprolactone modified group.

The compound represented by the following chemical formula (III) is a further suitably preferred radical polymerizable compound having a functional group with a charge transport structure.

Chemical formula (III)

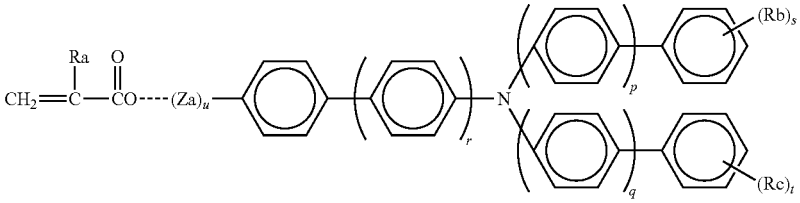

In Chemical formula (III), r, p, q and u represent 0 or 1, Ra represents hydrogen atom or methyl group, Rb and Rc independently represent an alkyl group having 1 to 6 carbon atoms. s and t represent an integer of from 0 to 3. Za represents methylene group, ethylene group, $—CH_2CH_2O—$, $—CHCH_3CH_2O—$, or $—C_6H_5CH_2CH_2—$.

Among the compounds represented by the chemical formula (III) illustrated above, the compounds having methyl group or ethyl group as a substitution group of Rb and Rc are particularly preferred.

The cross-linked surface layer formed in the present invention is free from cracking and has excellent electric characteristics.

The radical polymerizable compound (monomer) having a functional group with a charge transport structure for use in the present invention represented by the chemical formula (I), (II) or (III) in particular is polymerized in a manner that both sides of the carbon-carbon double bond are open. Therefore, the radical polymerizable compound does not constitute an end of the structure but is set in a chained polymer. The radical polymerizable monomer having a functional group is present in a main chain of a polymer in which cross-linking is formed by polymerization with a radical polymerizable monomer having at least three functional groups or a cross-linking chain between main chains. There are two kinds of the cross-linking chains. One is the cross-linking chain between a polymer and another polymer, and the other is the cross-linking chain formed by cross-linking a portion in the main chain present in a folded state in a polymer with a moiety deriving from a monomer polymerized away from the portion.

Regardless of whether or not the radical polymerizable compound having a functional group with a charge transport structure is present in the main chain or in the cross-linking chain, the triaryl amine structure suspends from the chain portion. The triaryl amine structure has at least three aryl groups disposed in the radial directions relative to the nitrogen atom therein. Such a triaryl amine structure is bulky but does not directly joint with the chain portion and suspends from the chain portion via the carbonyl group, etc. That is, the triaryl amine structure is stereoscopically fixed in a flexible state. Therefore, these triaryl amine structures can be adjacent to each other with a moderate space in the polymer. Therefore, the structural distortion in the molecule is slight. In addition, the surface layer of a photoreceptor having such a structure is deduced to have an internal molecular structure with relatively few disconnections in the charge transport route.

Specific examples of the radical polymerizable monomer having a functional group with a charge transport structure include, but are not limited to, the following. No. 358 is a missing number.

No.1

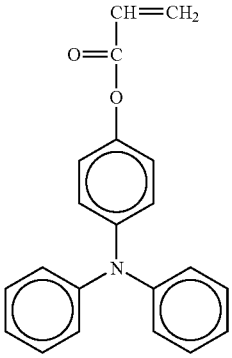

No.2

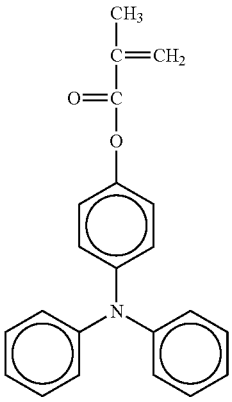

No.3

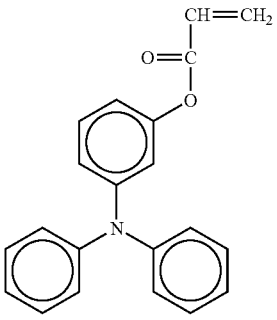

-continued

No.4

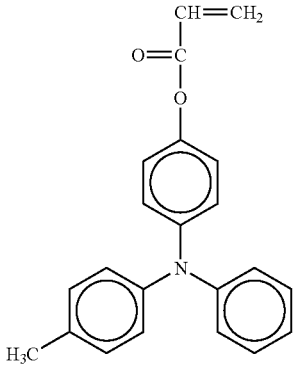

No.5

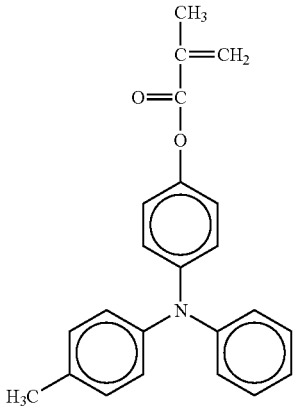

No.6

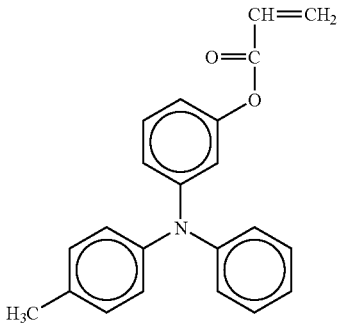

No.7

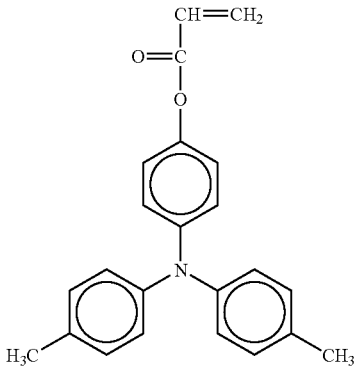

-continued
No.8
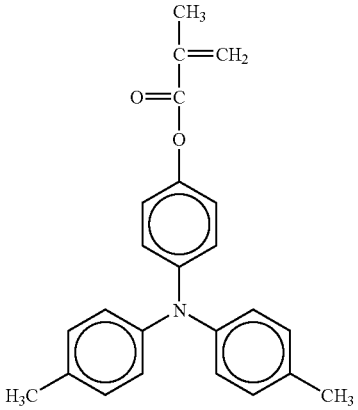
No.9
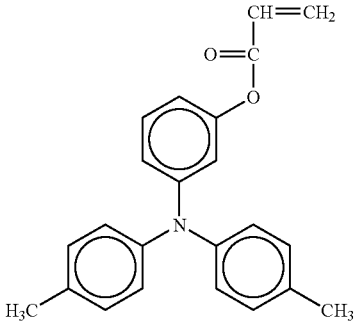
No.10
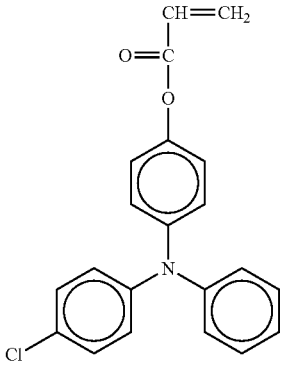
No.11
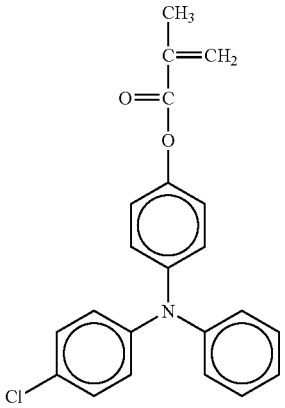
-continued
No.12
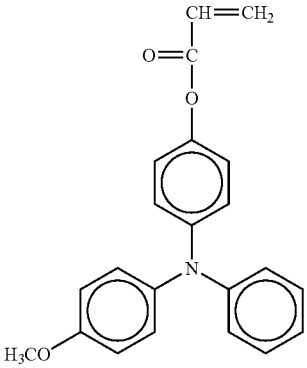
No.13
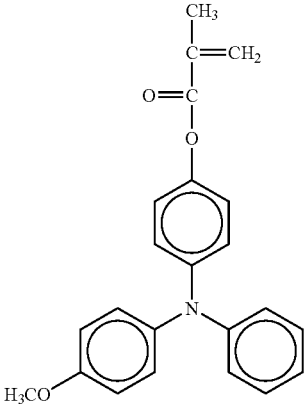
No.14
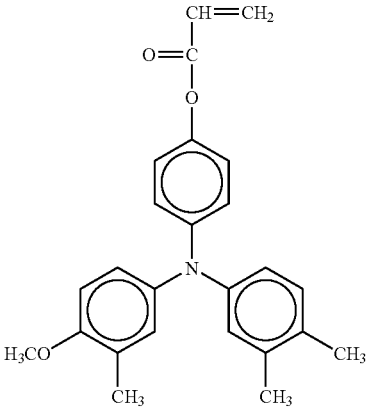
No.15
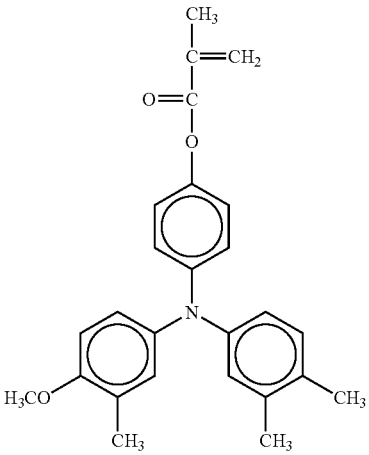

-continued
No.16
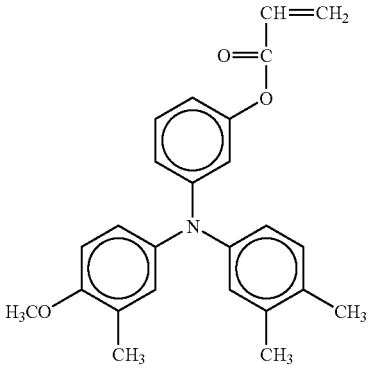
No.17
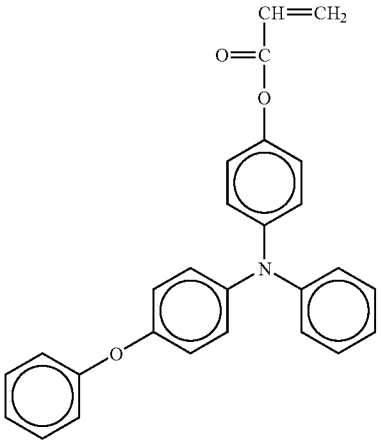
No.18
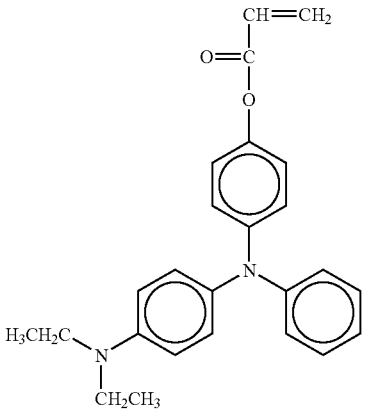
-continued
No.19
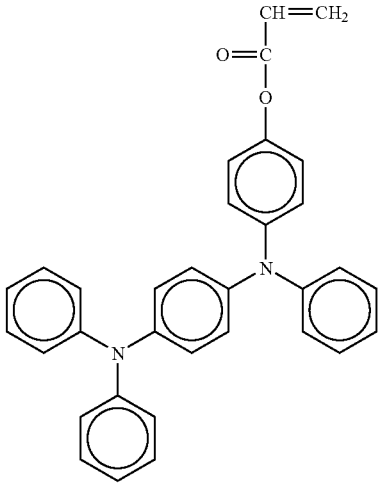
No.20
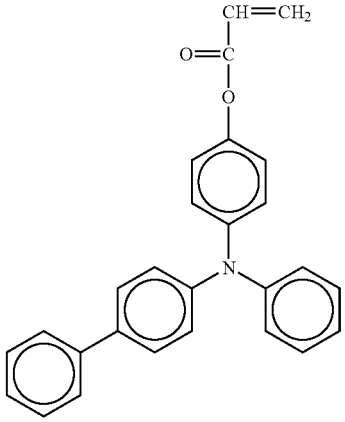
No.21
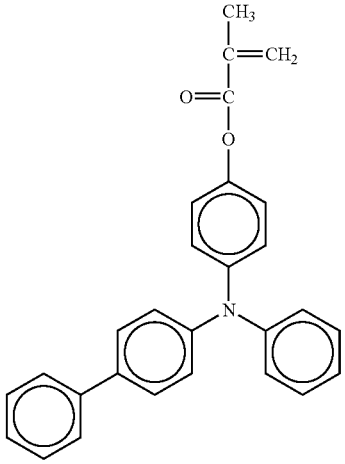

-continued
No.22
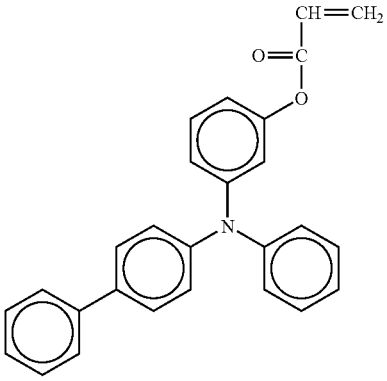
No.23
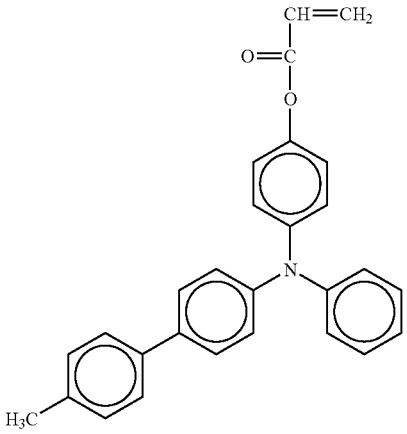
No.24
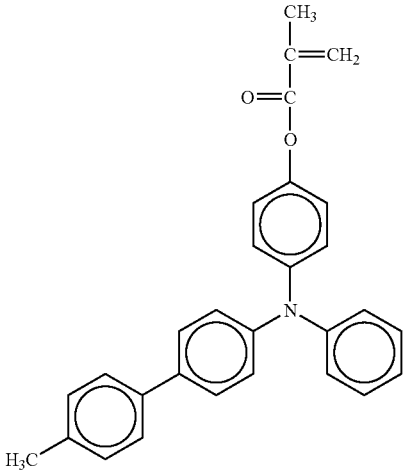
-continued
No.25
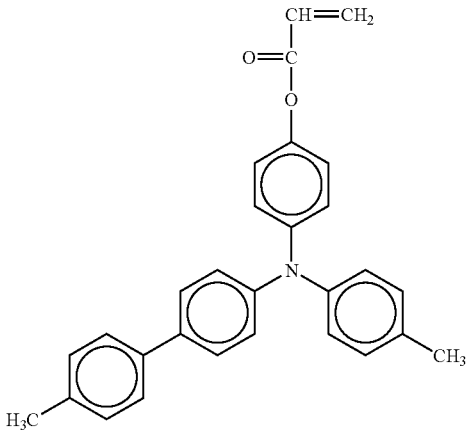
No.26
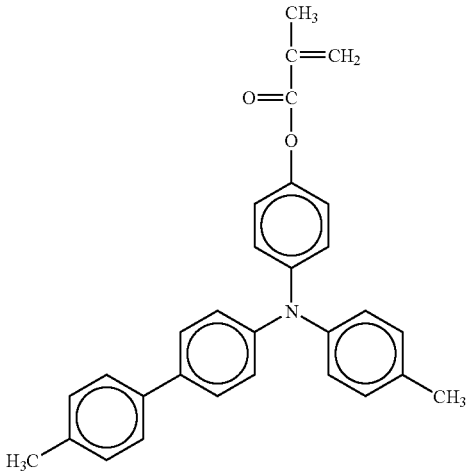
No.27
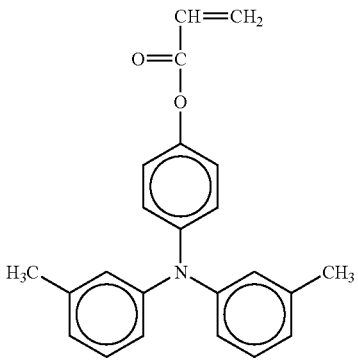

-continued
No.28
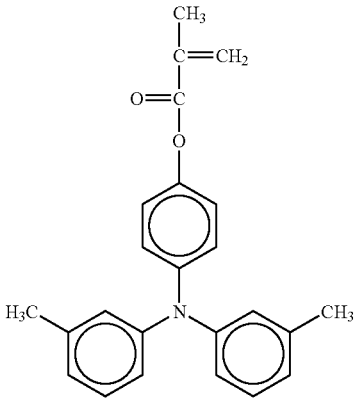
No.29
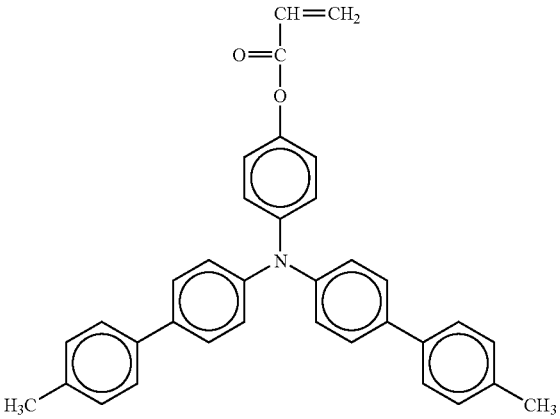
No.30
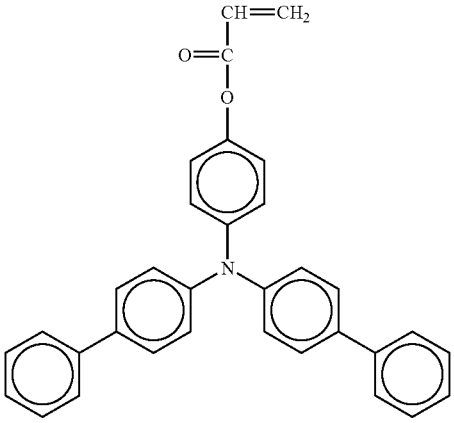
No.31
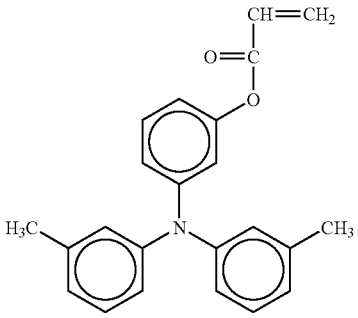
-continued
No.32
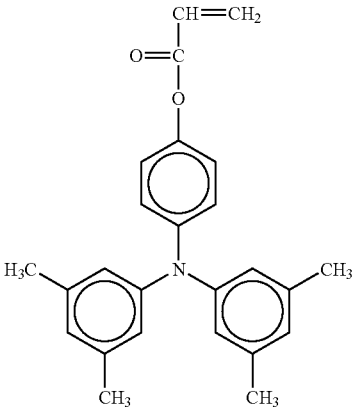
No.33
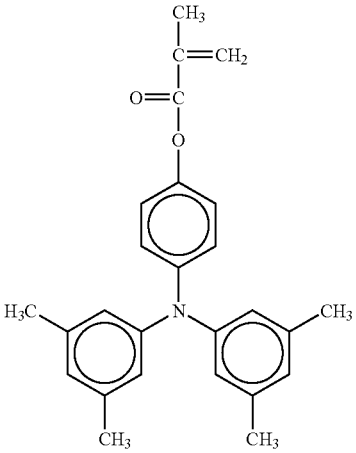
No.34
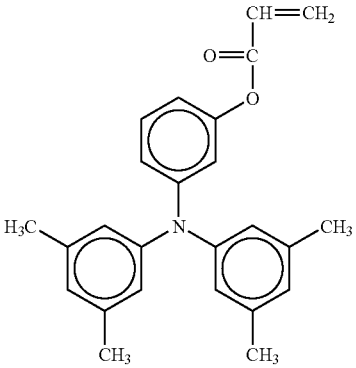
No.35
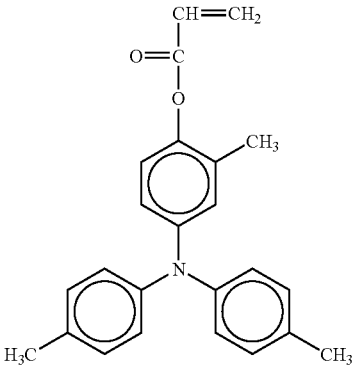

-continued
No.36
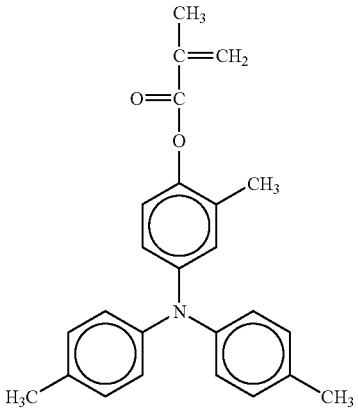
No.37
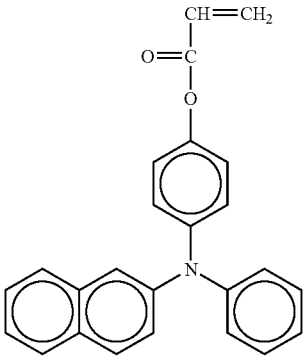
No.38
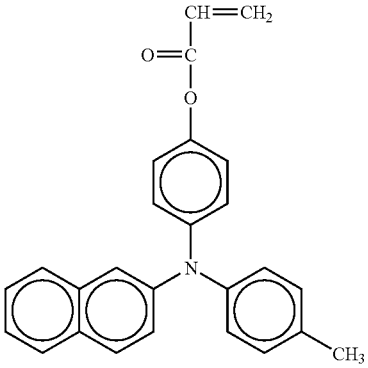
No.39
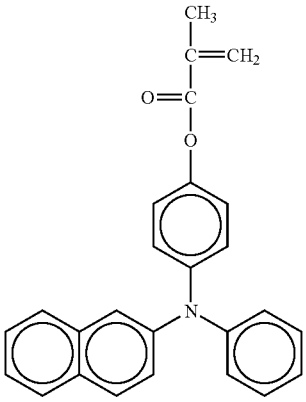
-continued
No.40
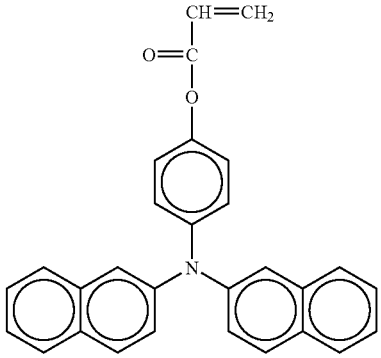
No.41
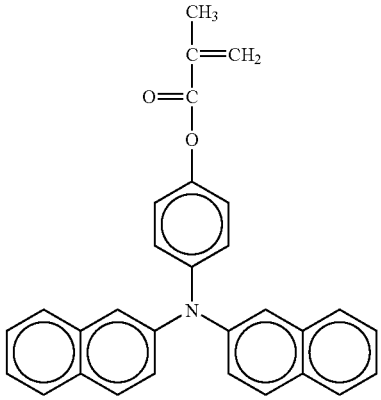
No.42
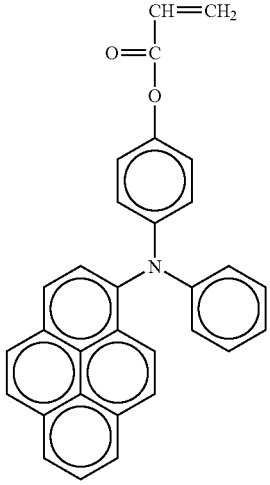

-continued
No.43
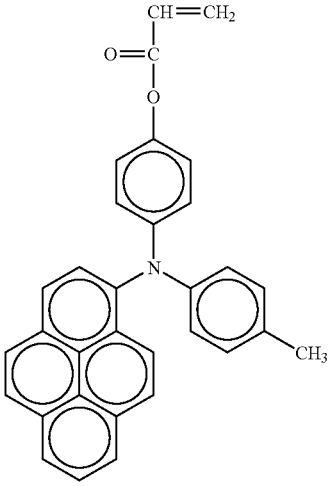
No.44
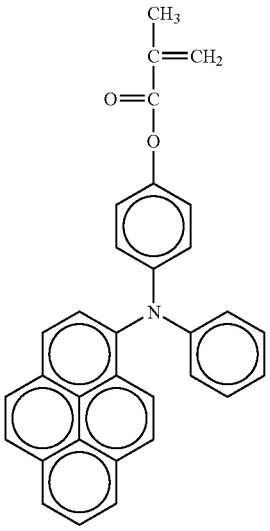
No.45
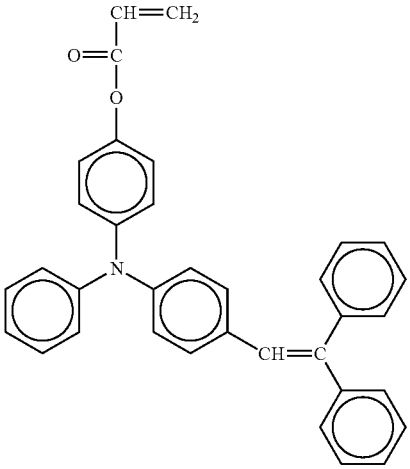
-continued
No.46
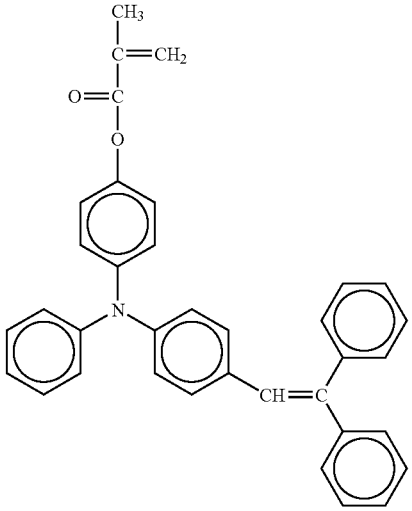
No.47
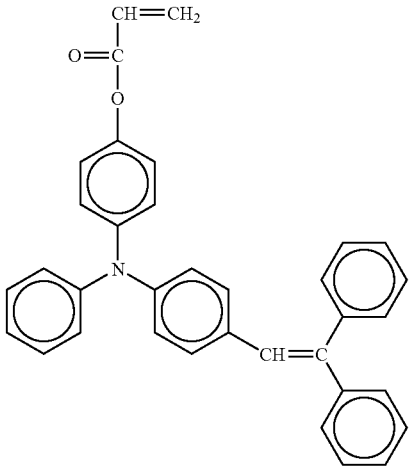
No.48
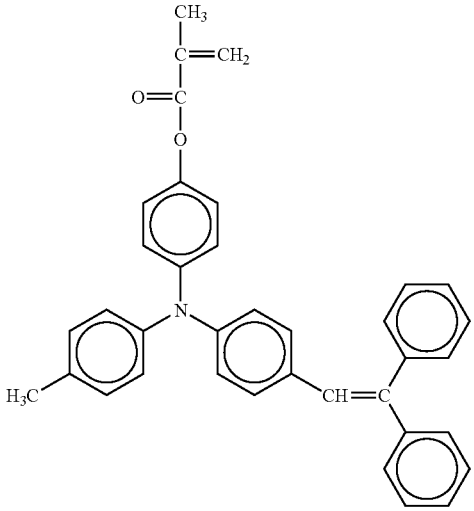

-continued
No.49
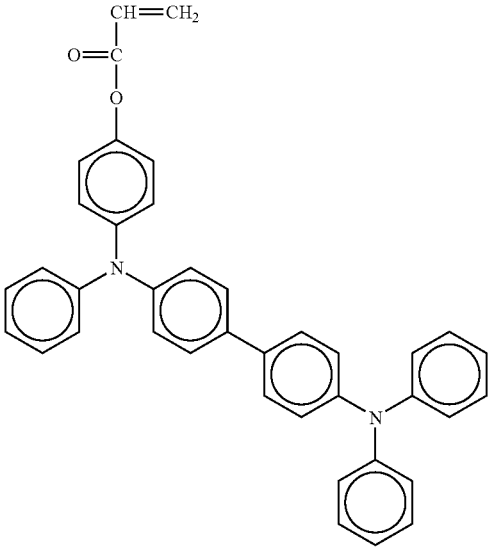
No.50
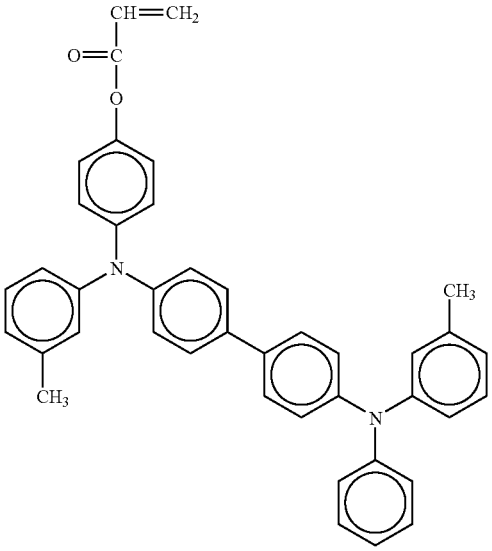
No.51
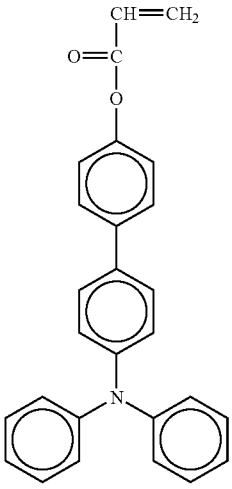
-continued
No.52
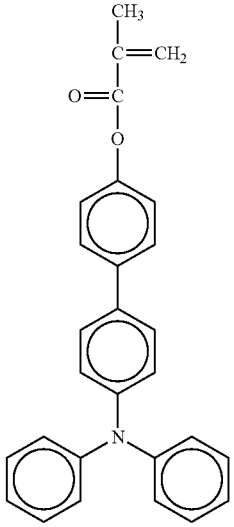
No.53
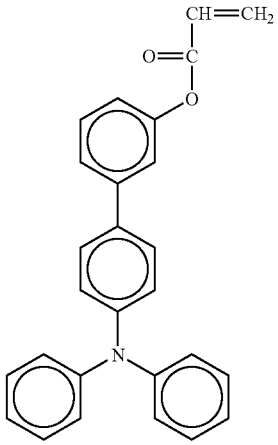
No.54
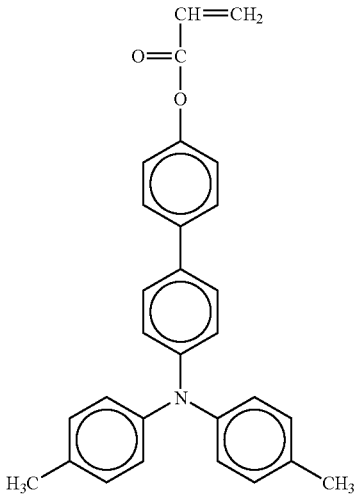

-continued
No.55
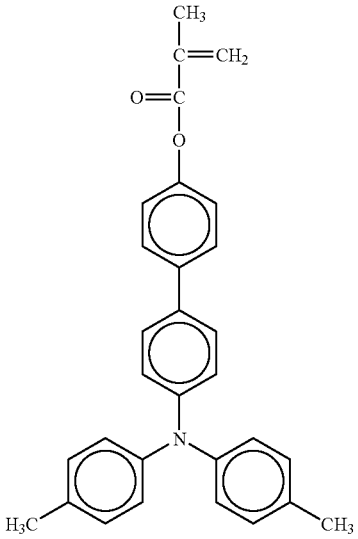
No.56
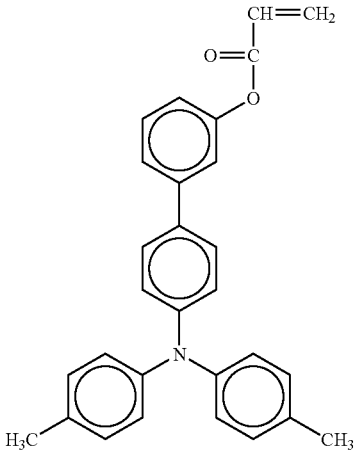
No.57
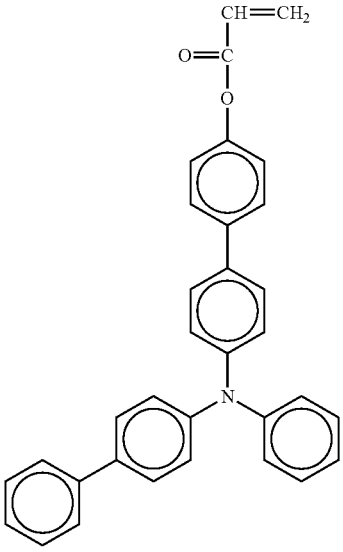
-continued
No.58
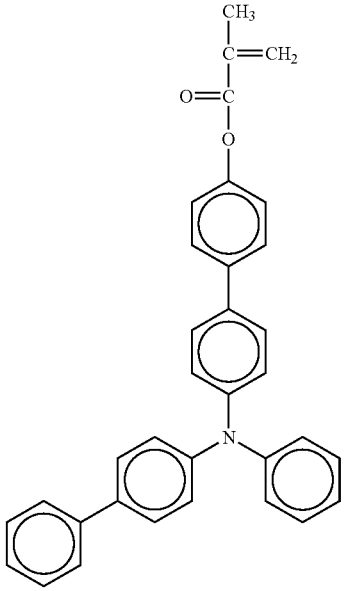
No.59
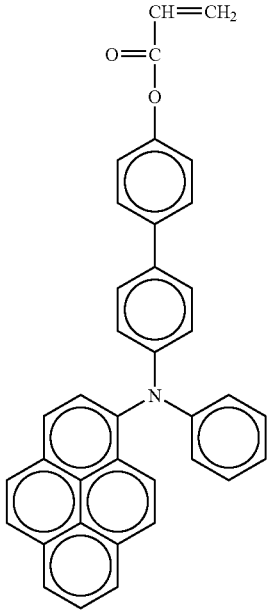
No.60
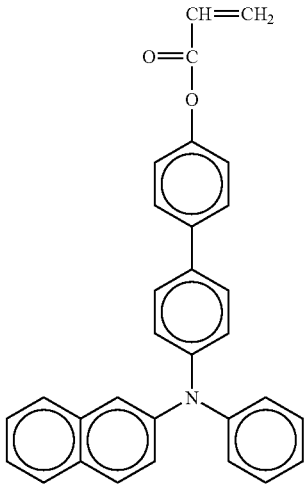

-continued
No.61
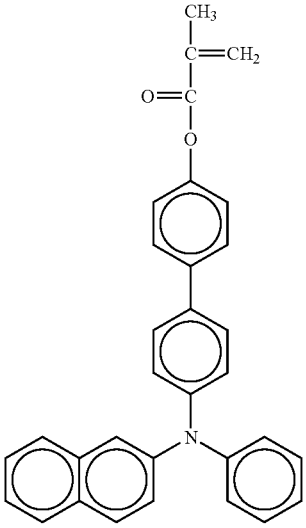
No.62
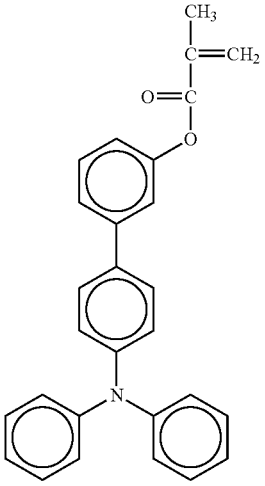
No.63
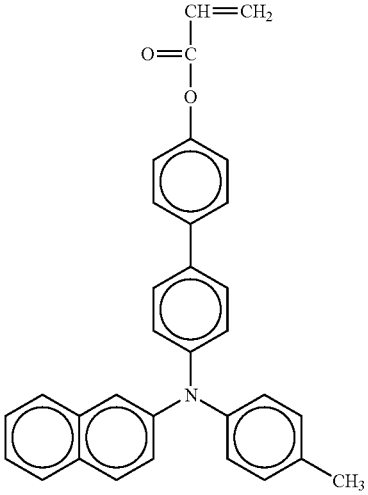
-continued
No.64
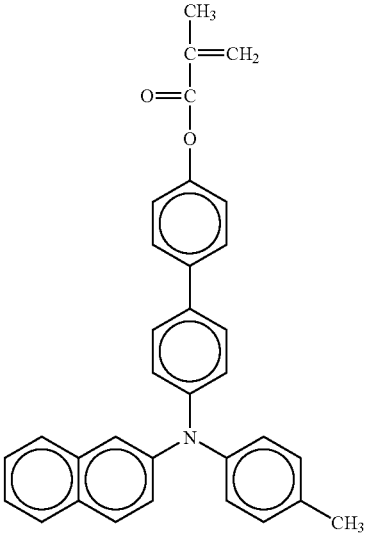
No.65
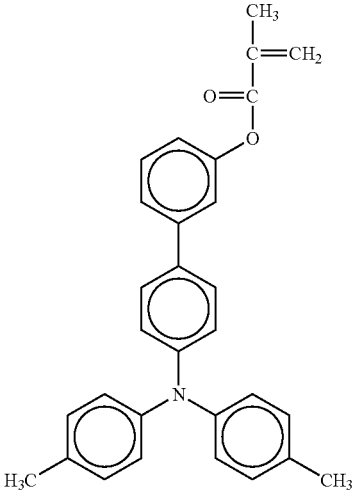
No.66
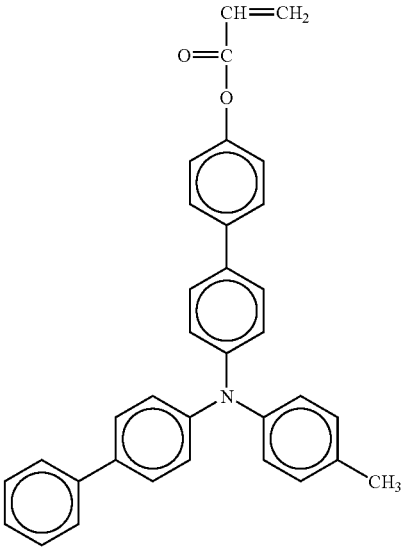

-continued
No.67
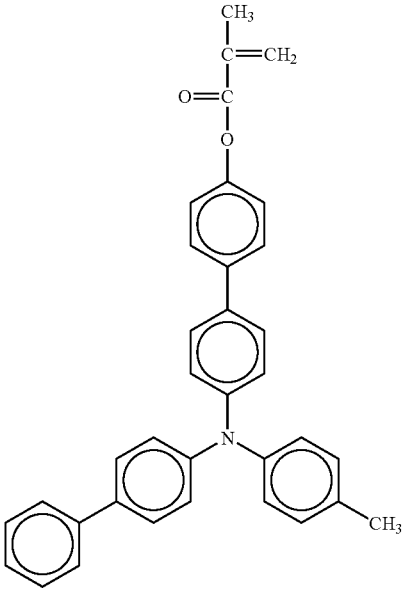
No.68
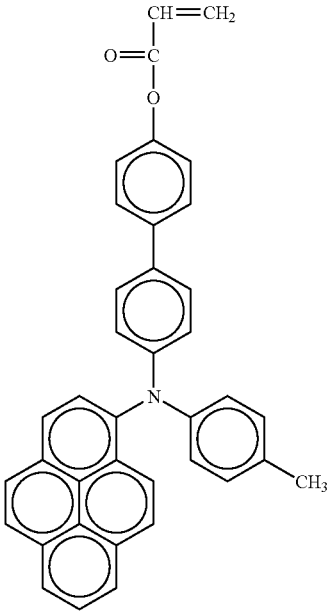
-continued
No.69
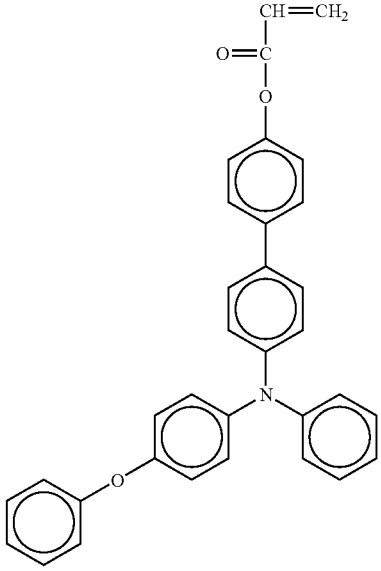
No.70
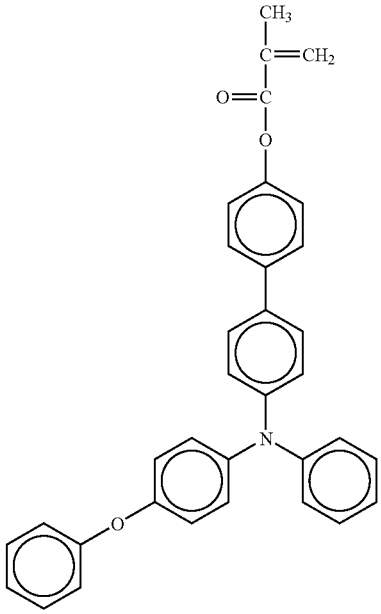

-continued
No.71
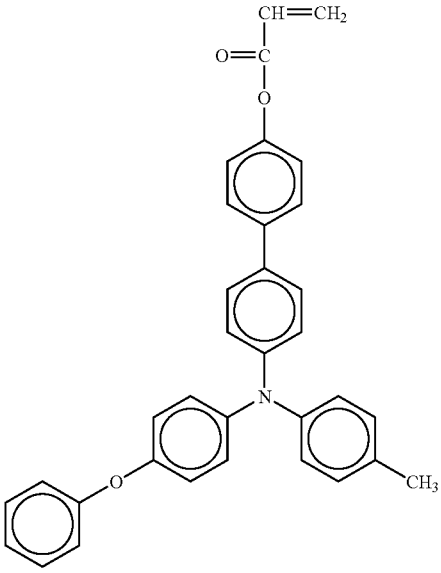
No.72
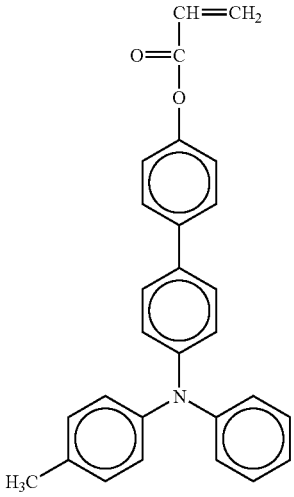
No.73
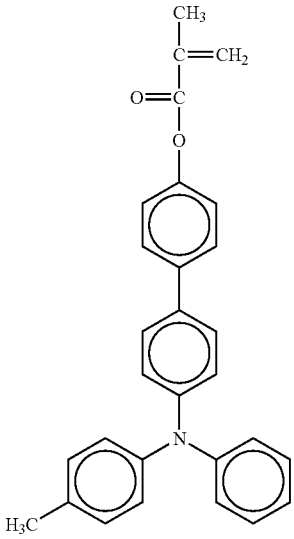
-continued
No.74
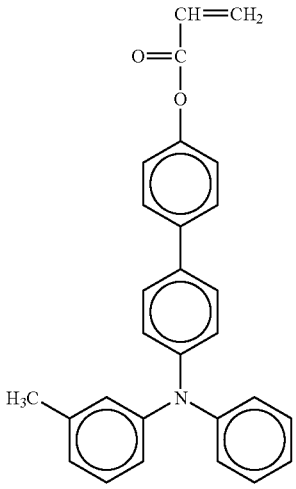
No.75
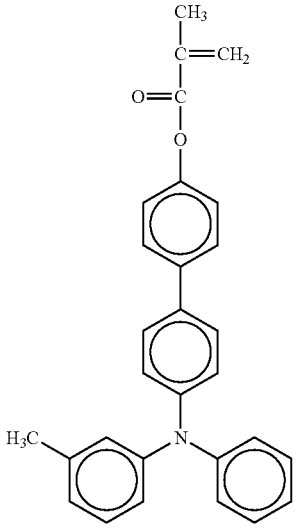
No.76
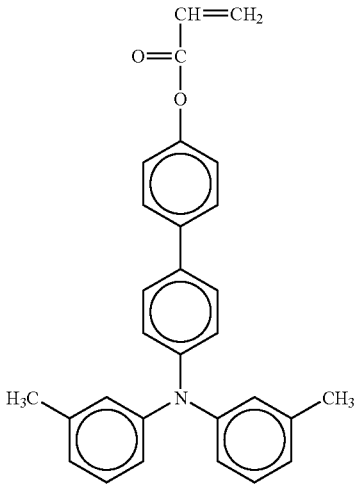

-continued
No.77
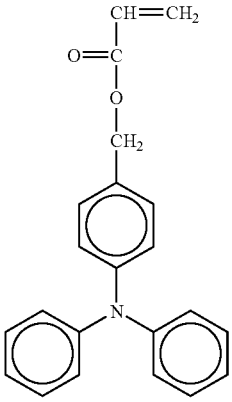
No.78
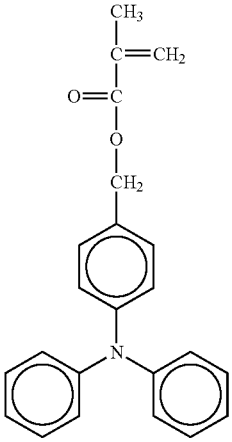
No.79
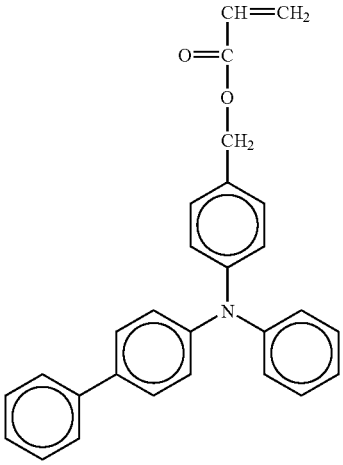
-continued
No.80
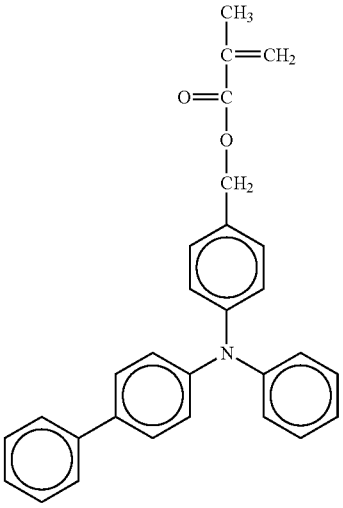
No.81
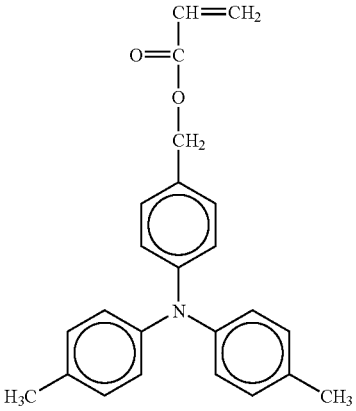
No.82
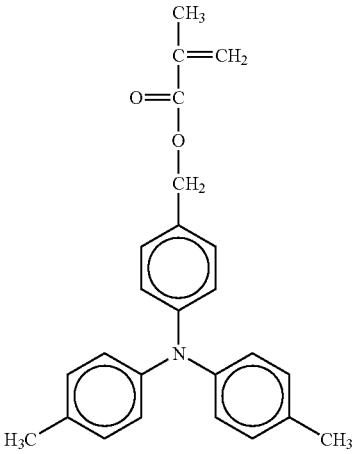

-continued
No.83
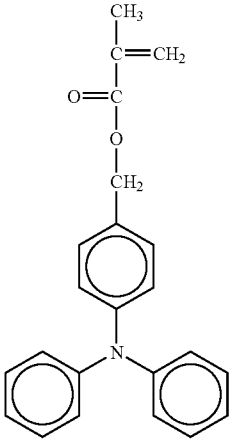
No.84
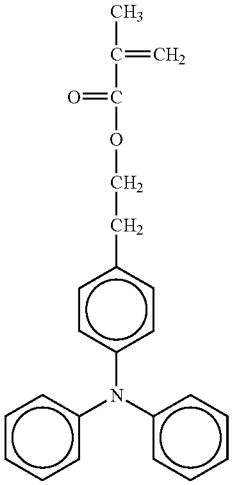
No.85
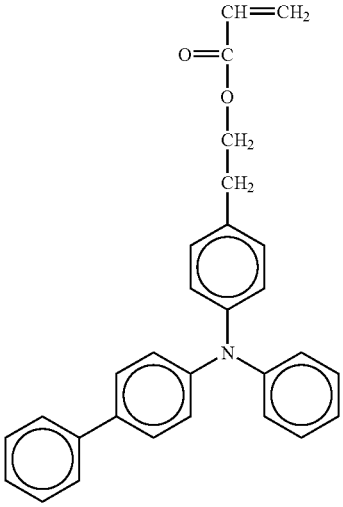
-continued
No.86
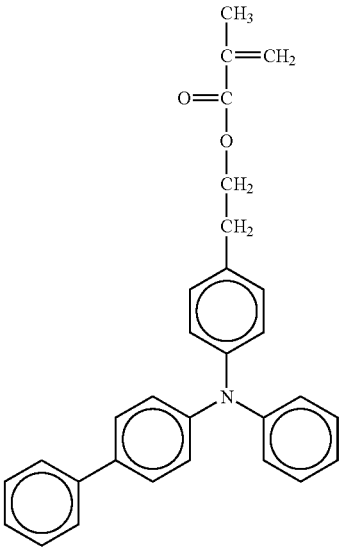
No.87
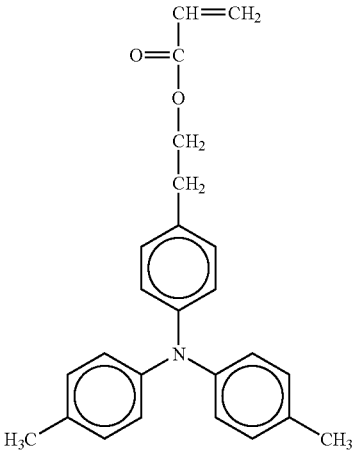
No.88
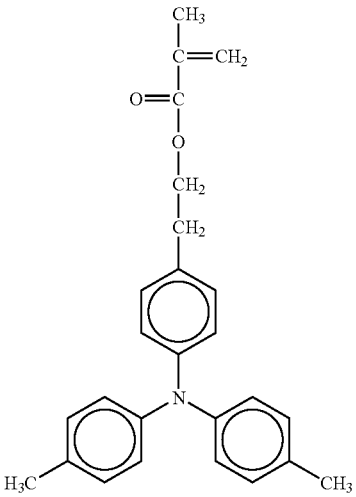

-continued
No.89
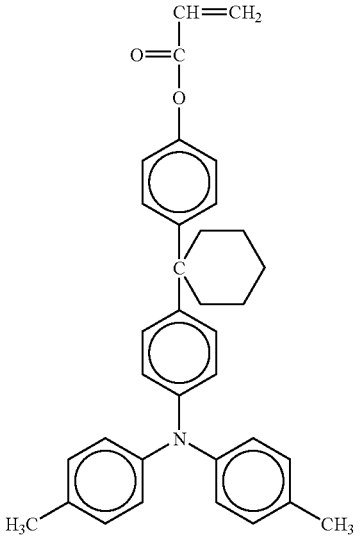
No.90
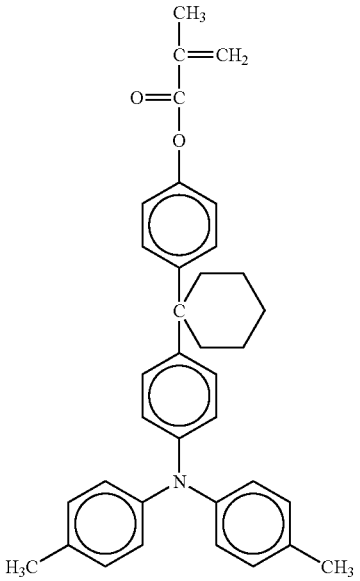
-continued
No.91
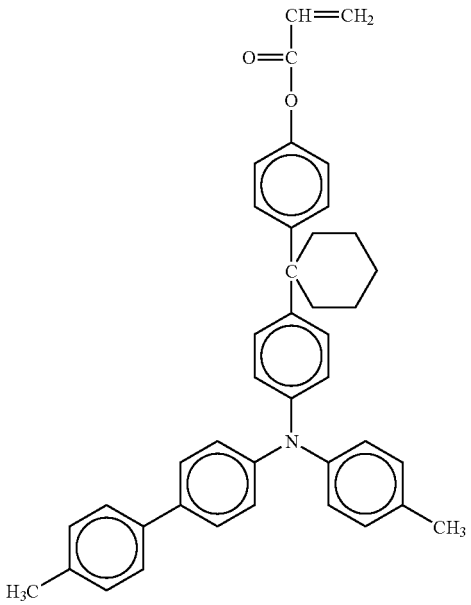
No.92
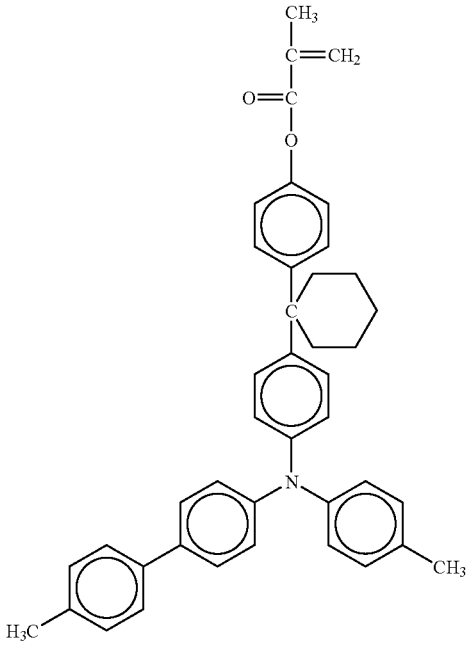

-continued
No.93
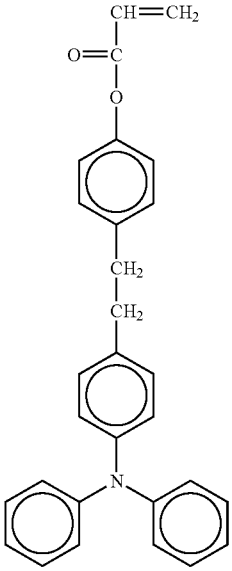
No.94
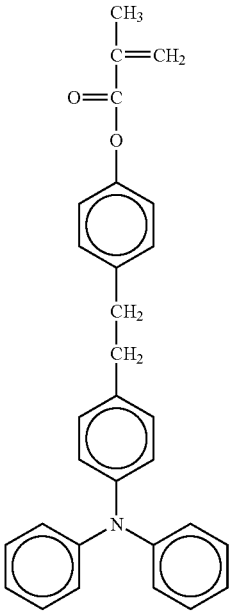
-continued
No.95
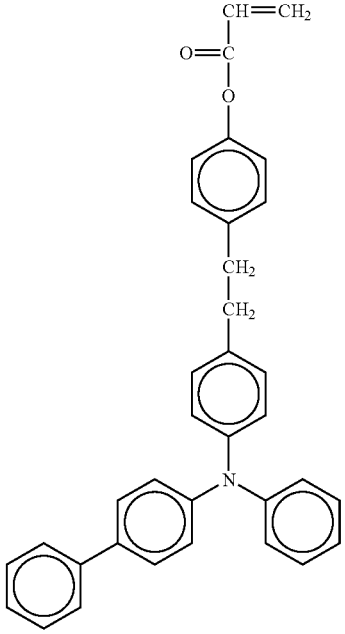
No.96
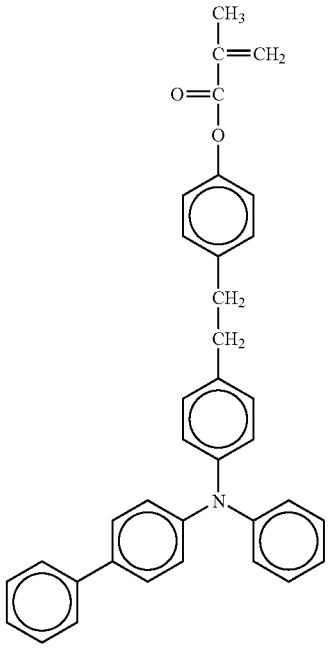

-continued
No.97
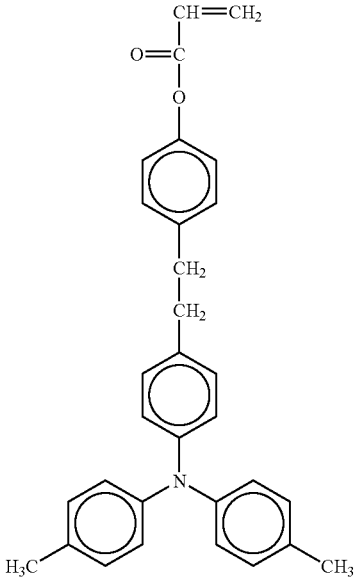
No.98
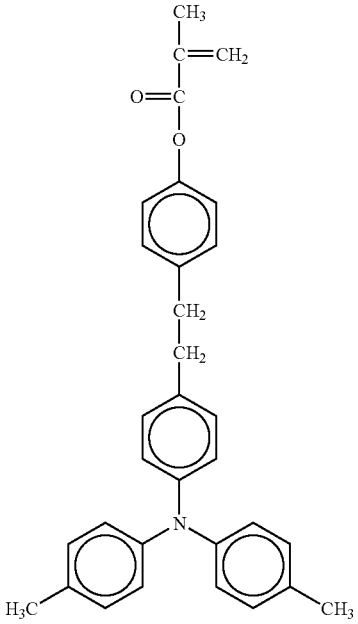
-continued
No.99
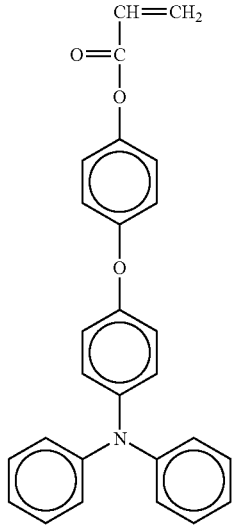
No.100
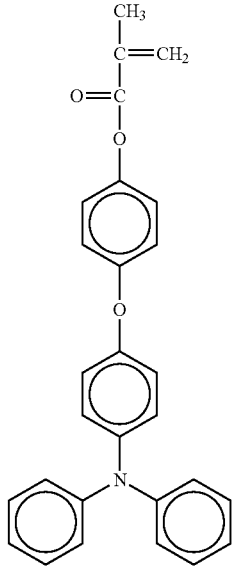
No.101
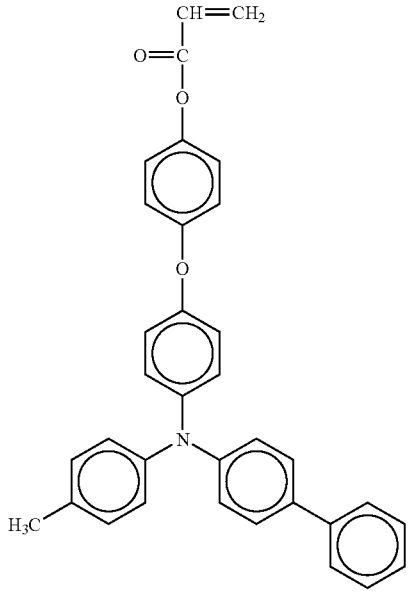

-continued
No.102
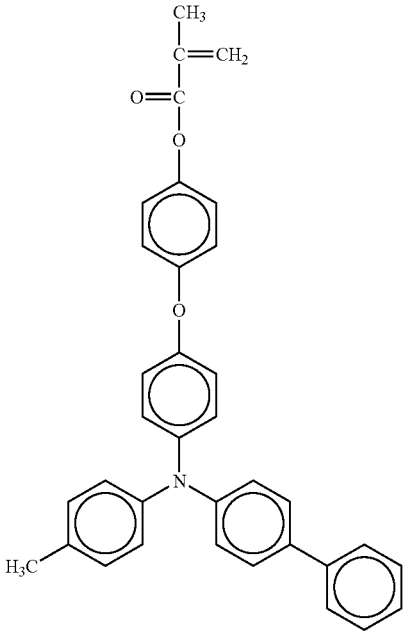
No.103
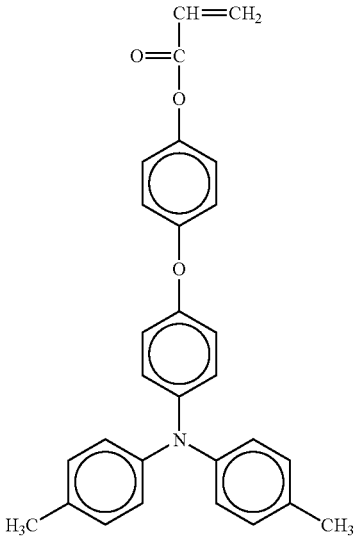
-continued
No.104
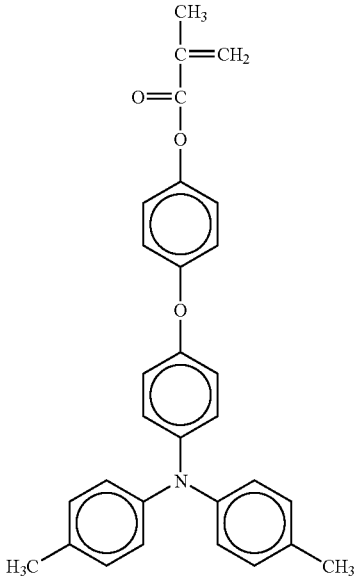
No.105
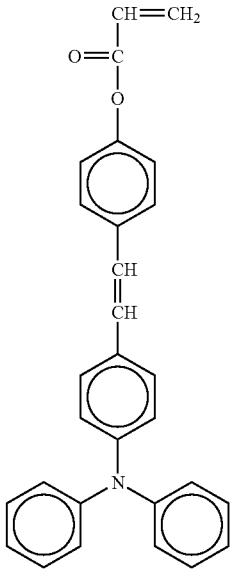

-continued
No.106
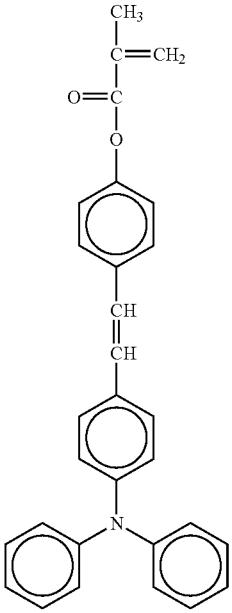
-continued
No.108
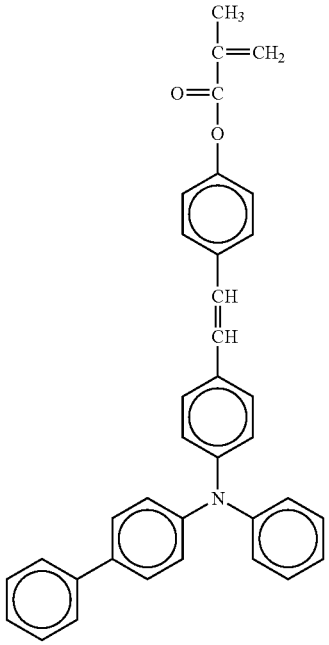
No.107
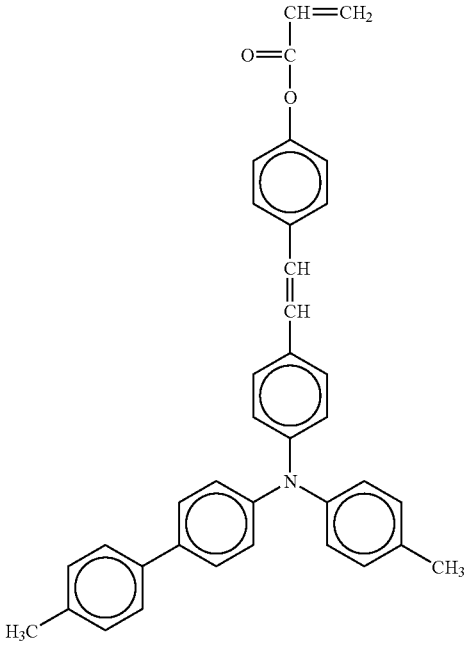
No.109
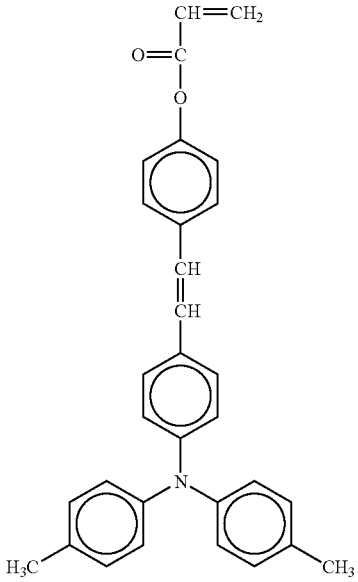

-continued
No.110
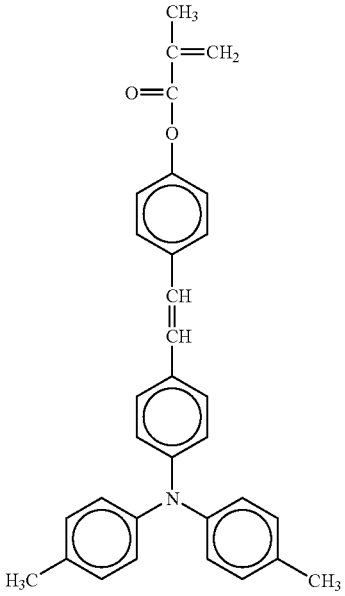
No.111
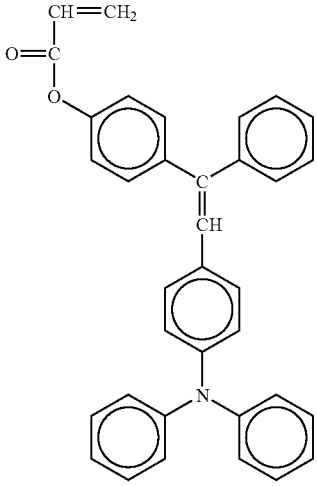
No.112
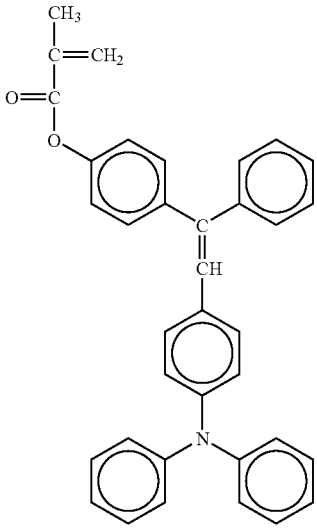
-continued
No.113
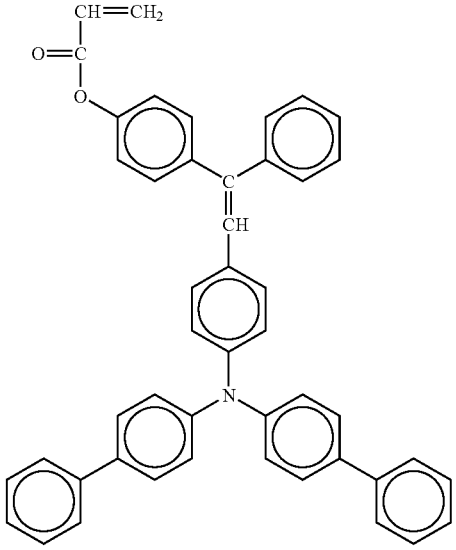
No.114
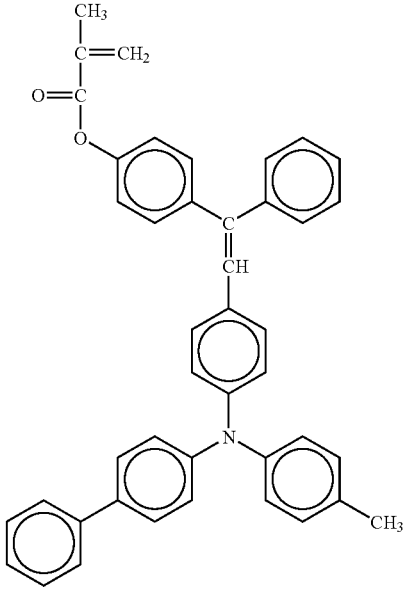
No.115
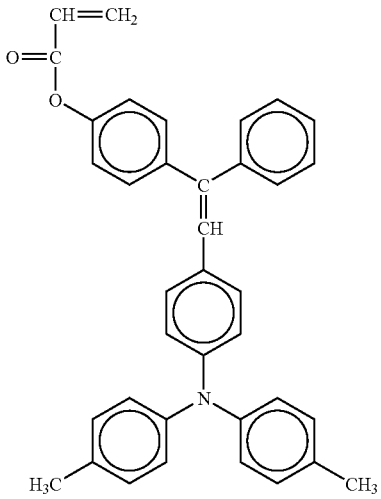

-continued
No.116
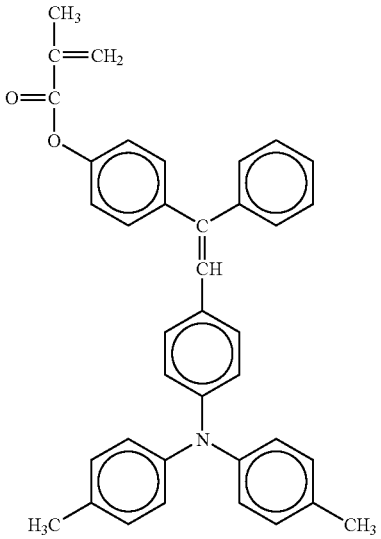
No.117
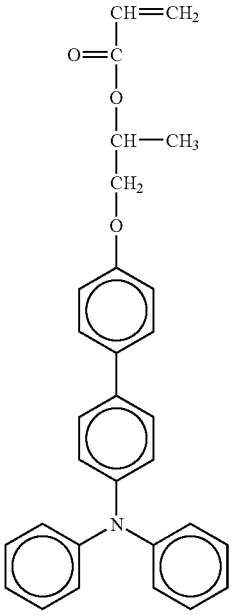
-continued
No.118
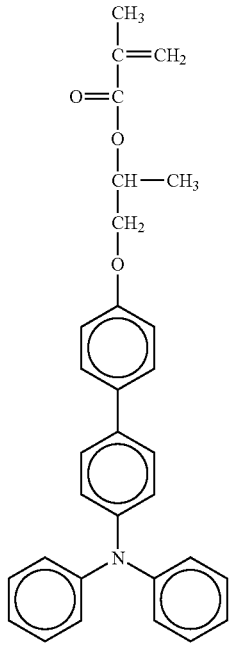
No.119
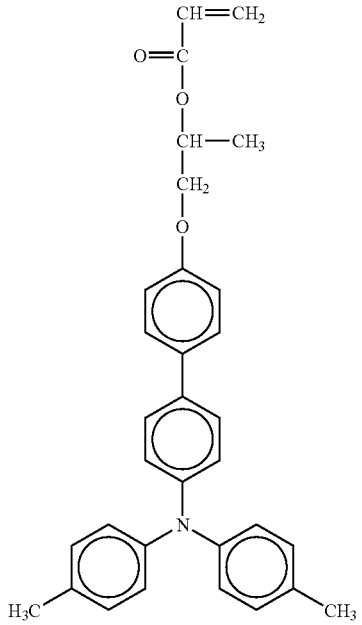

-continued
No.120
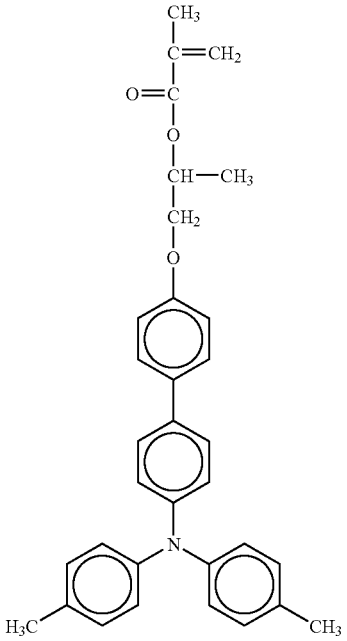
No.121
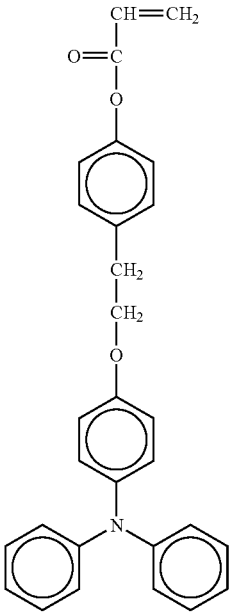
-continued
No.122
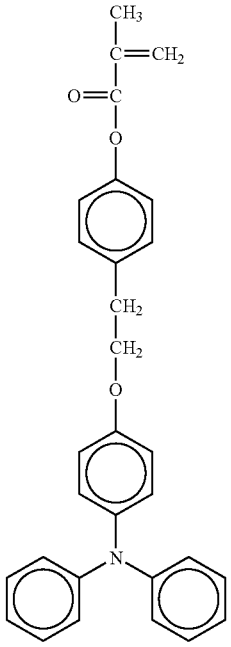
No.123
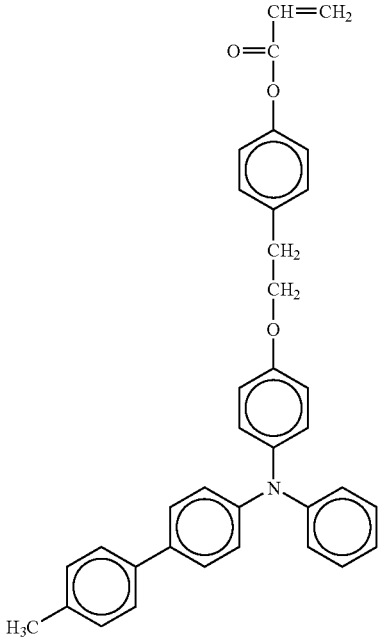

-continued
No.124
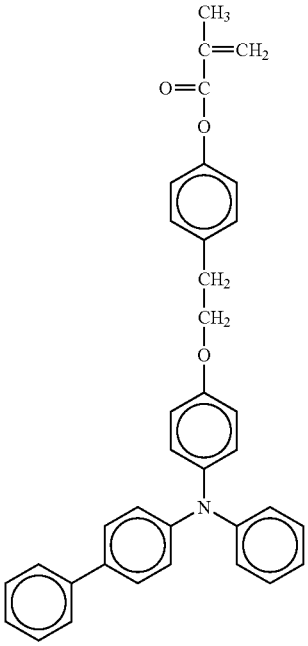
No.125
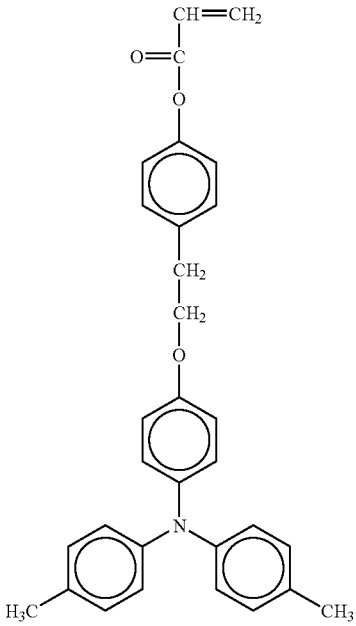
-continued
No.126
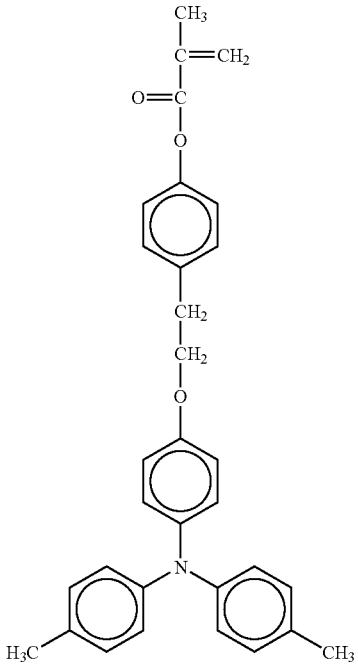
No.127
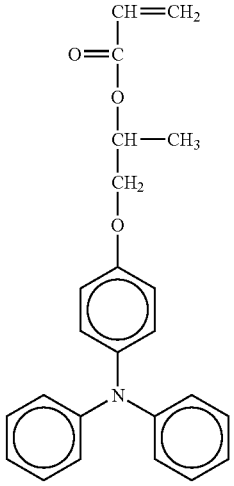
No.128
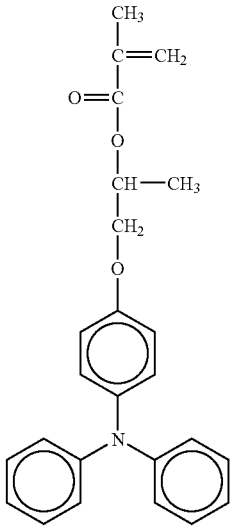

-continued
No.129
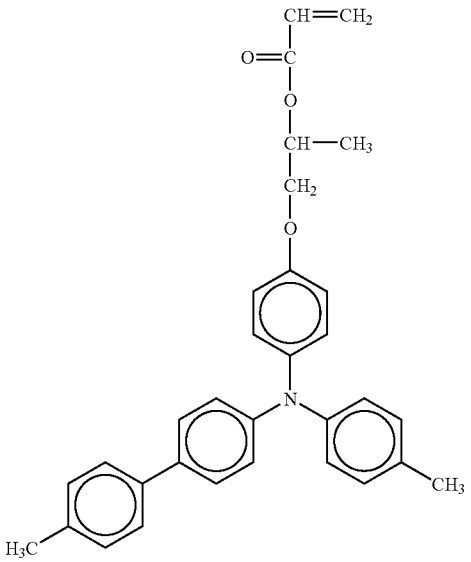
No.130
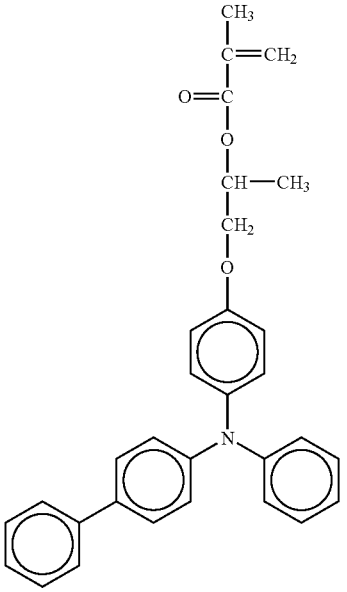
No.131
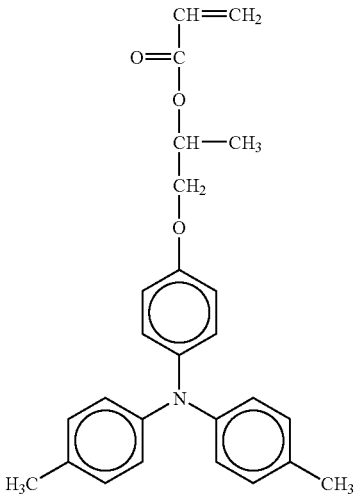
-continued
No.132
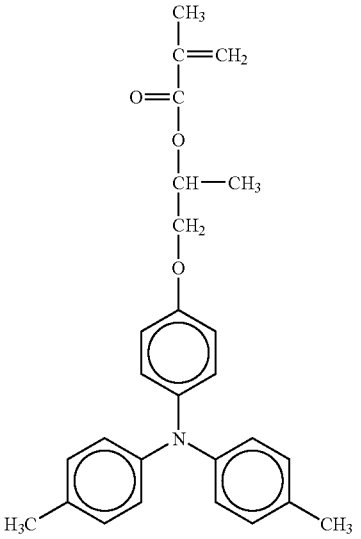
No.133
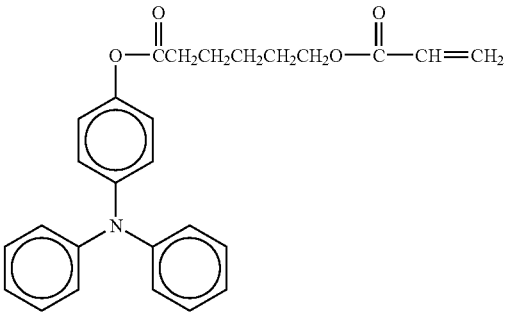
No.134
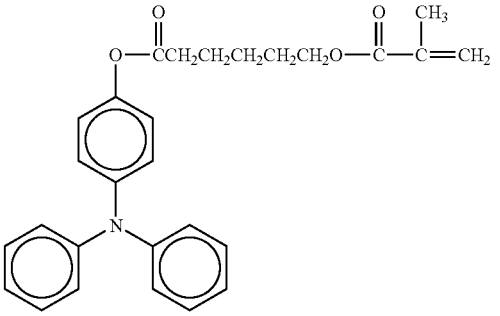
No.135
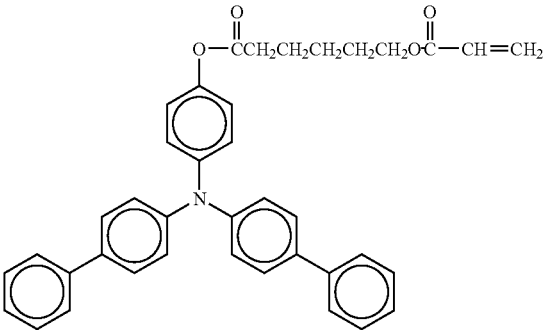

-continued
No.136
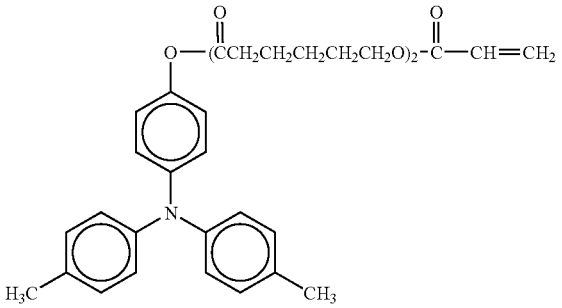
No.137
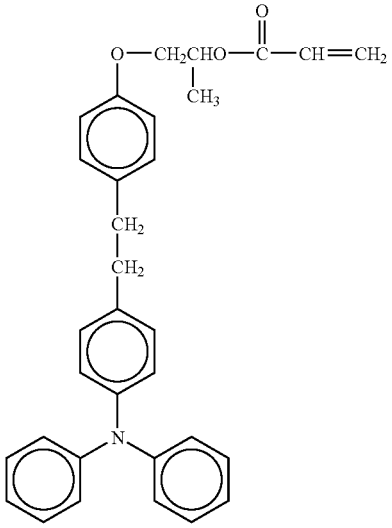
No.138
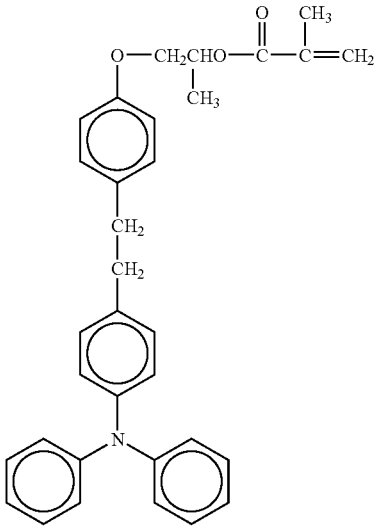
-continued
No.139
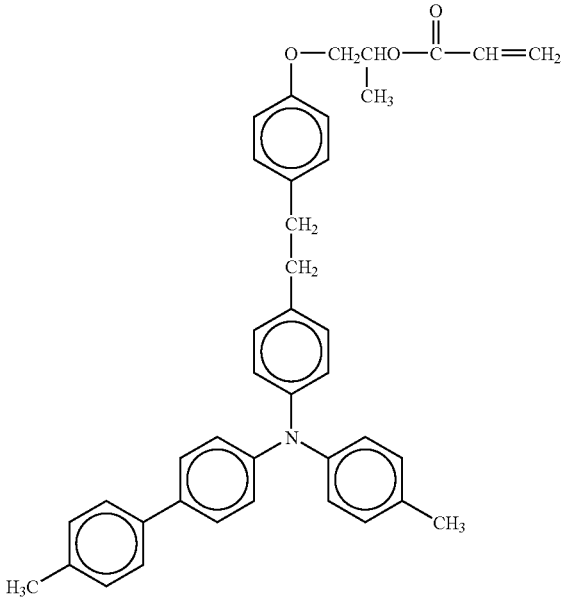
No.140
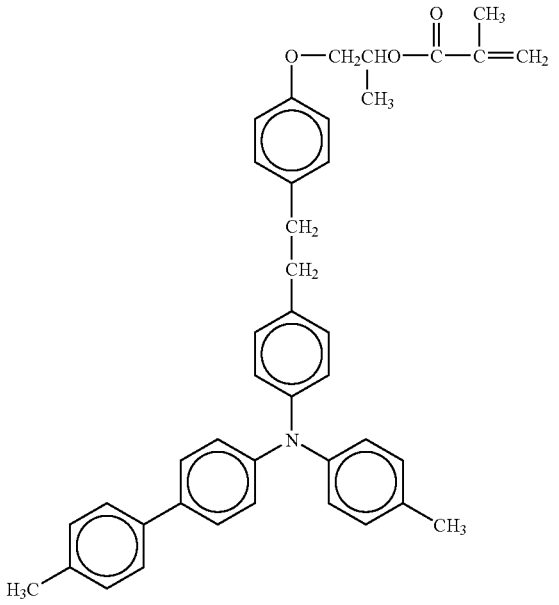

-continued
No.141
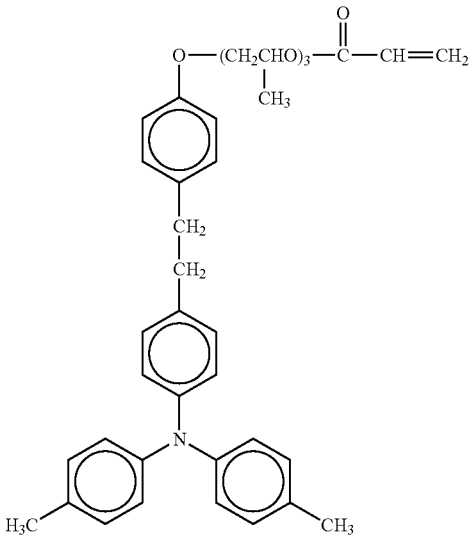
No.142
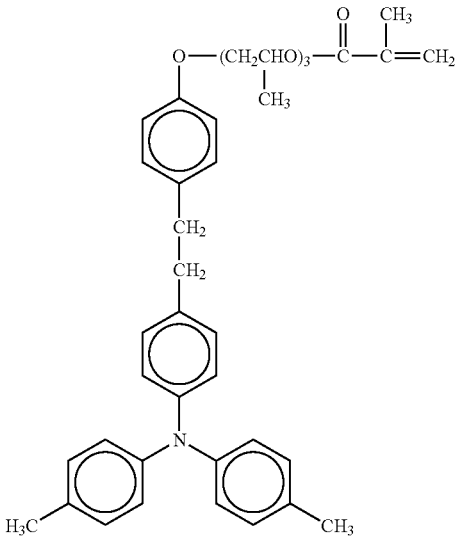
No.143
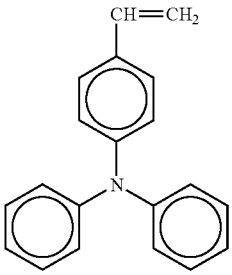
-continued
No.144
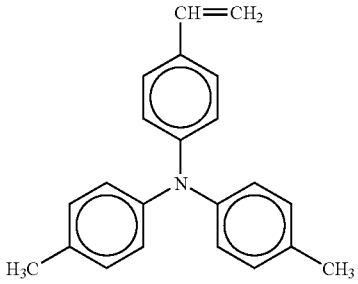
No.145
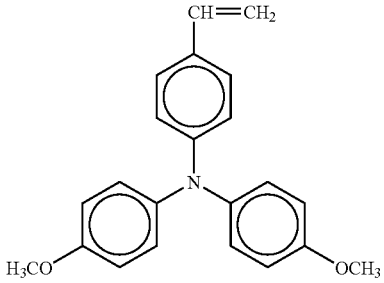
No.146
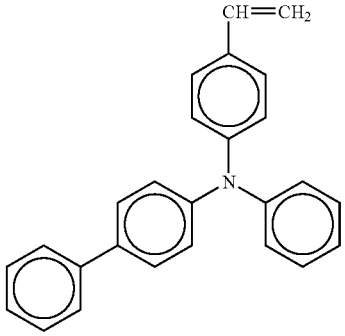
No.147
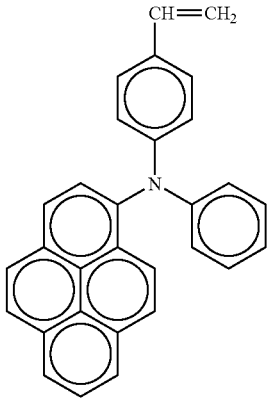
No.148
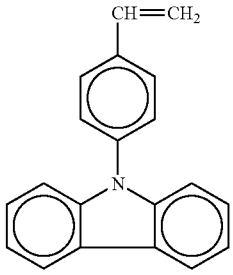

-continued
No.149
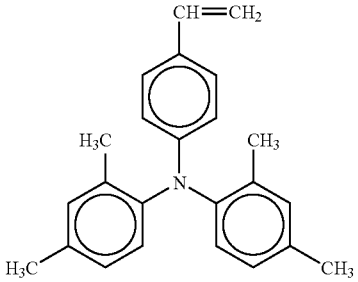
No.150
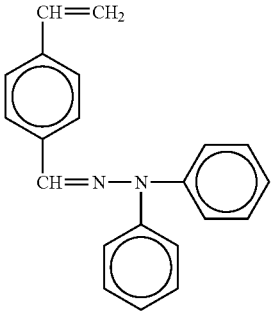
No.151
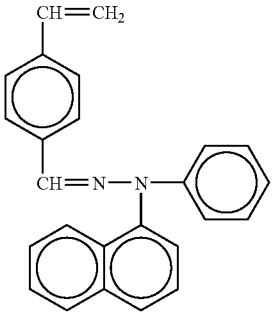
No.152
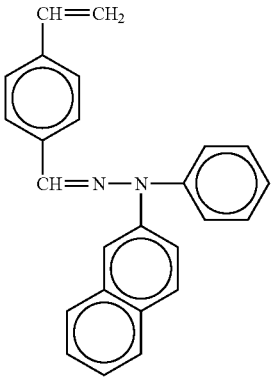
No.153
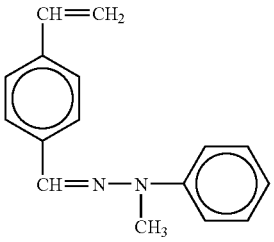
-continued
No.154
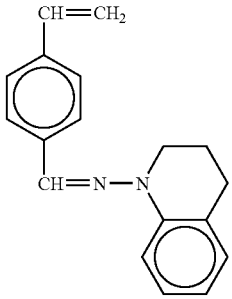
No.155
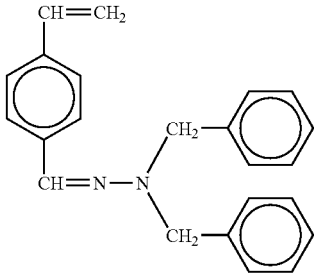
No.156
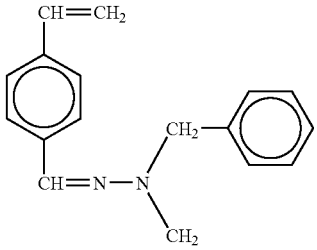
No.157
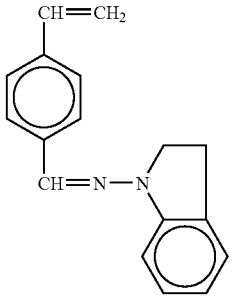
No.158
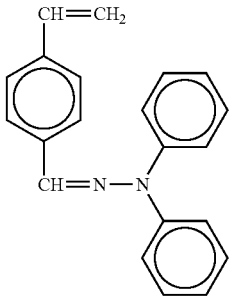

-continued
No.159
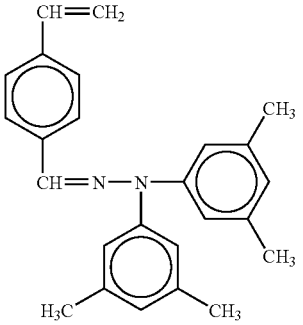
-continued
No.160
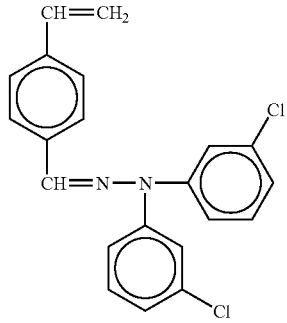
Specific examples of the radical polymerizable monomer (compound) having two functional groups with a charge transport structure include, but are not limited to, the following.
NO. 242
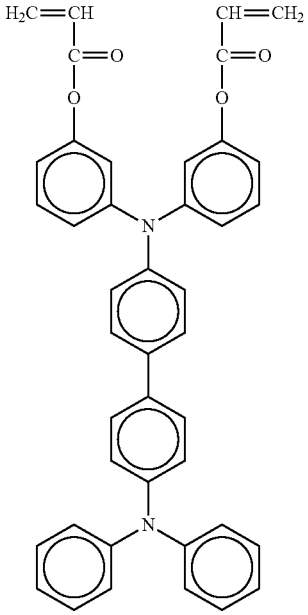
NO. 243
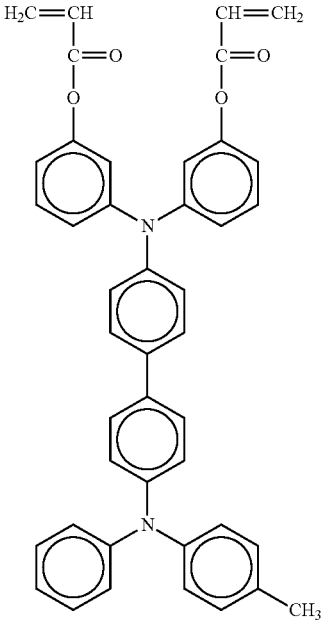
NO. 244
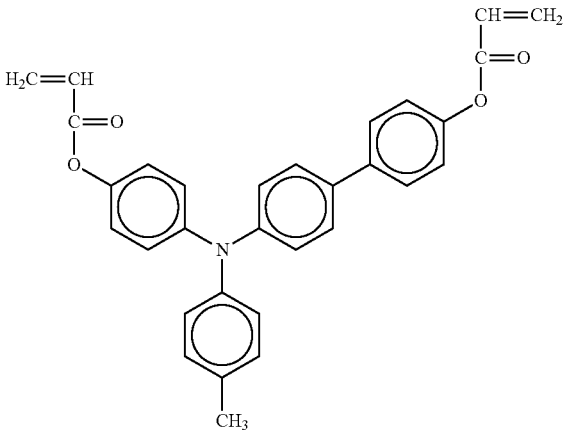

-continued
NO. 245
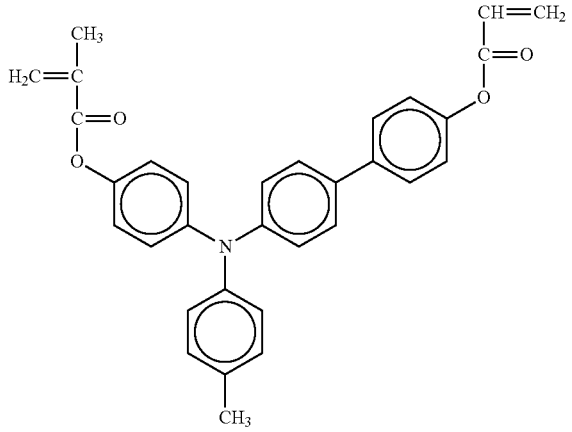
NO. 246
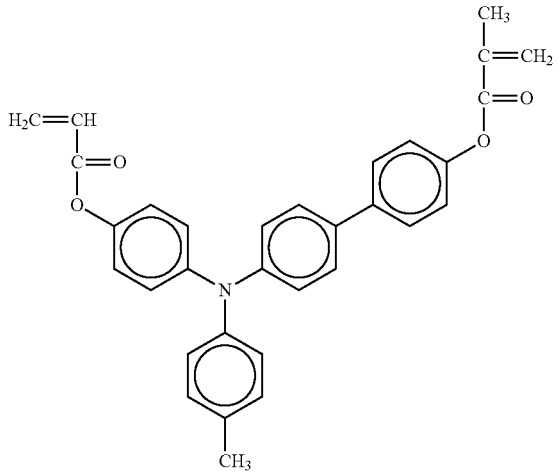
NO. 247
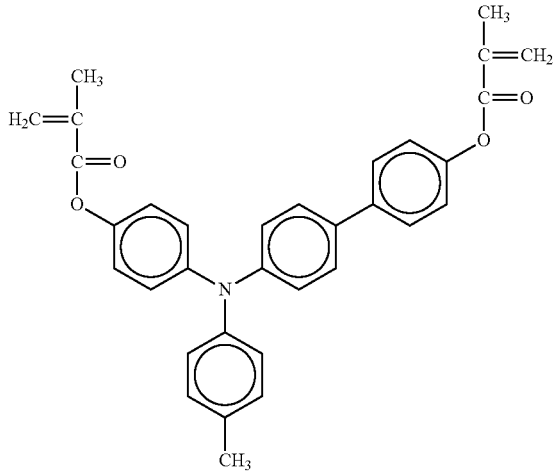

-continued
NO. 248
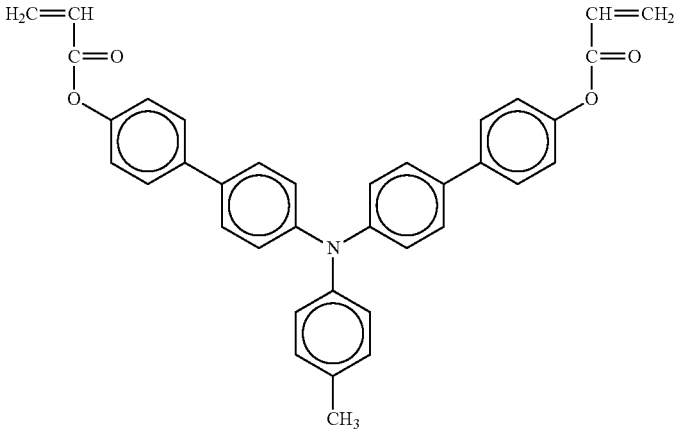
NO. 249
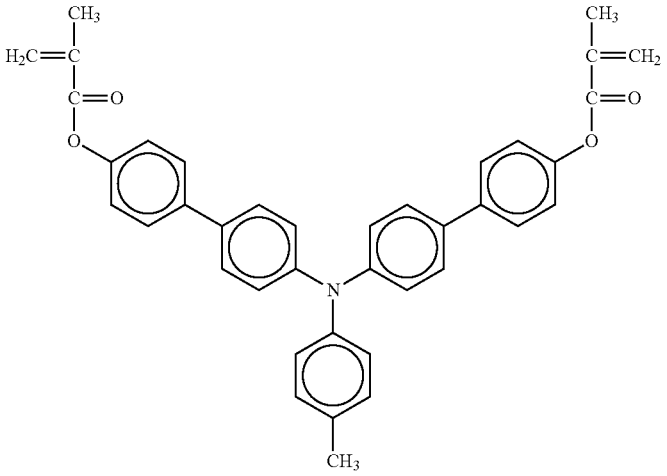
NO. 250
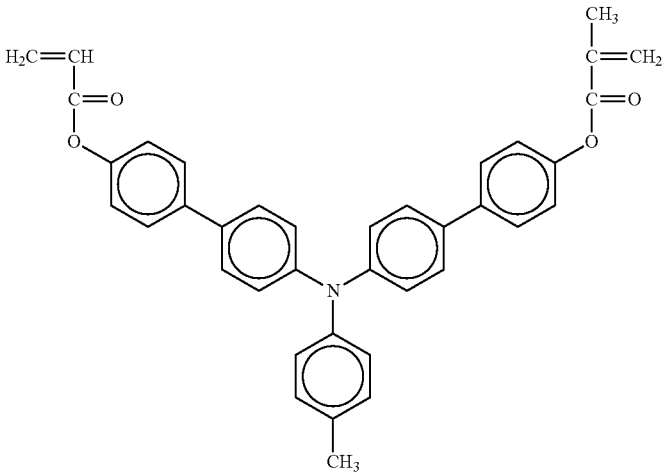

-continued
NO. 251
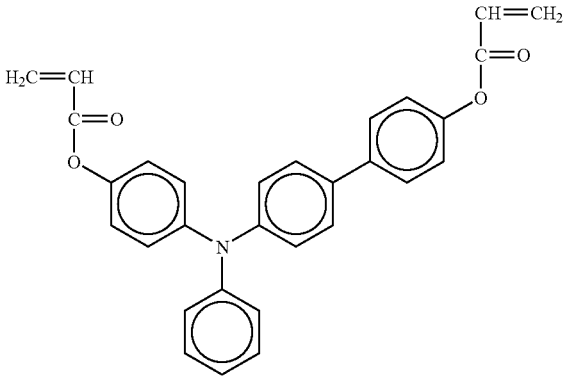
NO. 252
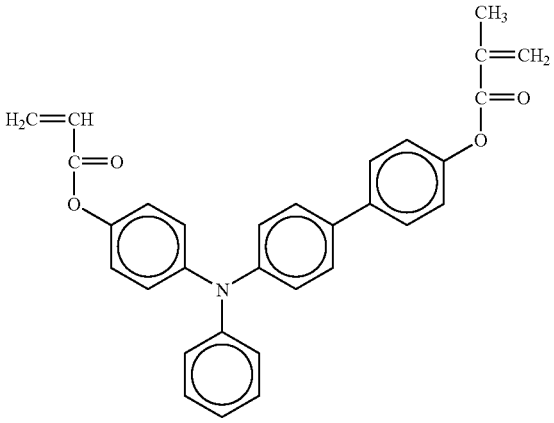
NO.253
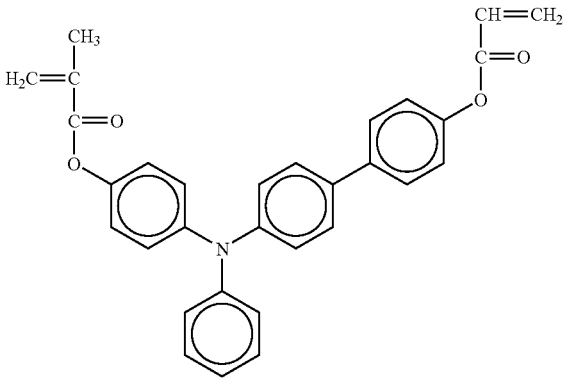
NO. 254
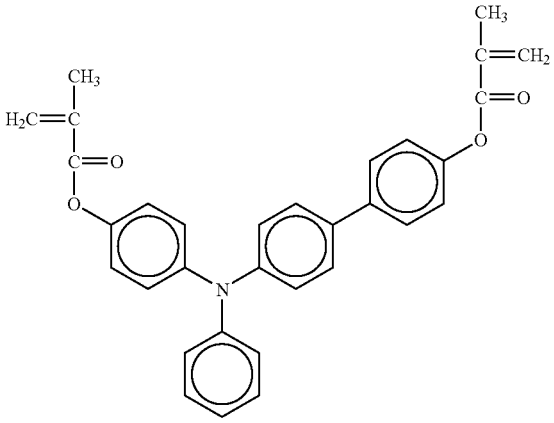

-continued
NO. 255
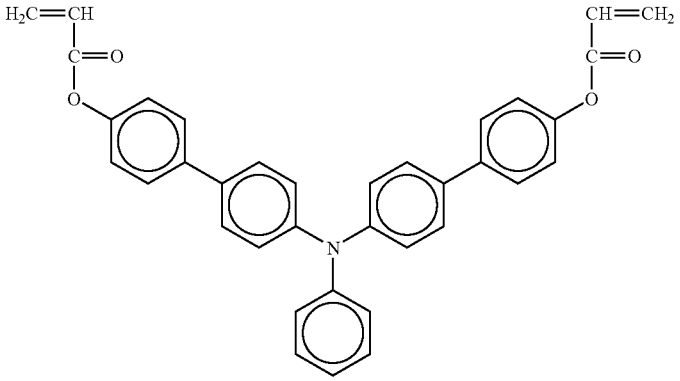
NO. 256
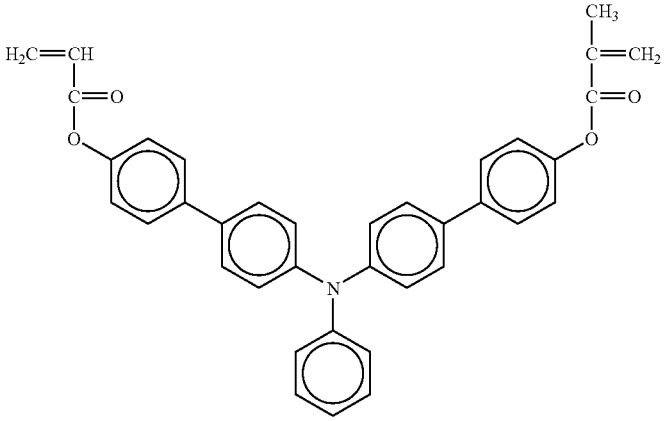
NO. 257
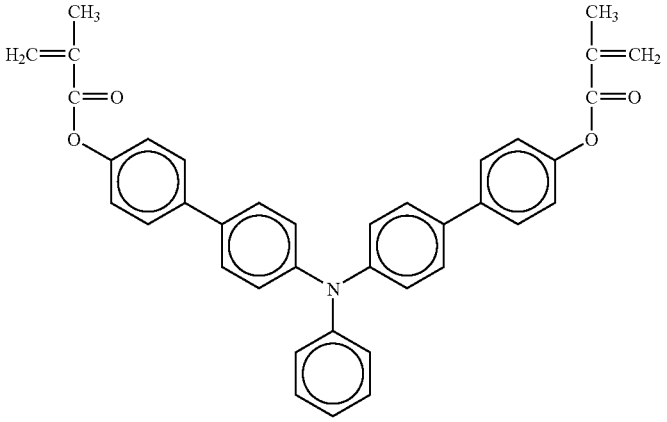

-continued
NO. 258
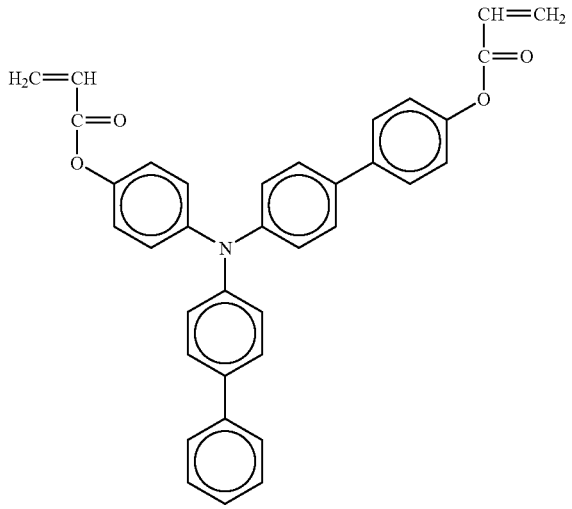
NO. 259
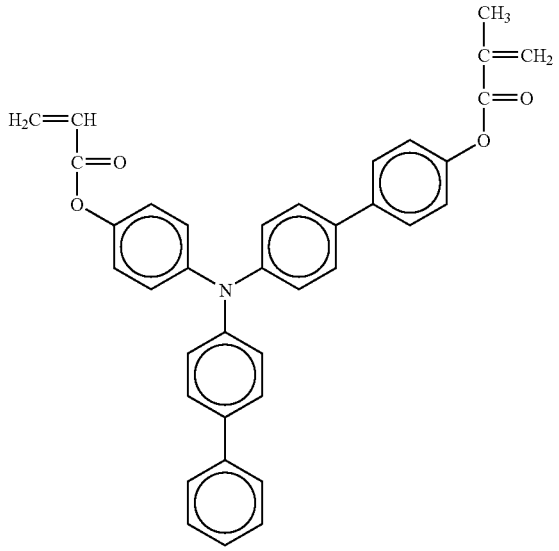
NO. 260
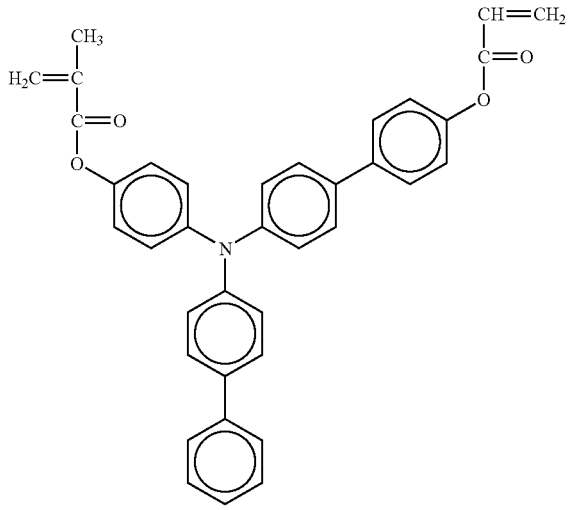

-continued
NO. 261
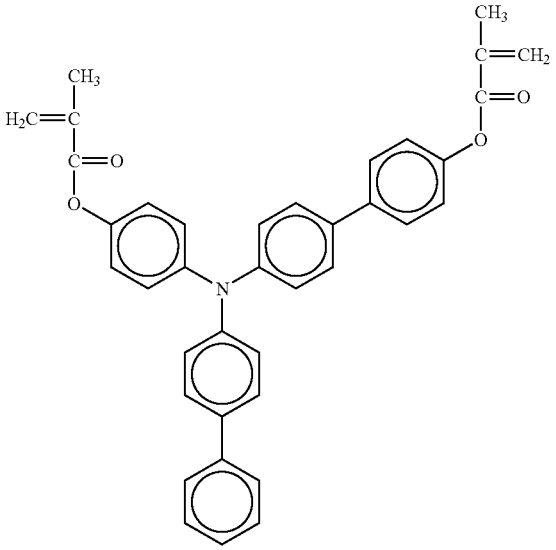
NO. 262
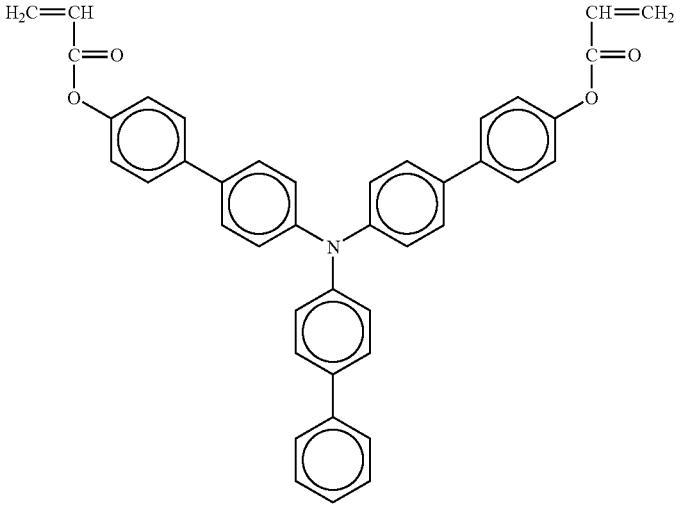
NO. 263
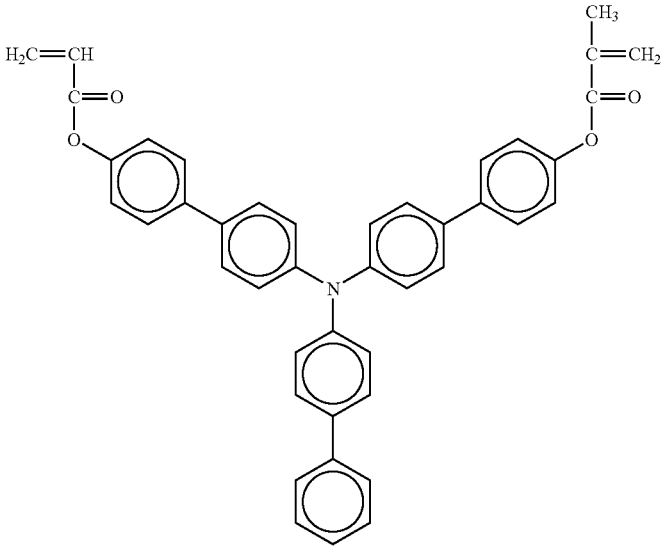

-continued
NO. 264
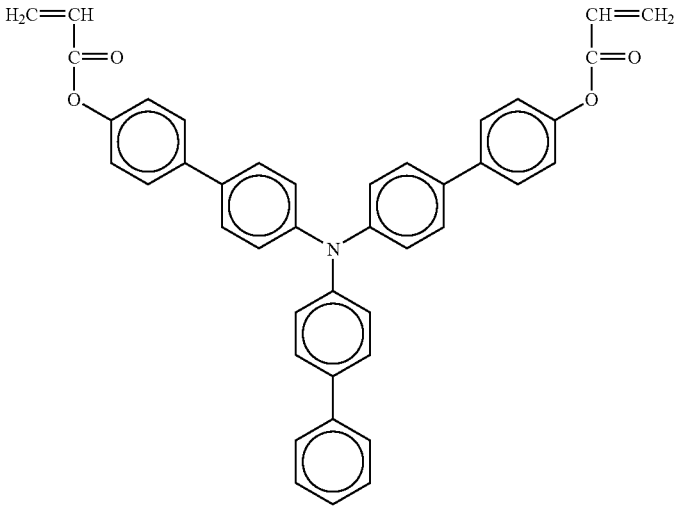
NO. 265
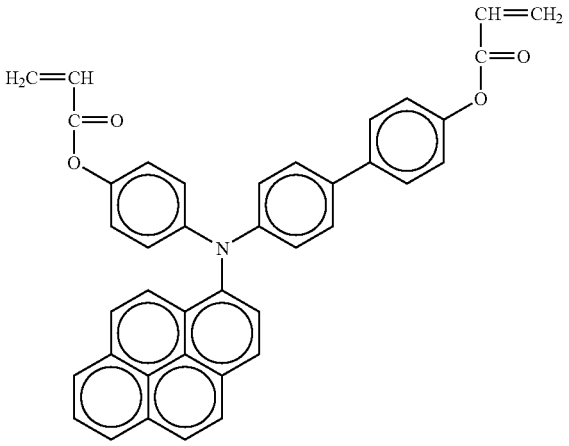
NO. 266
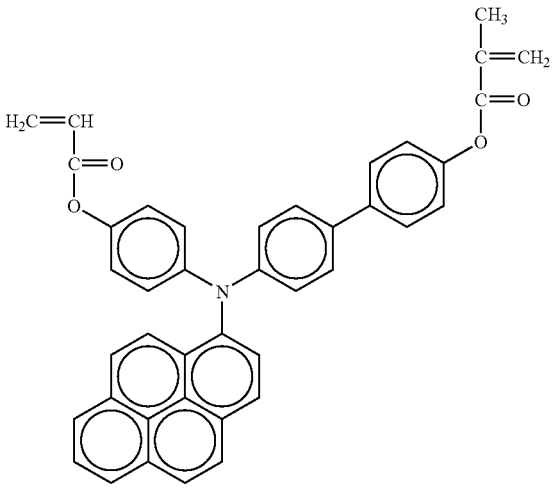

-continued
NO. 267
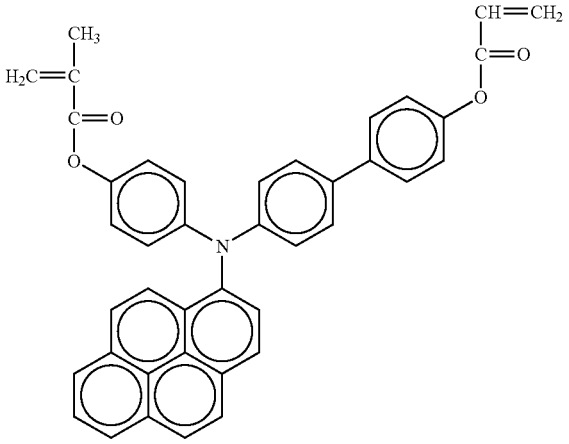
NO. 268
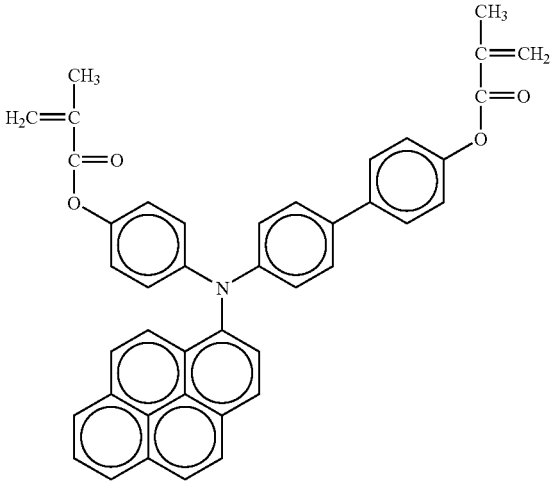
NO. 269
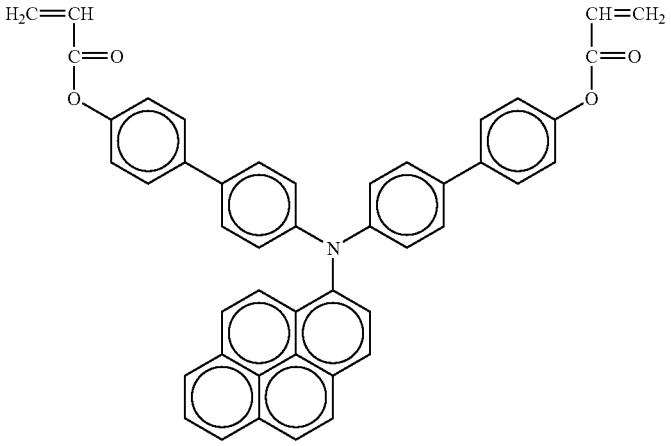

-continued
NO. 270
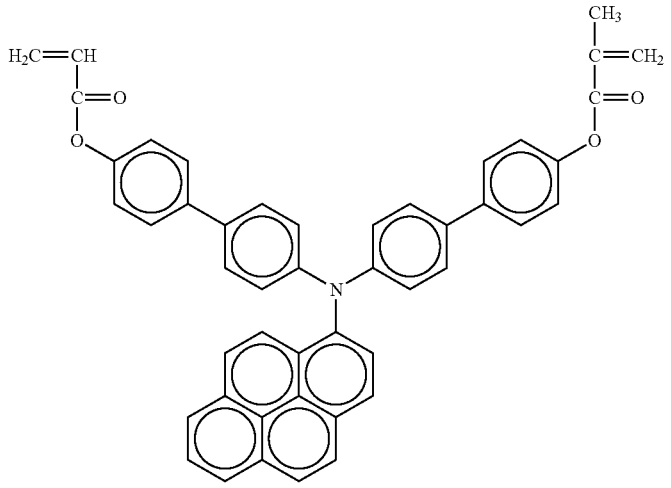
NO. 271
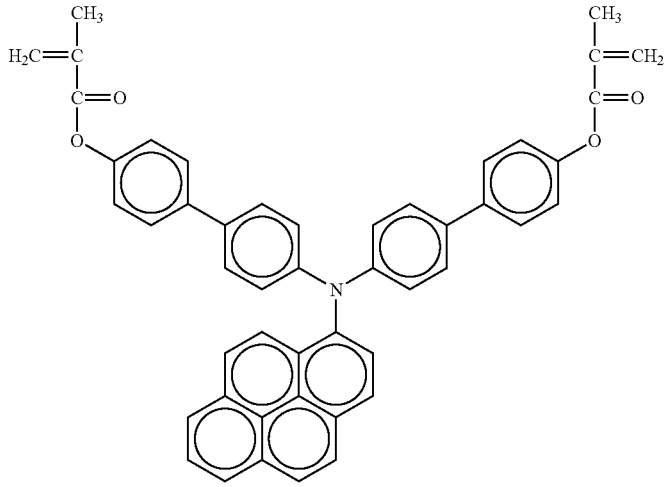
NO. 272
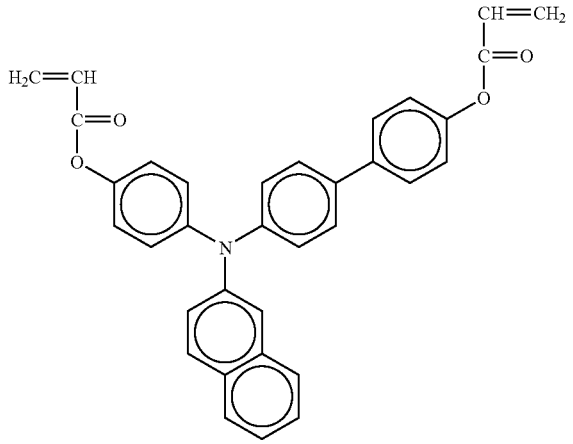

-continued
NO. 273
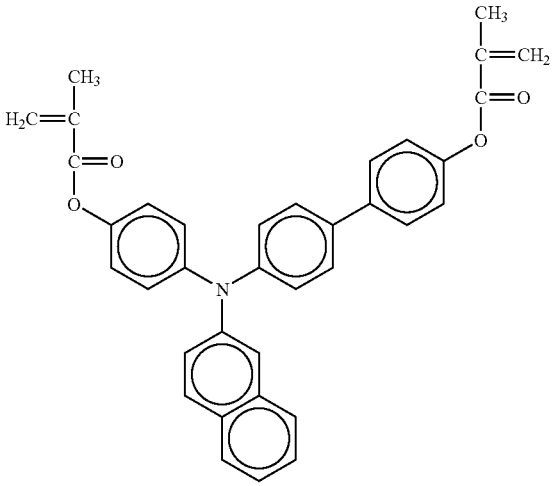
NO. 274
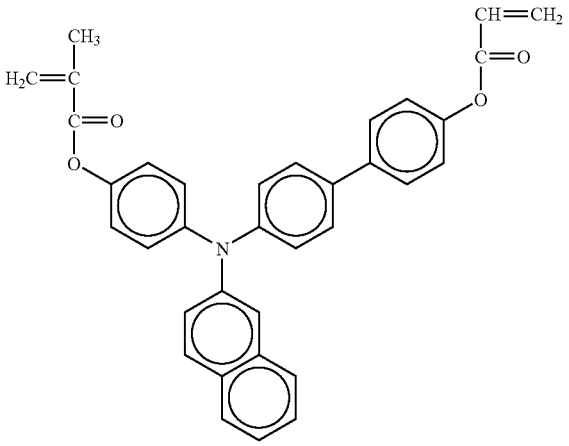
NO. 275
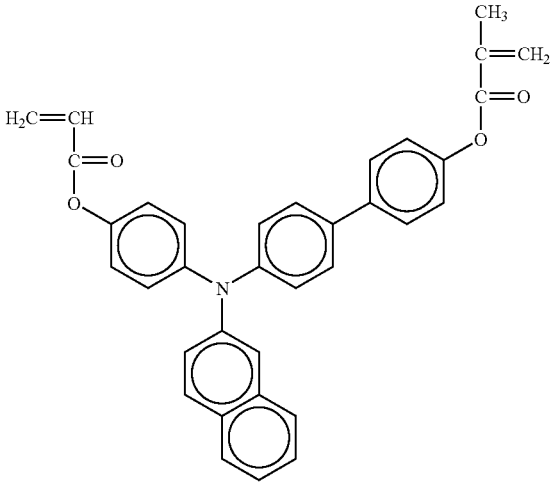

-continued
NO. 276
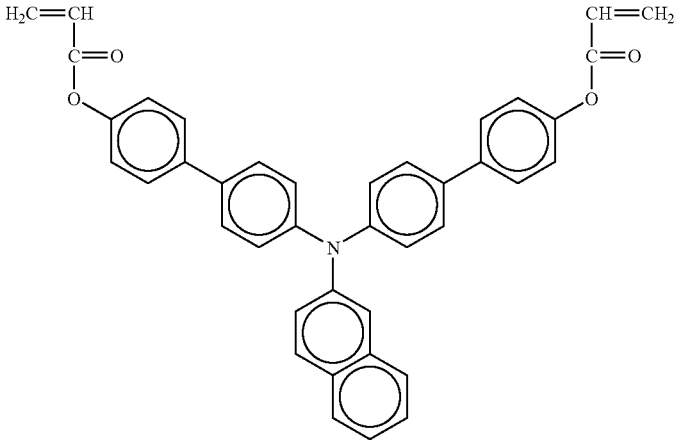
NO. 277
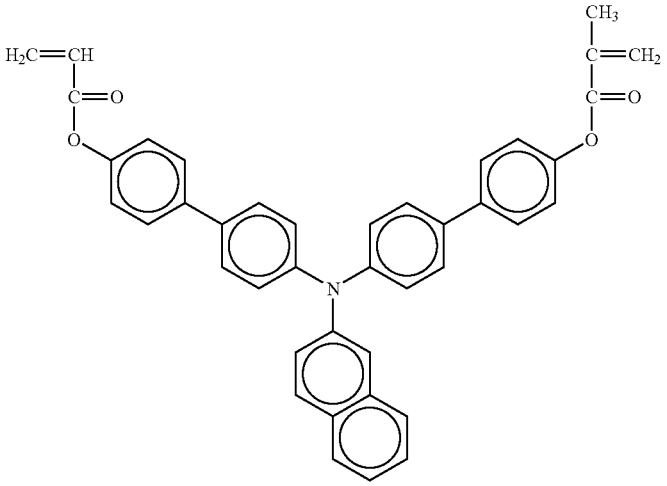
NO. 278
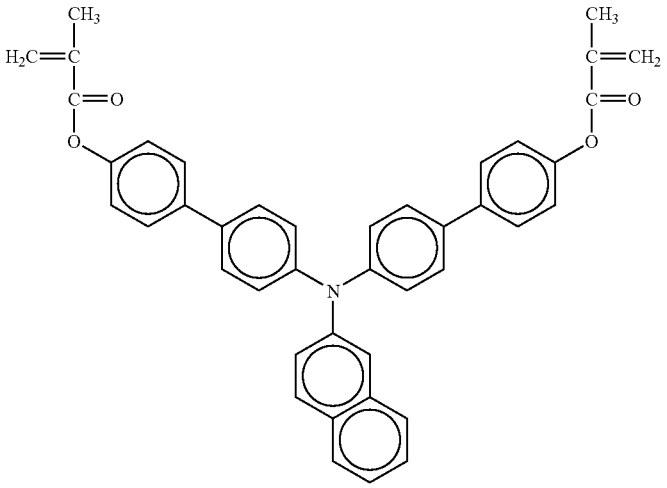

-continued
NO. 279
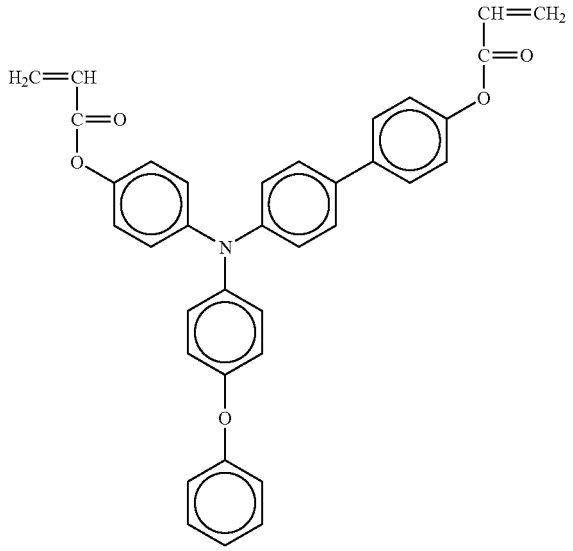
NO. 280
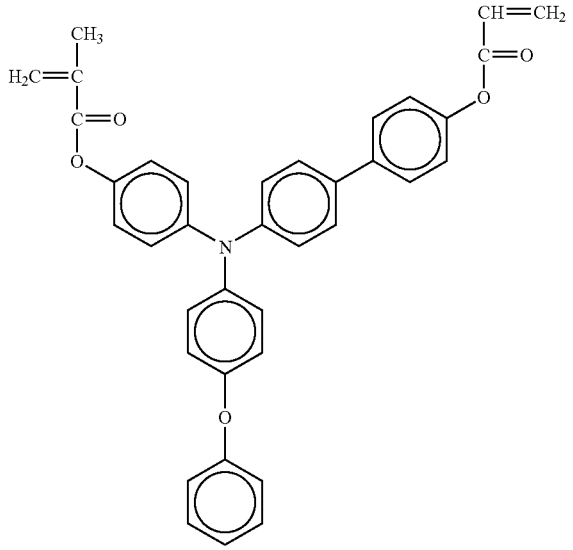
NO. 281
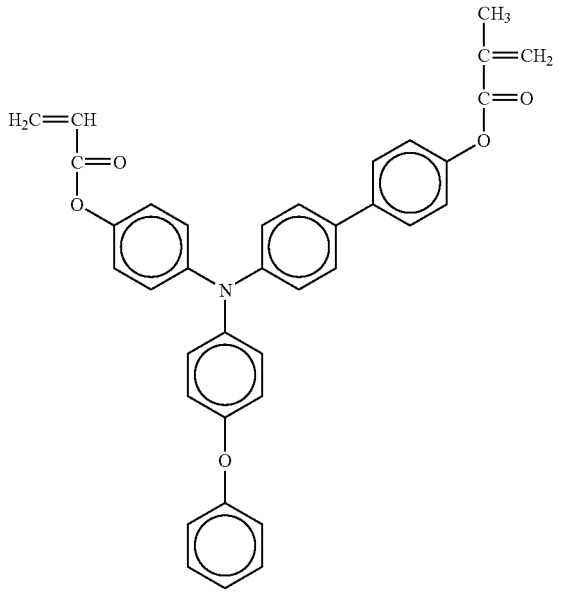

-continued
NO. 282
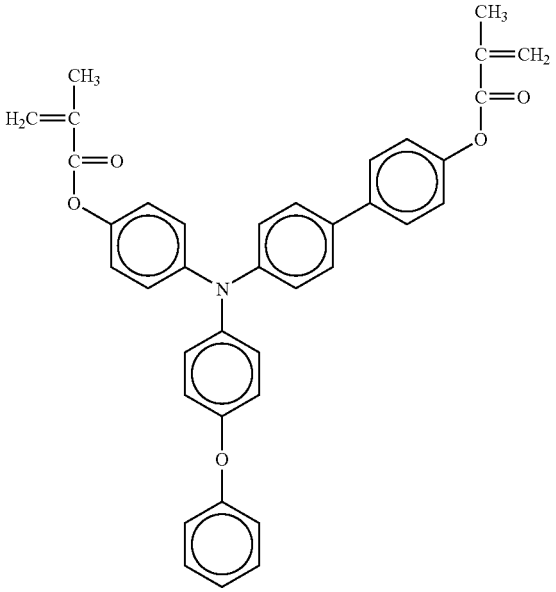
NO. 283
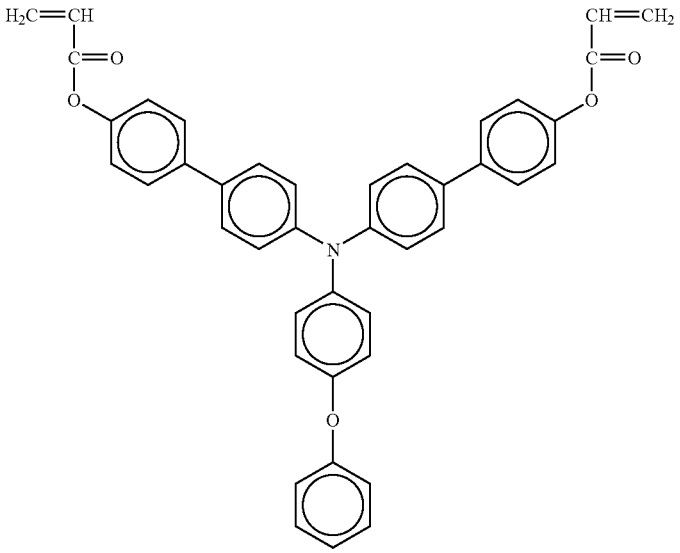

-continued
NO. 284
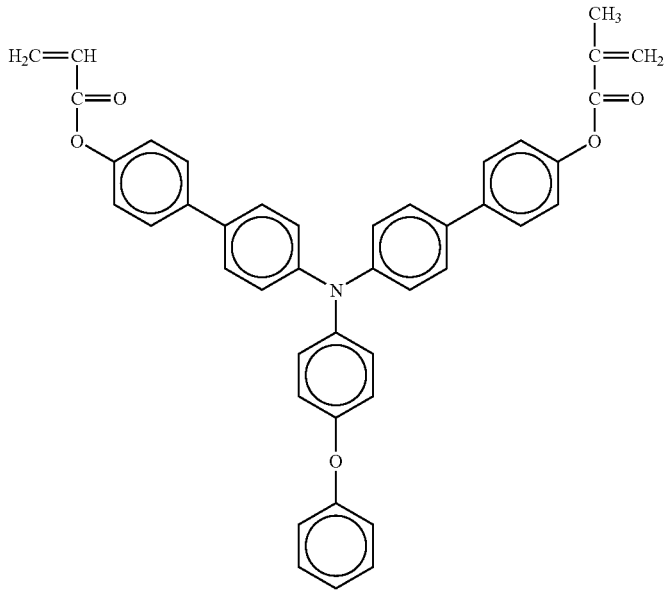
NO. 285
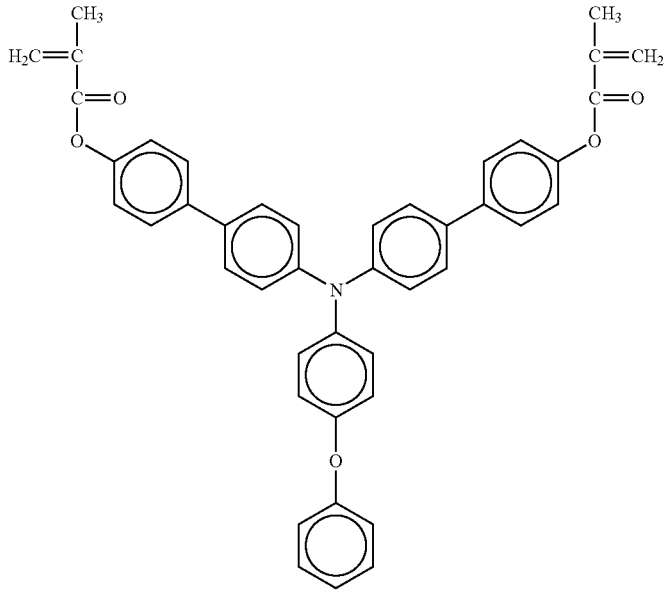
NO. 286
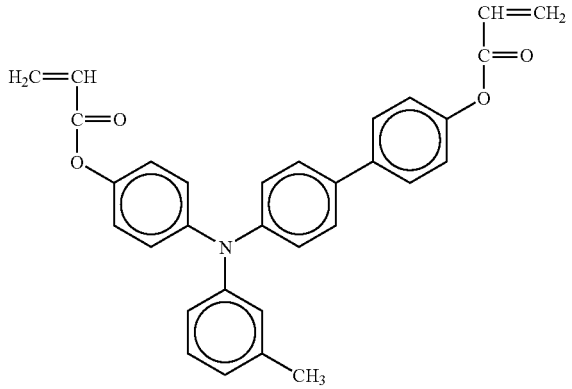

-continued
NO. 287
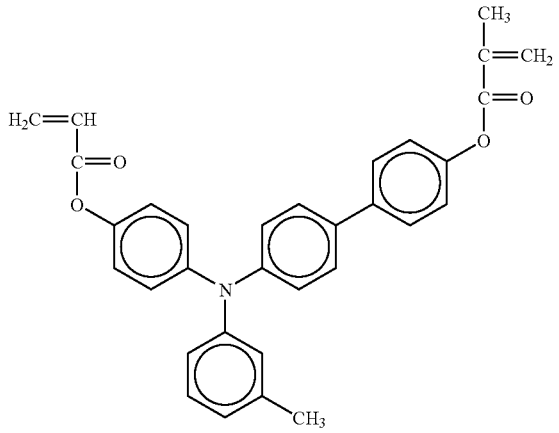
NO. 288
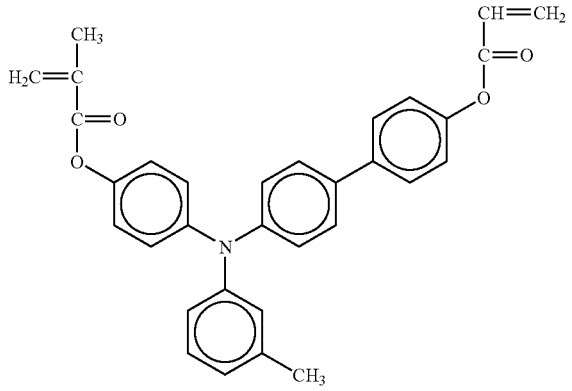
NO. 289
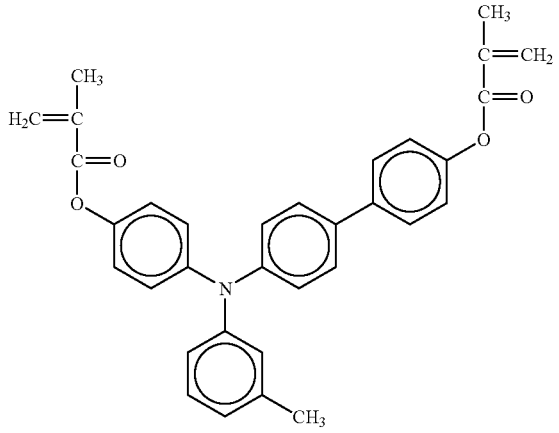
NO. 290
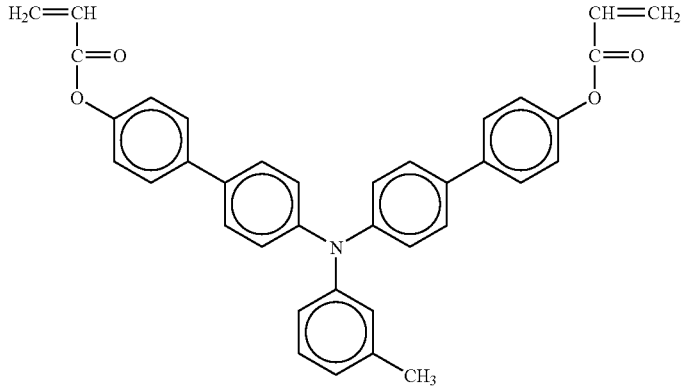

-continued
NO. 291
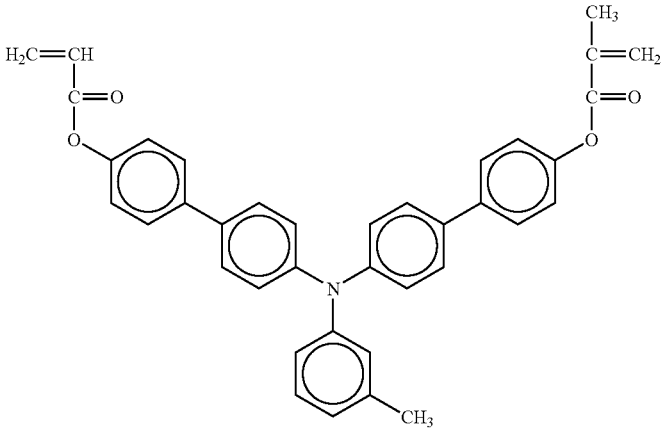
NO. 292
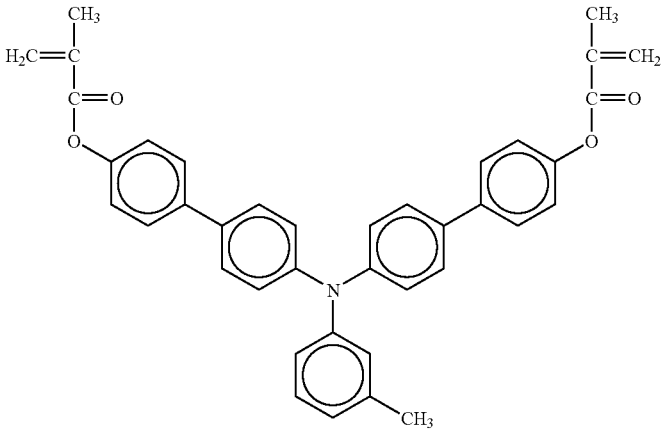
NO. 293
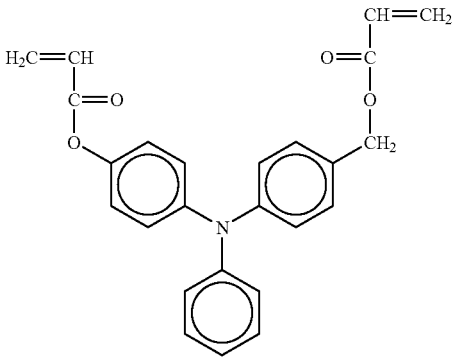
NO. 294
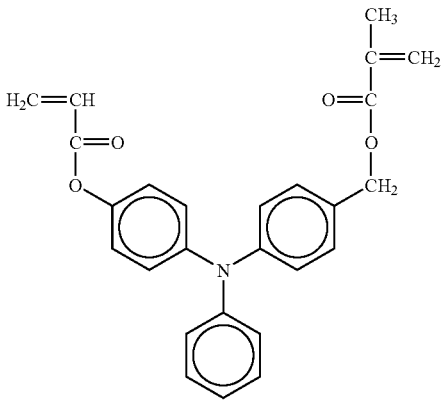
NO. 295
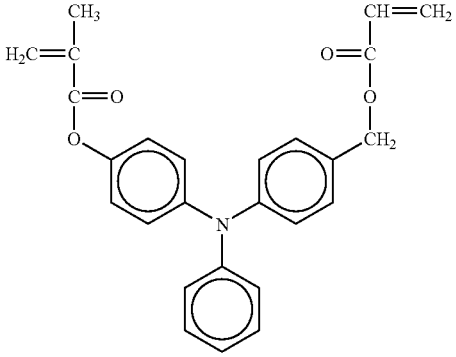
NO. 296
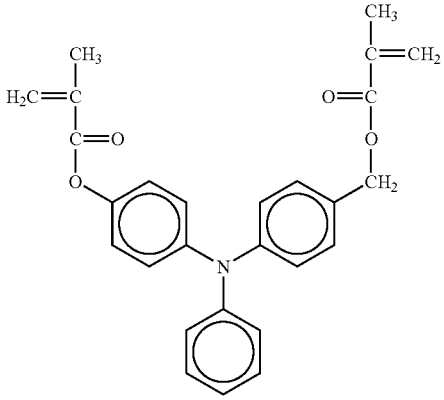

-continued
NO. 297
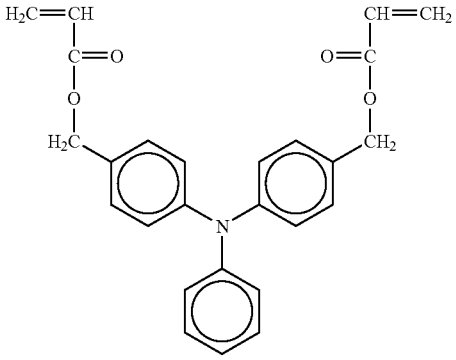
NO. 298
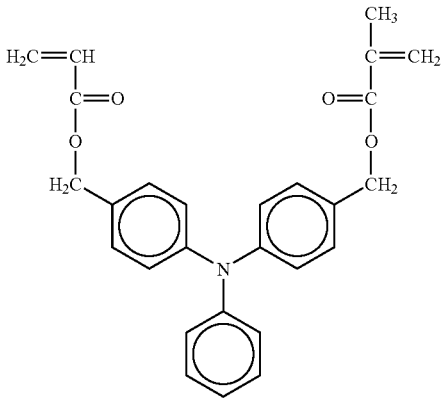
NO. 299
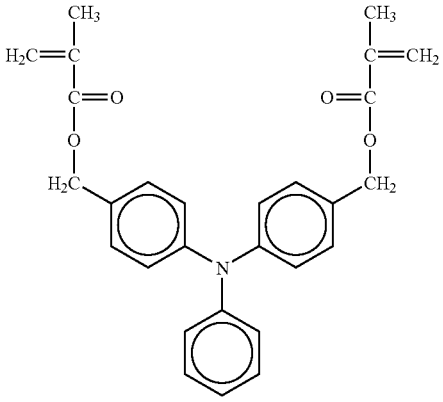
NO. 300
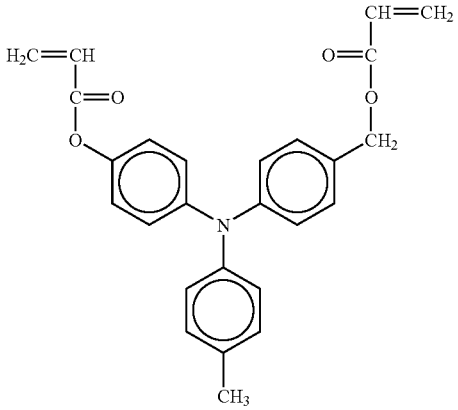
NO. 301
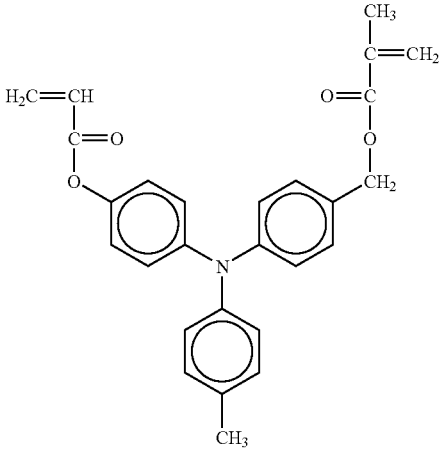
NO. 302
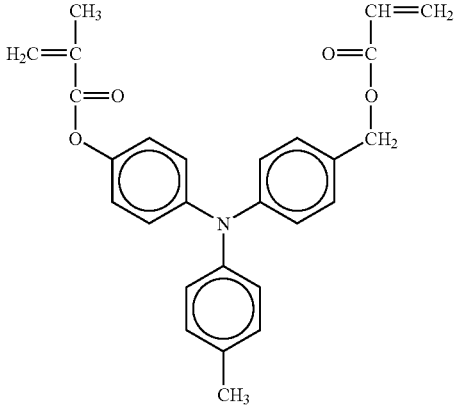

-continued
NO. 303
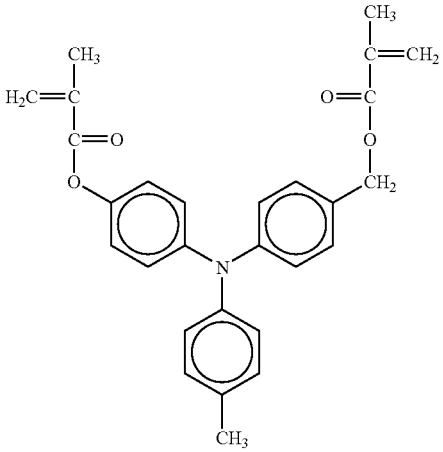
NO. 304
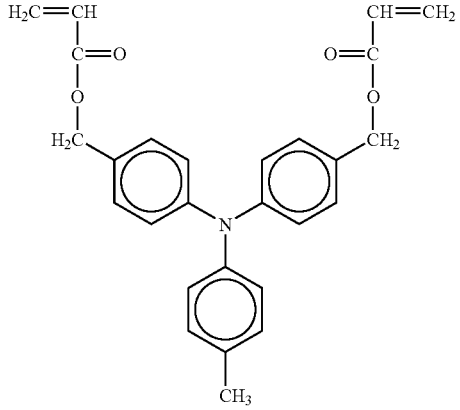
NO. 305
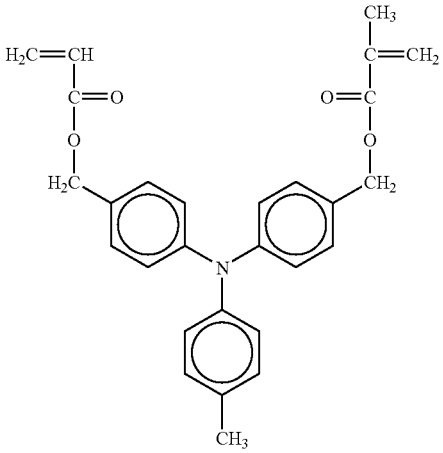
NO. 306
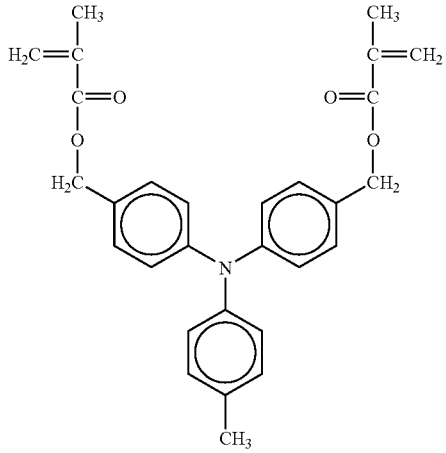
NO. 307
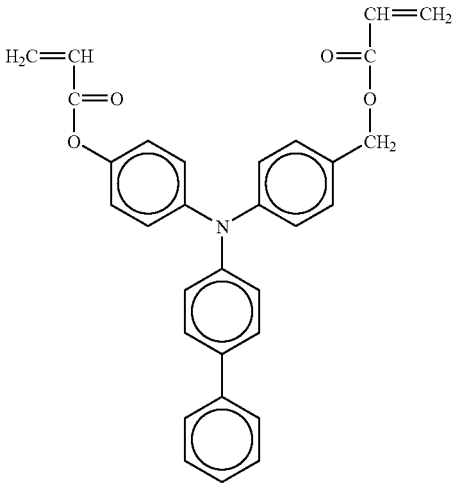
NO. 308
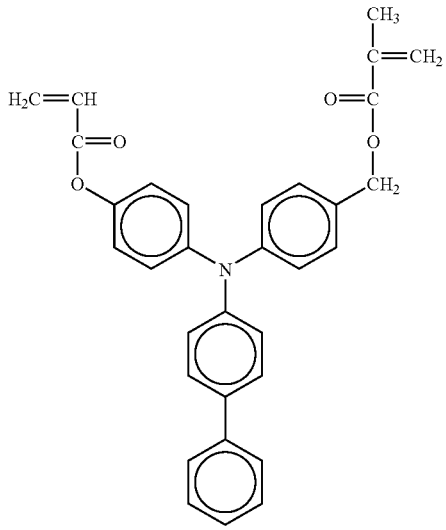

-continued
NO. 309
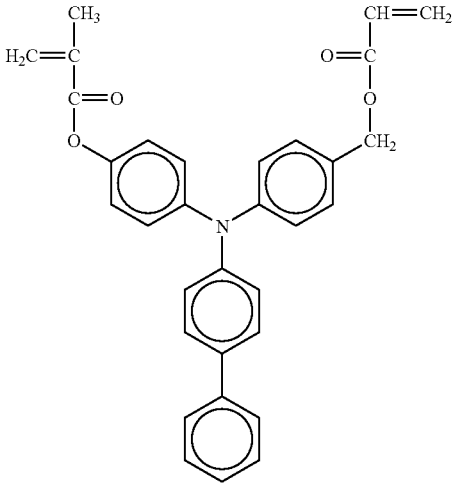
NO. 310
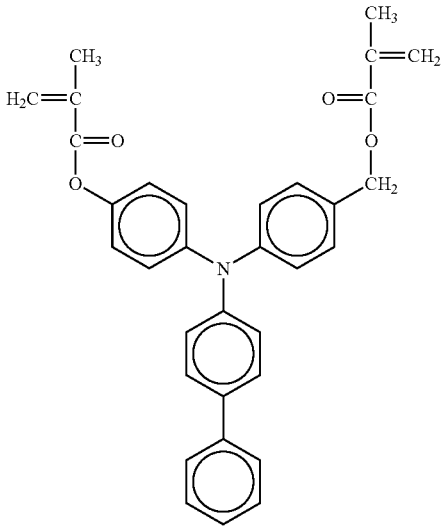
NO. 311
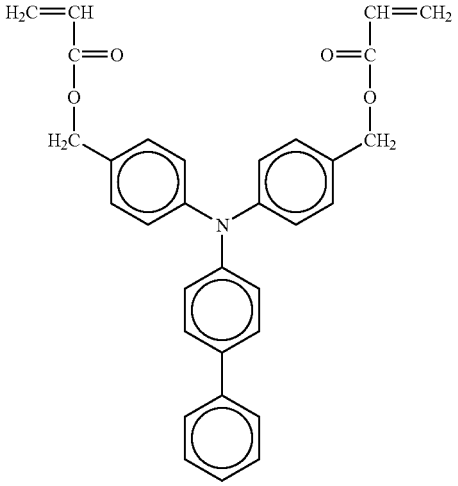
NO. 312
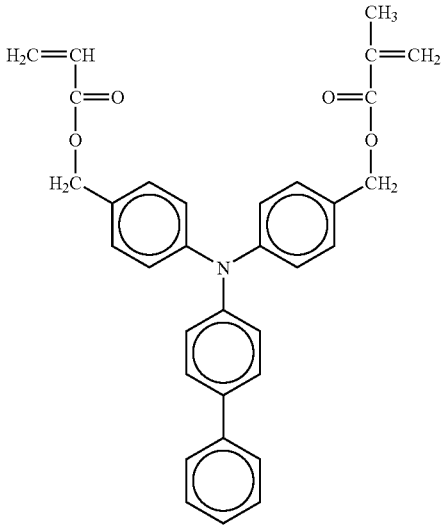
NO. 313
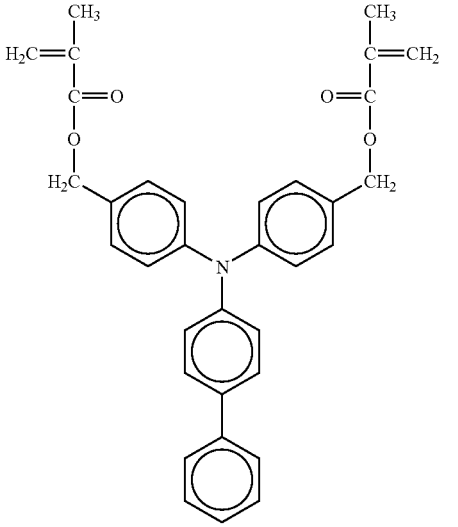
NO. 314
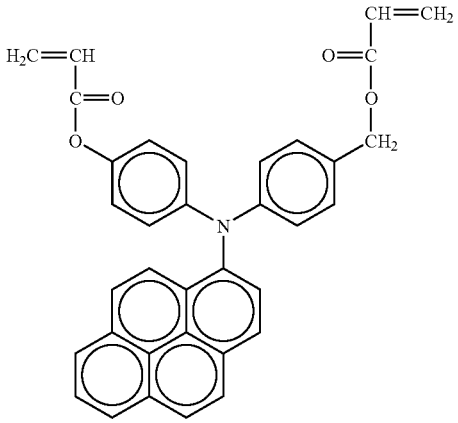

-continued
NO. 315
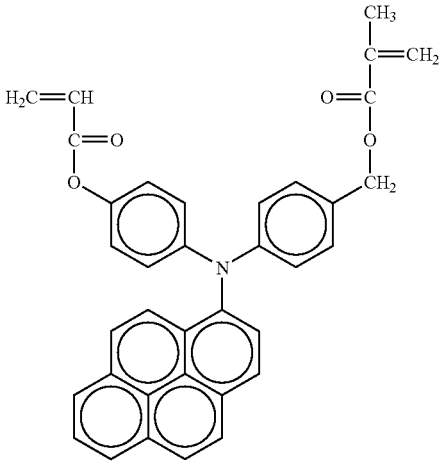
NO. 316
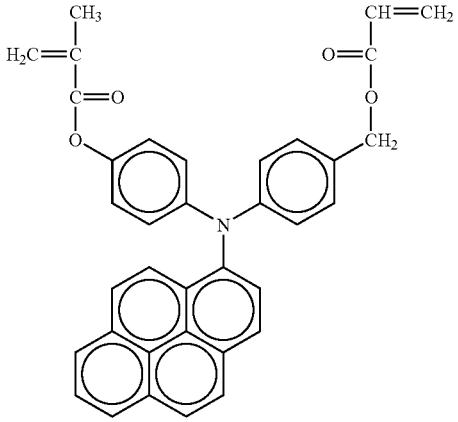
NO. 317
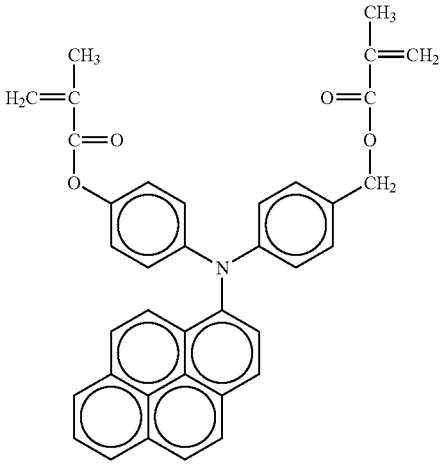
NO. 318
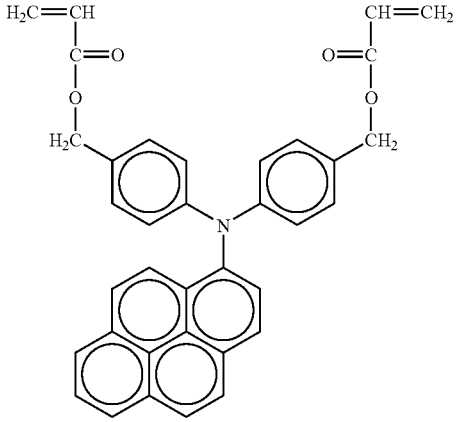
NO. 319
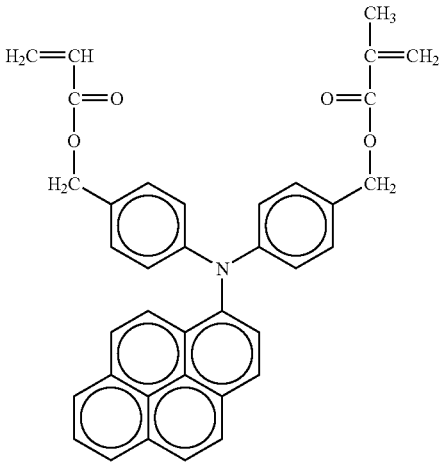
NO. 320
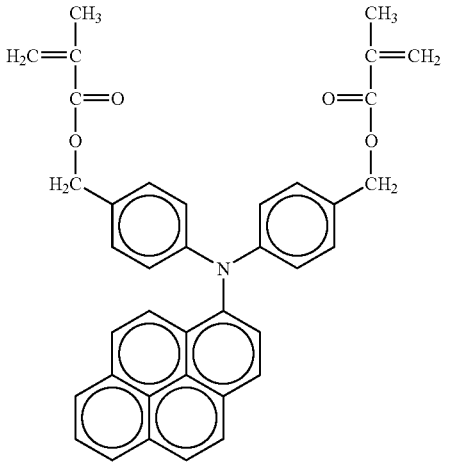

-continued
NO. 321
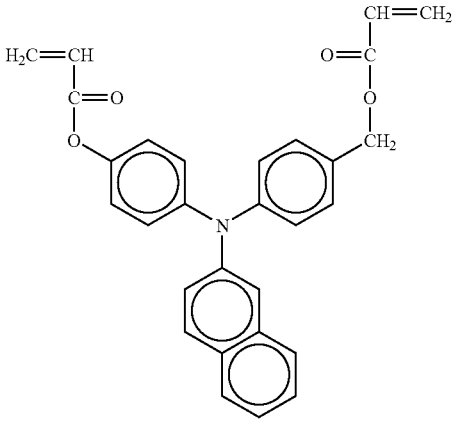
NO. 322
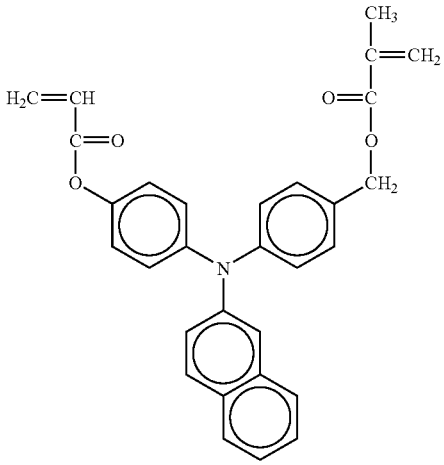
NO. 323
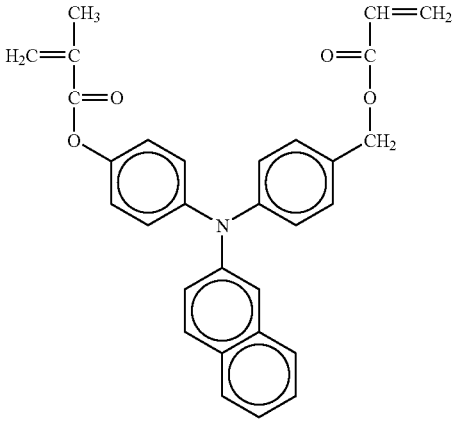
NO. 324
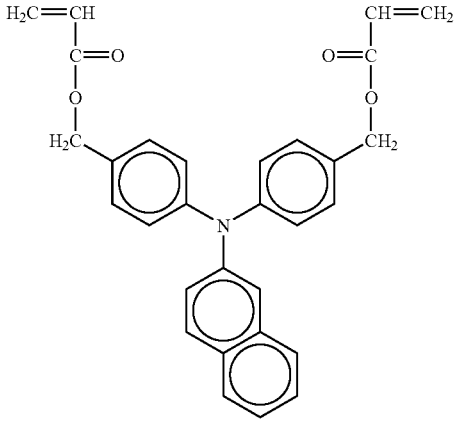
NO. 325
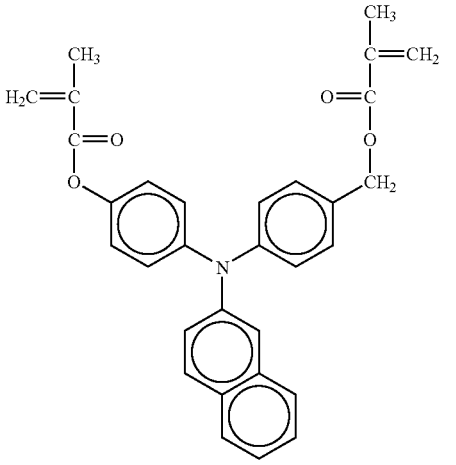
NO. 326
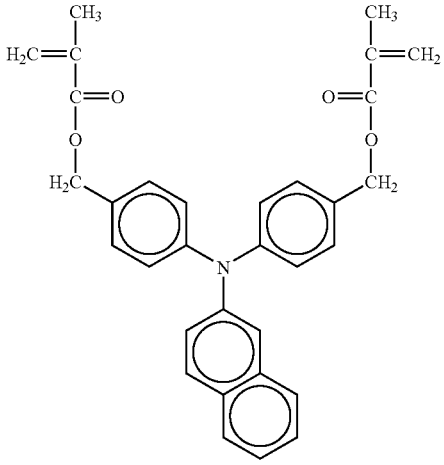

-continued
NO. 327
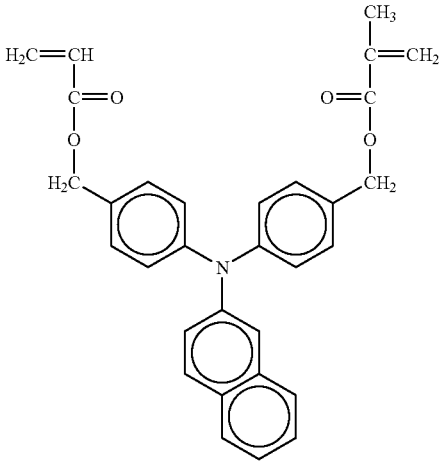
NO. 328
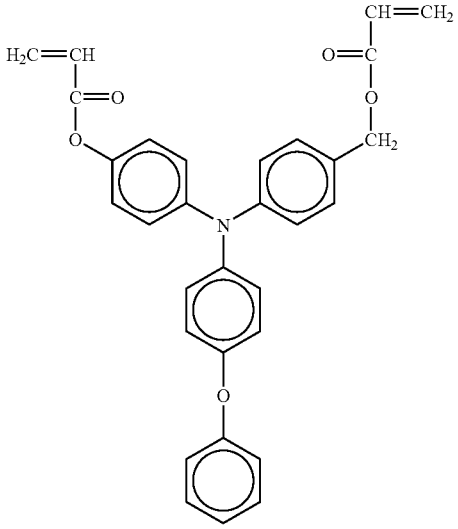
NO. 329
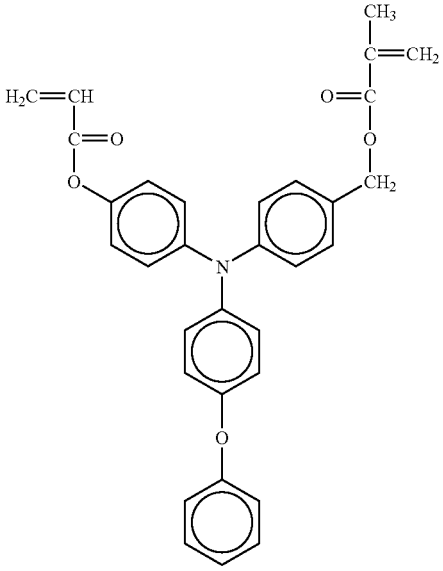
NO. 330
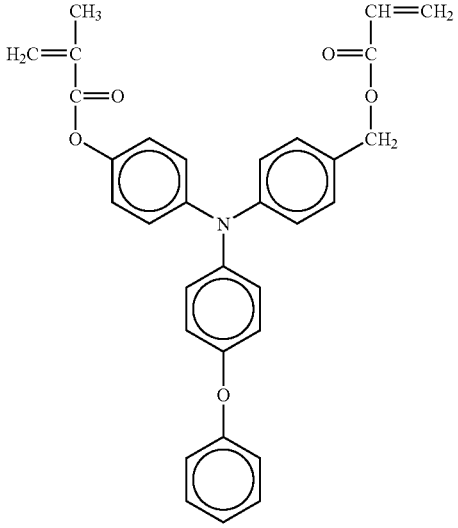
NO. 331
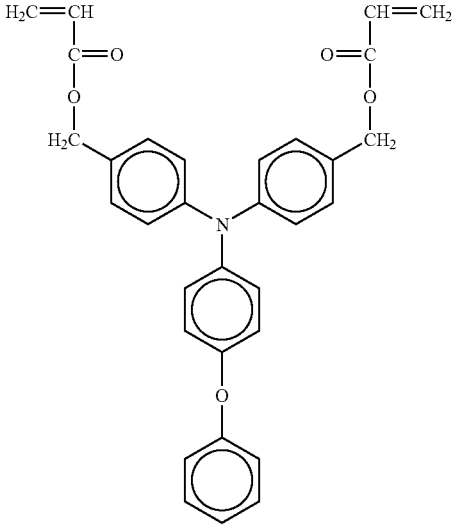
NO. 332
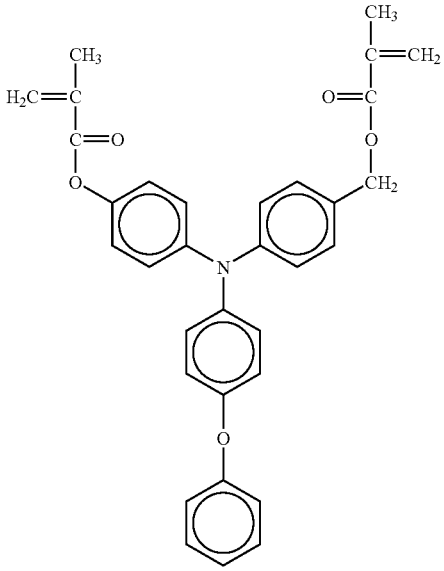

-continued
NO. 333
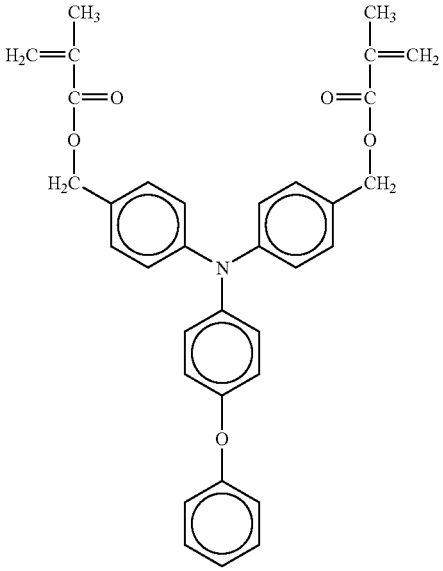
NO. 334
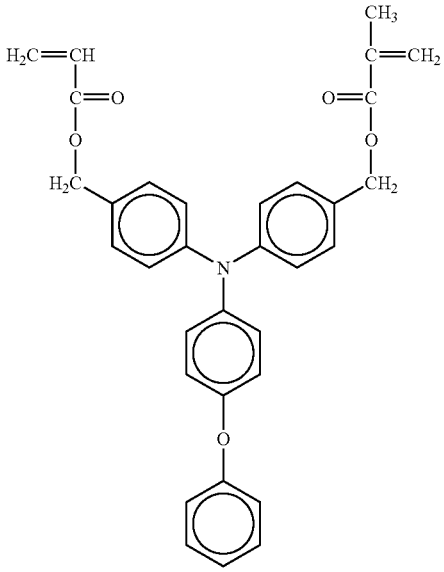
NO. 335
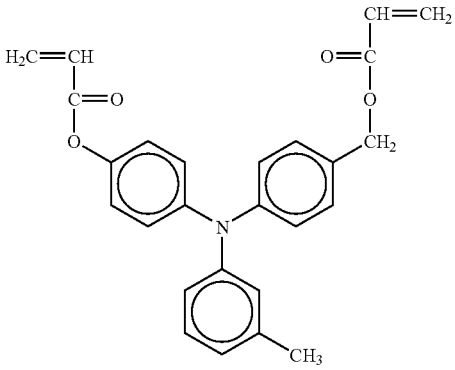
NO. 336
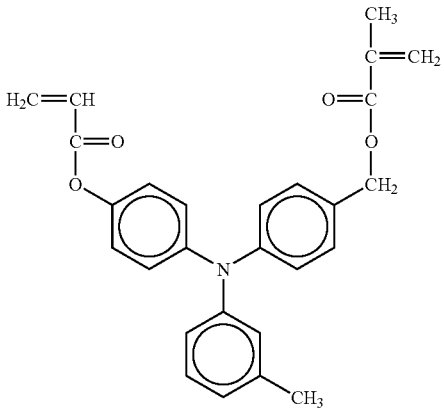
NO. 337
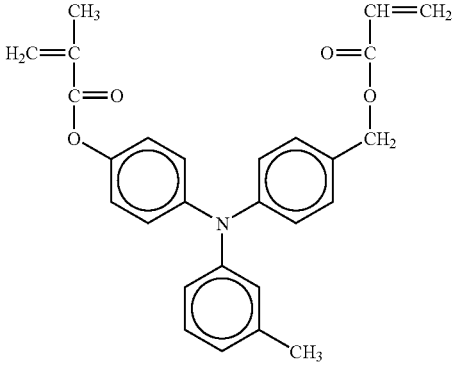
NO. 338
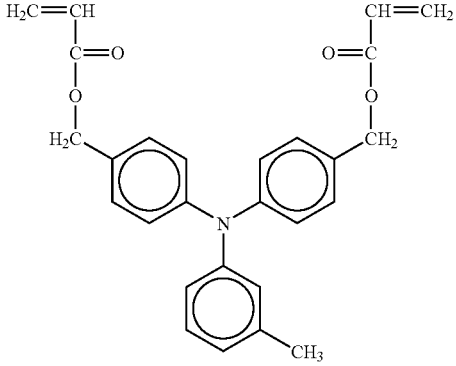

-continued
NO. 339
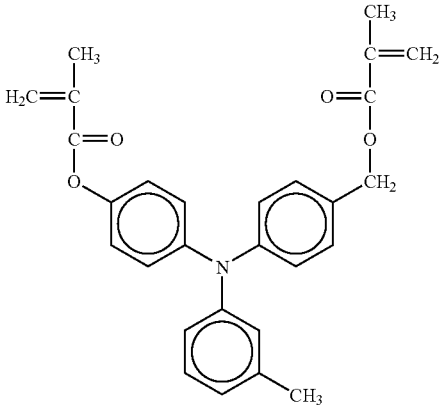
NO. 340
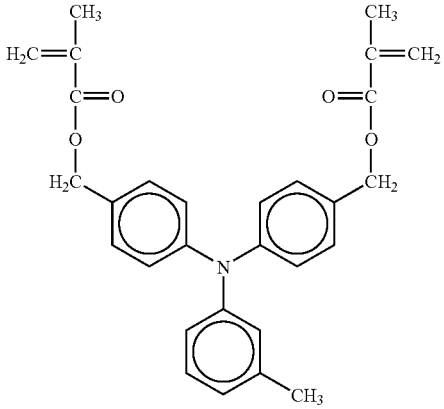
NO. 341
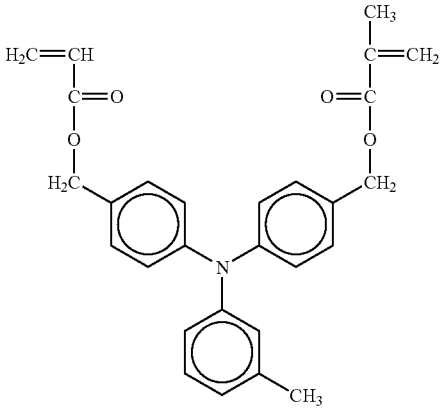
NO. 342
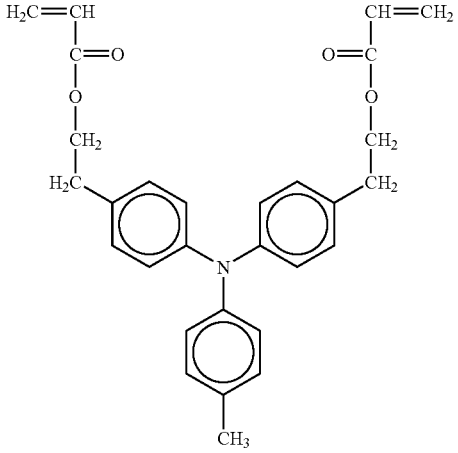
NO. 343
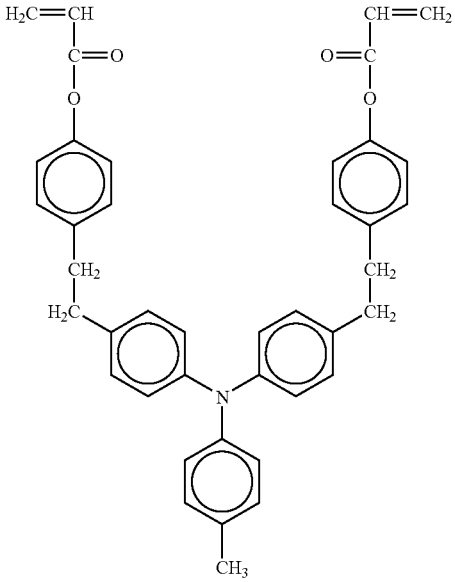
NO. 344
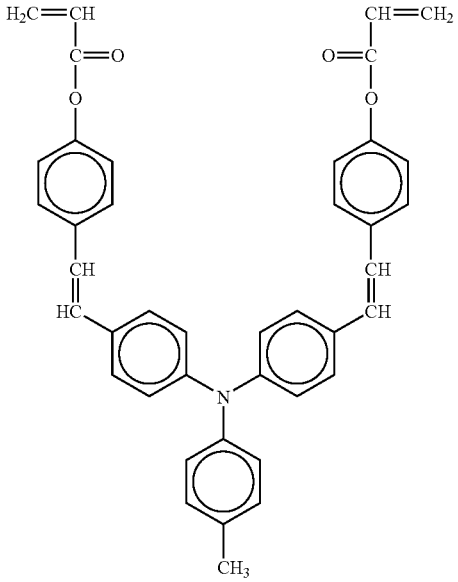

-continued
NO. 345
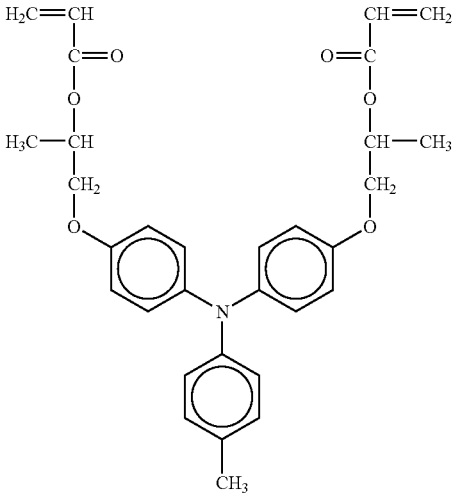
NO. 346
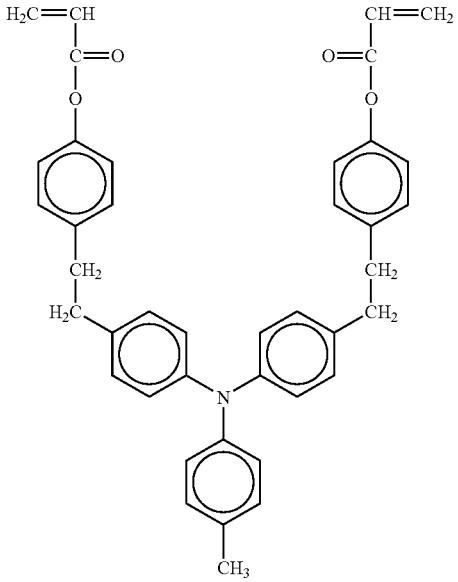
NO. 347
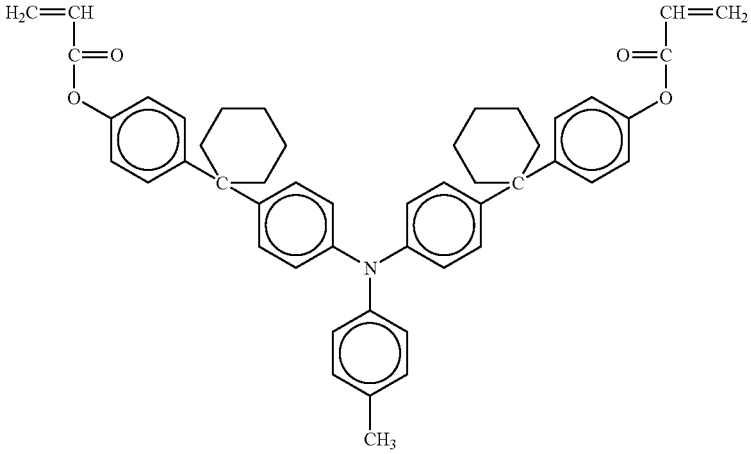
NO. 348
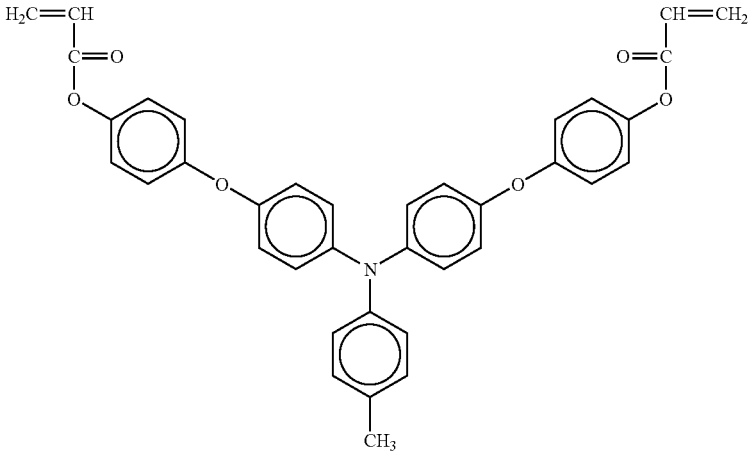

-continued
NO. 349
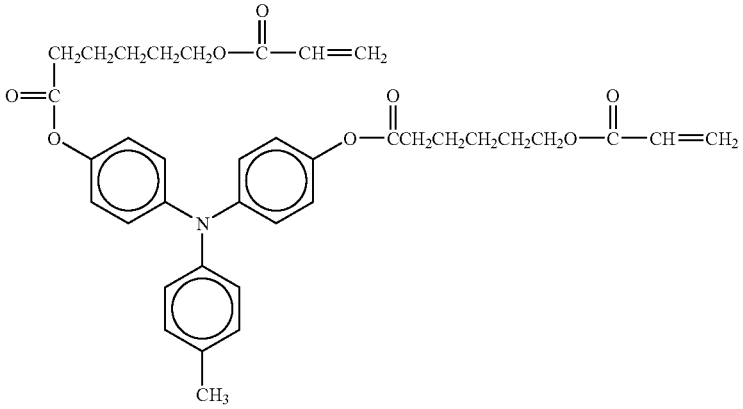
NO. 350
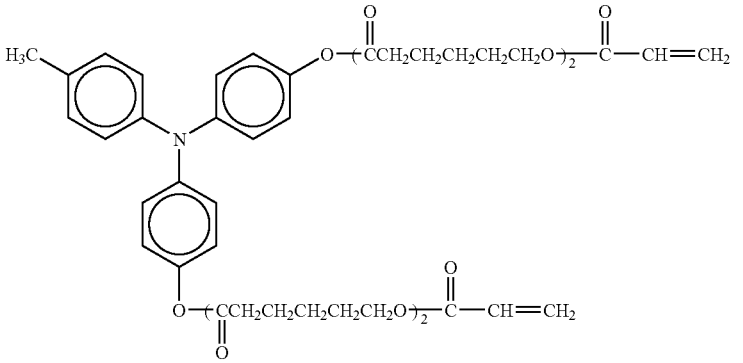
NO. 351
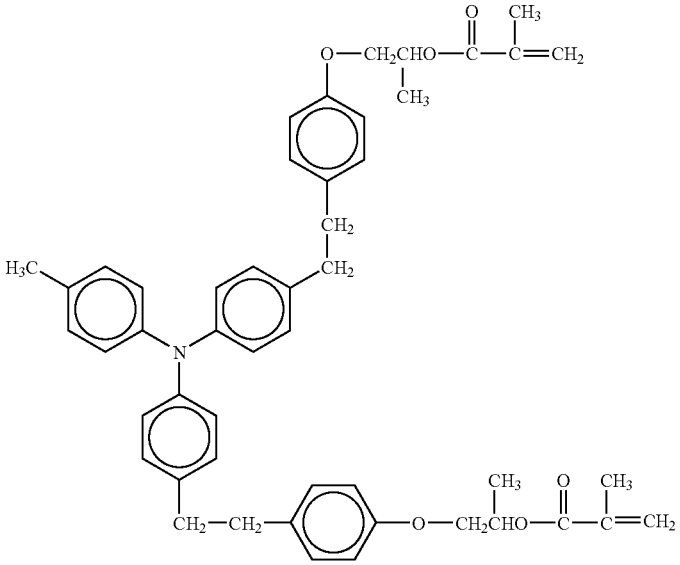

-continued
NO. 352
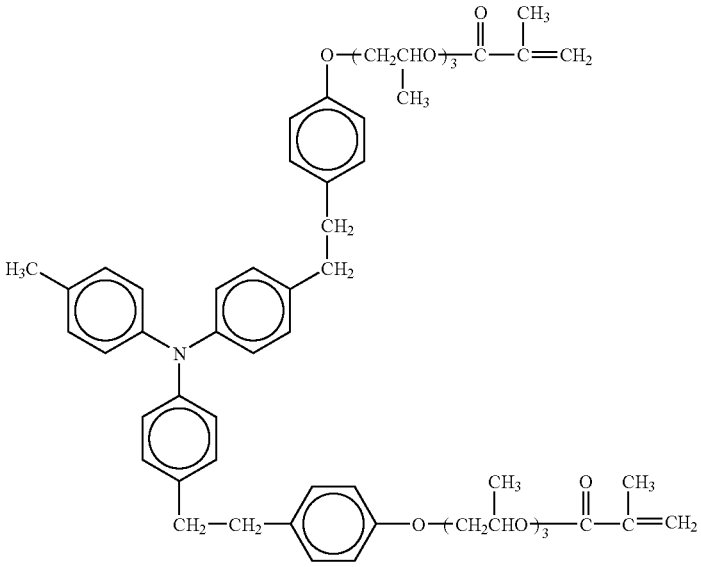
NO. 353
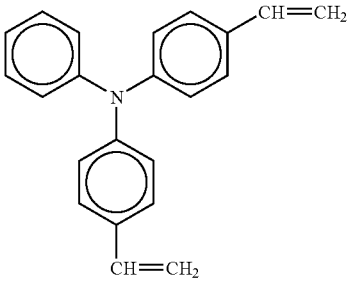
NO. 354
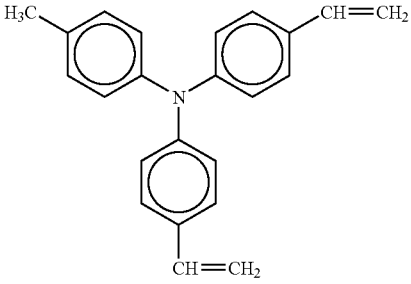
NO. 355
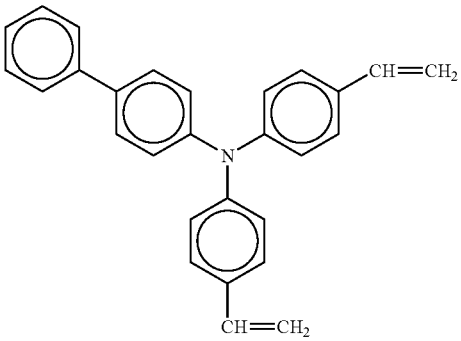
NO. 356
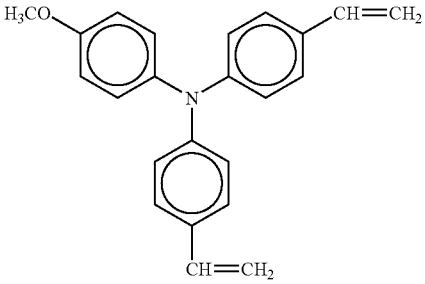

-continued
NO. 357
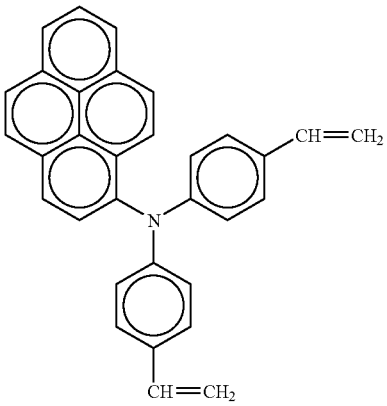
NO. 359
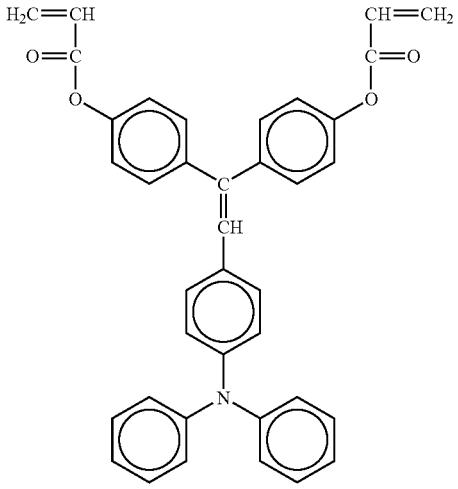
NO. 360
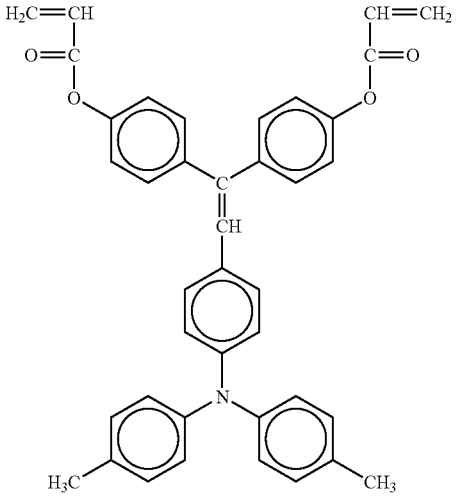
NO. 361
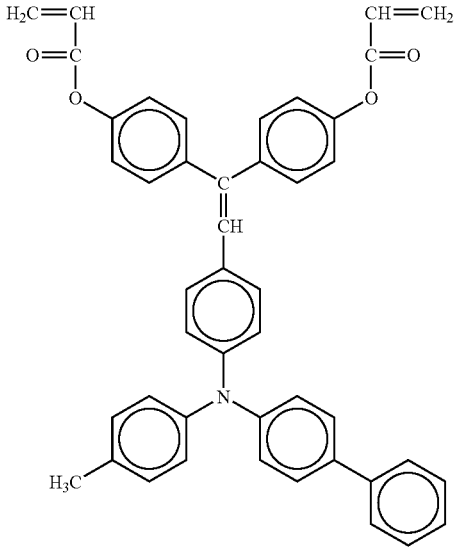
NO. 362
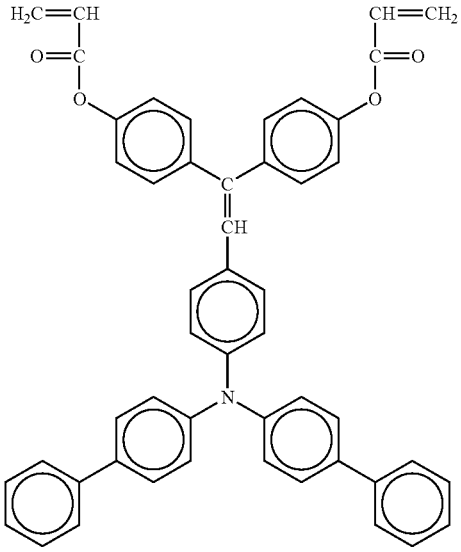
NO. 363
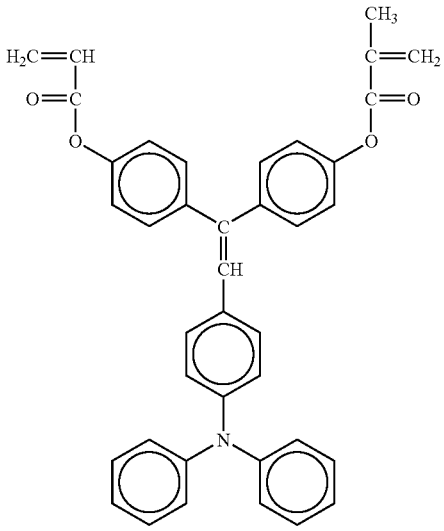

Specific examples of the radical polymerizable monomer (compound) having three functional groups with a charge transport structure include, but are not limited to, the following.
NO. 364
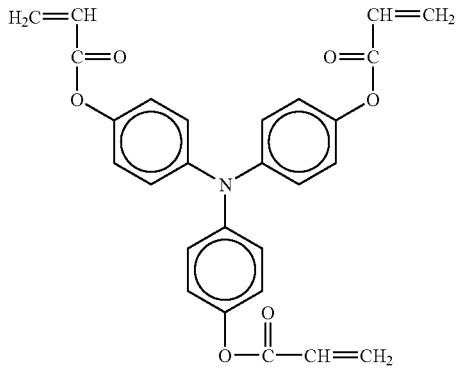
NO. 365
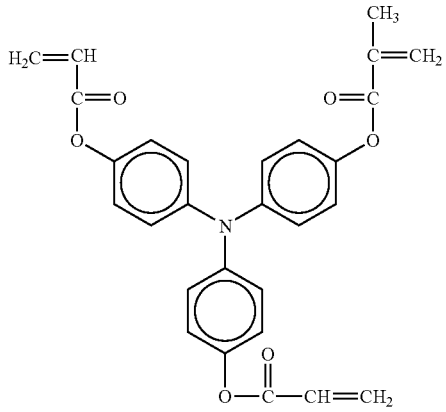
NO. 366
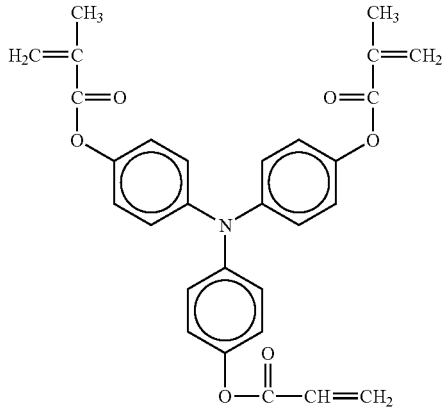
-continued
NO. 367
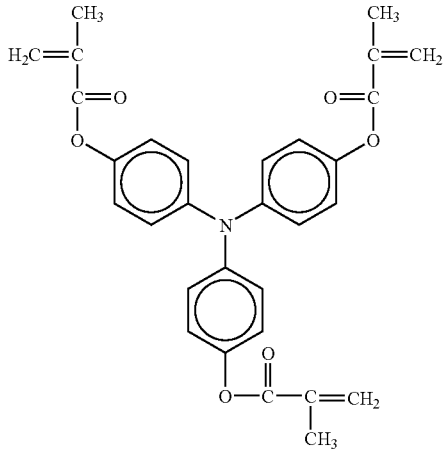
NO. 368
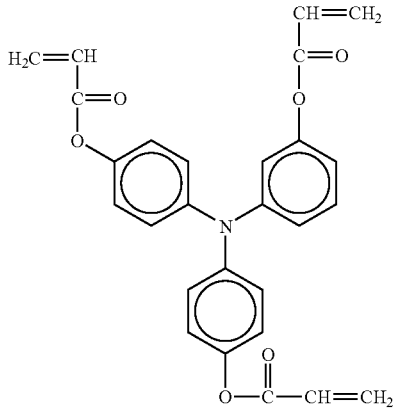
NO. 369
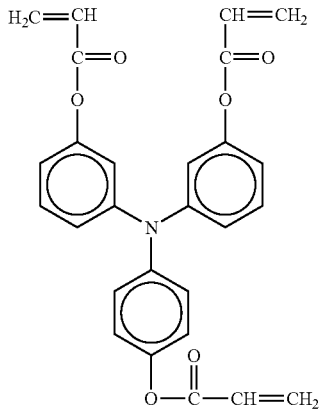
NO. 370
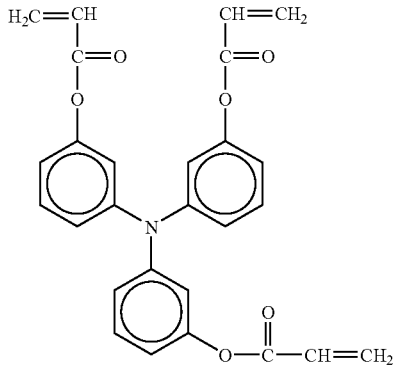

-continued
NO. 371
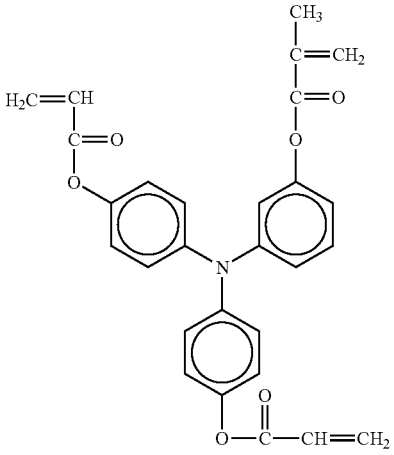
NO. 372
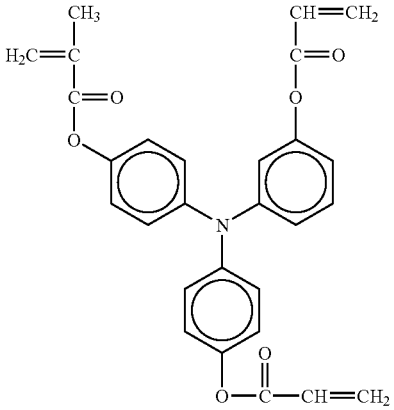
NO. 373
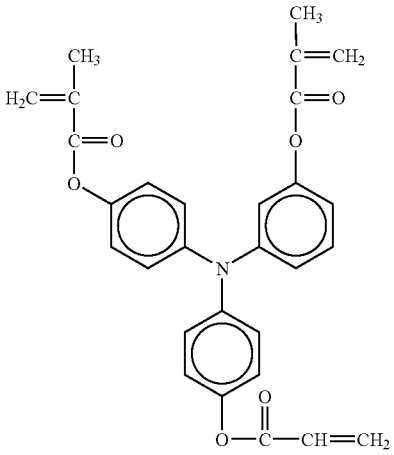
-continued
NO. 374
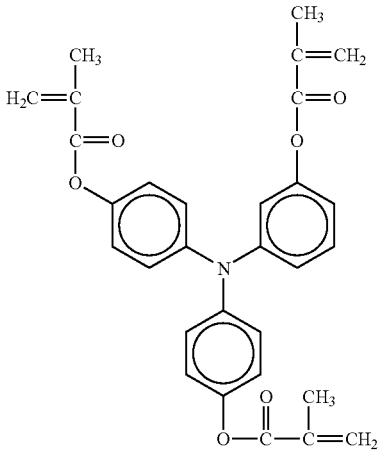
NO. 375
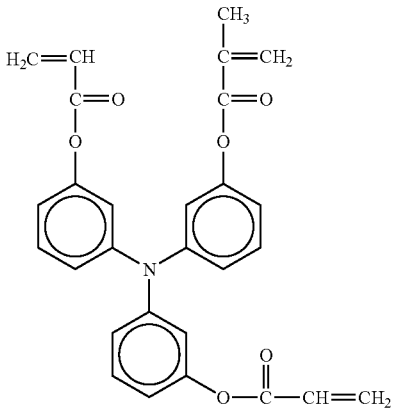
NO. 376
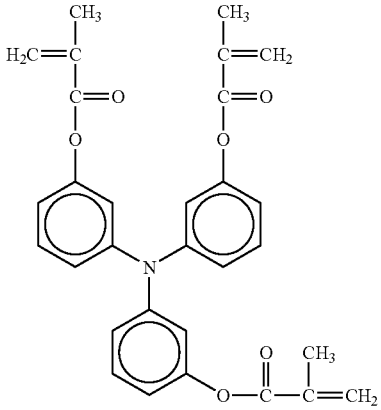

-continued
NO. 377
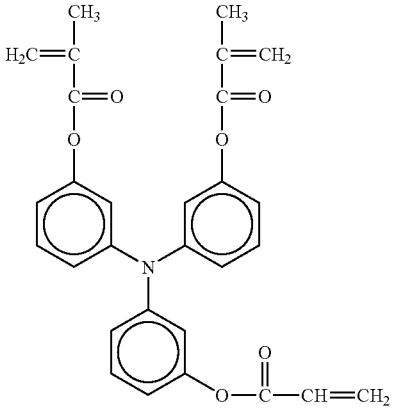
NO. 377
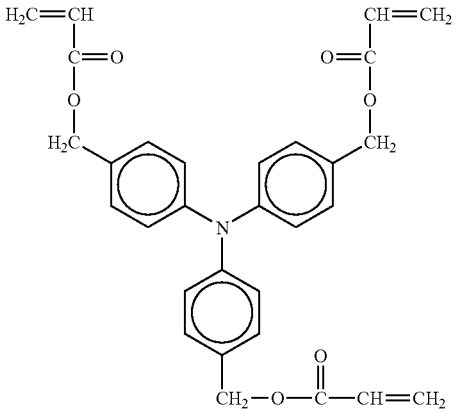
NO. 378
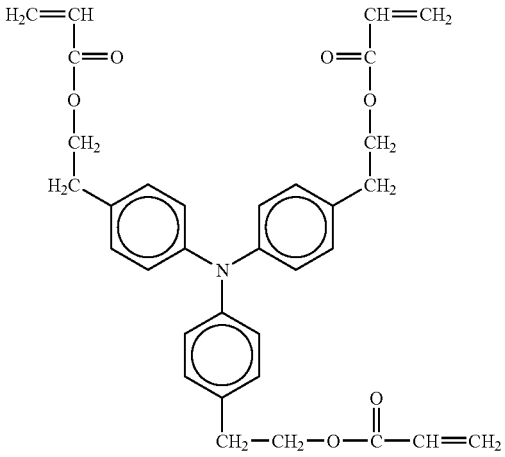
-continued
NO. 379
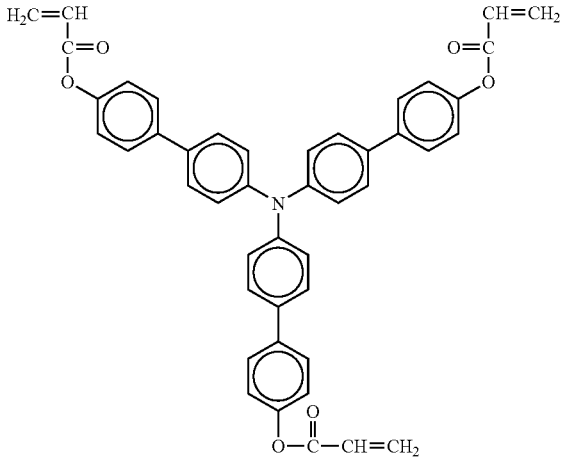
NO. 380
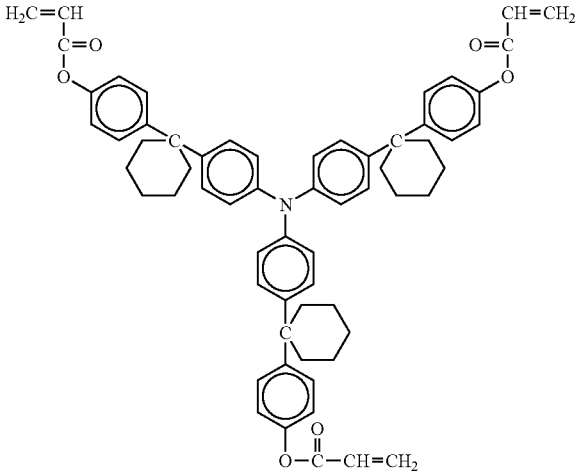
NO. 381
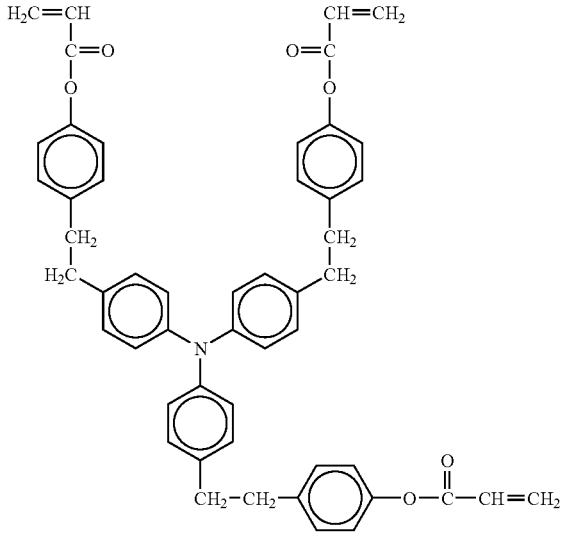

-continued

NO. 382

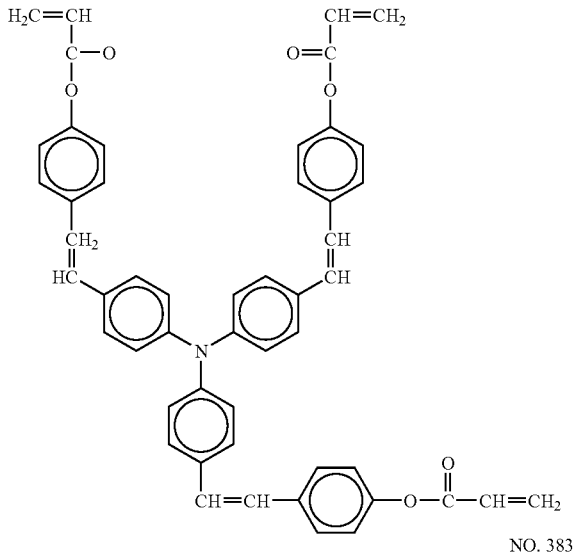

NO. 383

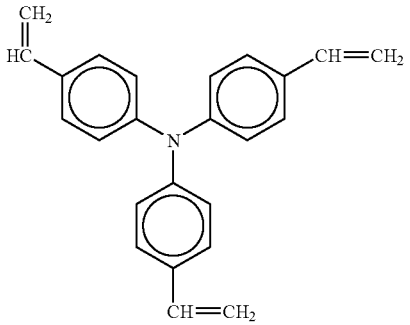

NO. 384

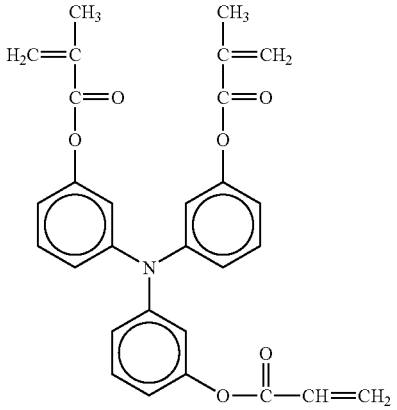

In addition, the radical polymerizable monomer having a charge transport structure imparts a charge transport power to the cross-linked surface layer, and the content ratio of the radical polymerizable monomer having a charge transport structure is from 20 to 80% by weight, and preferably from 30 to 70% by weight based on the total weight of the cross linked surface layer.

A content of the radical polymerizable monomer having a charge transport structure that is excessively small tends not to sustain the charge transport power of the cross linked surface layer, which leads to deterioration of electric characteristics such as sensitivity, and a rise of residual voltage over repetitive use.

A content of the radical polymerizable monomer having a charge transport structure that is excessively large means reduction of the content of a monomer having three functional groups without having a charge transport structure. This easily leads to reduction of the cross linking density, which prevents demonstration of a high anti-abrasion property.

Desired electric characteristics and anti-abrasion property vary depending on the process used. Therefore, it is difficult to jump to any conclusion but considering the balance, the range of from 30 to 70% by weight is most preferred.

The surface layer of the present invention is preferably formed by curing at least a radical polymerizable monomer having at least three functional groups without having a charge transport structure and a radical polymerizable monomer having a charge transport structure. In addition, a radical polymerizable monomer and an oligomer having one or two functional groups can be used in combination therewith to control the viscosity during coating, relax the internal stress within the cross-linked surface layer, reduce the surface energy, decrease the friction index, etc.

Any known radical polymerizable monomers and oligomers can be used.

Specific examples of such radical polymerizable monomers having a functional group include, but are not limited to, 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the radical polymerizable divalent functional groups include, but are not limited to, 1,3-butane diol acrylate, 1,4-butane diol acrylate, 1,4-butane diol dimethacrylate, 1,6-hexane diol diacrylate, 1,6-hexane diol dimethaacrylate, diethylene glycol diacrylate, neopentyl glycol diacrylate, bisphenol A-EO modified diacrylate, bisphenol F-EO modified diacrylate, and neopentyl glycol diacrylate.

Specific examples of such functional monomers include, but are not limited to, a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a siloxane repeating unit described in unexamined published Japanese patent applications Nos. (hereinafter referred to as JPP) H05-60503 and H06-45770; and a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl.

Specific examples of the radical polymerizable oligomers include, but are not limited to, an epoxy acrylate based oligomer, a urethane acrylate based oligomer, and a polyester acrylate based oligomer. However, an amount of the radical polymerizable monomer having one or two functional groups and the radical polymerizable oligomer that is excessively large tends to substantially decreases the density of three-dimensional cross-linking in the cross-linked surface layer, which leads to deterioration of the anti-abrasion property thereof. Therefore, the content of these monomer and oligomer is not greater than 50 parts, and preferably not greater than 30 parts based on 100 parts of the radical polymerizable monomer having at least three functional groups.

In addition, the surface layer of the present invention is preferably formed by curing at least a radical polymerizable monomer having three functional groups without having a charge transport structure and a radical polymerizable monomer having a charge transport structure. A polymerization initiator is optionally used in the cross-linked surface layer to efficiently conduct the curing reaction.

Specific examples of the thermal polymerization initiators include, but are not limited to, a peroxide based initiator such as 2,5-dimethyl hexane-2,5-dihydroperoxide, dicumyl peroxide, benzoyl peroxide, t-butylcumyl peroxide, 2,5-dimethyl-2,5-di(peroxybenzoyl)hexine-3, di-t-butyl beroxide, t-butylhydro beroxide, cumenehydro beroxide, and lauroyl peroxide, and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phneyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound. In addition, a compound having an acceleration effect on photopolymerization can be used alone or in combination with the photopolymerization initiator.

Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination.

The content of such a polymerization initiator is from 0.5 to 40 parts by weight and preferably from 1 to 20 parts by weight based on 100 parts by weight of the compound having a radical polymerization property.

Furthermore, the liquid application for use in formation of the surface layer for use in the present invention optionally includes additives such as various kinds of plasticizers (for relaxing internal stress or improving adhesiveness), a leveling agent, a charge transport material having a low molecular weight having no radical reaction property. Known additives can be used as these additives. A typical resin such as dibutylphthalate and dioctyl phthalate can be used as the plasticizer. The content thereof is not greater than 20% by weight and preferably not greater than 10% based on the total solid portion of the liquid application. Silicone oils such as dimethyl silicone oil, methyl phenyl silicone oil and a polymer or an oligomer having a perfluoroalkyl group in its side chain can be used as the leveling agent. The content thereof is suitably not greater than 3% by weight based on the total solid portion of the liquid application. The cross-linked surface layer for use in the present invention is formed by coating and curing a liquid application containing at least a radical polymerizable monomer having three functional groups without having a charge transport structure, a radical polymerizable monomer having a charge transport structure, and filler particulates.

When a liquid radical polymerizable monomer is used, other components are possibly dissolved in the liquid before application of the liquid. Optionally, the liquid application is diluted by a suitable solvent before coating.

Specific examples of such solvents include, but are not limited to, an alcohol such as methanol, ethanol, propanol and butanol; a ketone such as acetone, methyl ethyl ketone, methyl isobutyl ketone, and cycle hexanone; an ester such as ethyl acetate and butyl acetate; an ether such as tetrahydrofuranm dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosove and cellosolve acetate.

These solvents can be used alone or in combination. The dilution ratio by using such a solvent is arbitrary and varies depending on the solubility of a composition, a coating method, and a target layer thickness. A dip coating method, a spray coating method, a bead coating method, a ring coating method, etc., can be used for coating the liquid application. In the present invention, subsequent to application of the liquid application, the cross-linked surface layer is formed by curing upon application of external energy such as heat, light and radiation ray. Heat can be applied to the cross-linked surface layer from the application surface side or the substrate side using a gas such as air and nitrogen, vapor, or various kinds of heat media, infra-red radiation and electromagnetic wave.

The heating temperature is not lower than 100° C. and preferably not higher than 170° C. When the heating temperature is too low, the reaction speed tends to be slow so that the curing reaction may not be complete. A heating temperature that is too high tends to cause non-uniform curing reaction, thereby significantly distorting the inside of the cross-linked surface layer. A method of heating the cross linked surface layer at a relatively low temperature, for example lower than 100° C., followed by heating at a relatively high temperature, for example, higher than 100° C., is suitable to uniformly conduct curing reaction.

As light energy, a UV irradiation light source such as a high pressure mercury lamp or a metal halide lamp having a main emission wavelength in the ultraviolet area is used. A visible light source can be used according to the absorption wavelength of a compound containing a radical polymerizable monomer and a photopolymerization initiator. The irradiation light amount is preferably from 50 mW/cm$^2$ to 1,000 mW/cm$^2$. When the irradiation light amount is too small, it takes a long time to complete the curing reaction. An irradiation light amount that is too large tends to prevent a uniform curing reaction, which roughens the cross-linked surface layer. Beams of electron can be used as the radiation ray energy. Among these forms of energies, thermal or light energy is suitably used in terms of easiness of reaction speed control and simplicity of a device.

The layer thickness of the cross linked surface layer for use in the present invention varies depending on the layer structure of the photoreceptor using the cross linked surface layer and thus is described below according to the layer structure. Optionally, a binder resin can be contained in the composition contained in the liquid application of the cross linked surface layer as long as the binder resin does not degrade electric characteristics and/or durability of the photoreceptor. Containing a bulky charge transport structure in the cross linked surface layer to maintain the electric characteristics, and increasing the density of the cross linking bonding to improve the durability are suitable for the cross linked surface layer of the present invention. When an extremely high energy is applied from outside to violently conduct the curing reaction of the cross linked surface layer after its coating, the charge transport material is broken, which leads to deterioration of the electric characteristics. Therefore, using eternal energy such as thermal energy or optical energy is preferable because such energy can control the reaction speed according to the heating condition, the irradiation intensity condition, and the amount of the polymerization initiator.

An illustrative method of application of formation material of the cross linked surface layer for use in the present invention is described below. For example, when an acrylate monomer having three acryloyloxy groups and a triaryl amine compound having one acryloyloxy group are used as a liquid application, the content ratio of the acrylate monomer to the triaryl amine is 3/7 to 7/3 and an polymerization initiator is added in an amount of 3 to 20% by weight based on the total amount of the acrylate compound followed by an addition of filler particulates and a solvent as described above to prepare the liquid application. For example, when a triaryl amine based doner as the charge transport material and polycarbonate as the binder resin are used in a charge transport layer provided under the cross-linked surface layer and the cross linked surface layer is formed by a spray application method, tetrahydrofuran, 2-butanone or ethyl acetate are preferably used as the solvent mentioned above for the liquid application. Its content is 3 to 10 times as much as the total weight of the acrylate compound. The cured cross linked surface layer is preferably insoluble in an organic solvent. A layer that has not sufficiently been cured is soluble in an organic solvent and the cross linking density thereof is low. Therefore, the mechanical strength is also low.

Next, for example, the liquid application prepared as described above is applied with, for example, a spray, on a photoreceptor formed by sequentially accumulating an undercoating layer, a charge generation layer, and a charge transport layer in this order on a substrate such as an aluminum cylinder. Subsequent to drying the liquid application at a relatively low temperature (25 to 80° C.) for a short time (1 to 10 minutes), the liquid application is cured upon application of UV ray irradiation or heat.

In the case of UV ray irradiation, a metal halide lamp, etc., is used with a preferable illumination intensity of from 50 to 1,000 mW/cm$^2$. For example, the entire surface of the photoreceptor can be uniformly irradiated with UV light having an illumination intensity of 700 mW/cm$^2$ for curing for about 20 seconds by rotating the drum. The drum temperature is controlled not to be higher than 50° C. In the case of the heat curing, the heating temperature is preferably from 100 to 170° C. An air supply oven is used as a heating device. The liquid application is heated for 20 minutes to 3 hours when the heating temperature is set at 150° C. Subsequent to completion of the curing reaction, the surface layer is heated at 100° C. to 150° C. for 10 to 30 minutes to reduce the amount of remaining solvent to obtain the photoreceptor of the present invention.

Figure 5:
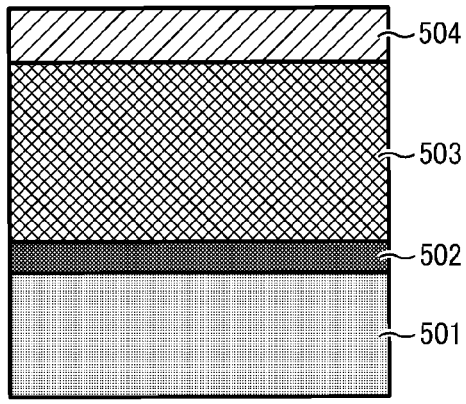
FIG. 5 is a cross section illustrating the layer structure of the photoreceptor of the present invention.

The present invention is described in detail below with reference to the layer structure. Layer Structure of Photoreceptor The photoreceptor of the present invention is described with reference to the accompanying drawings. FIG. 5 is a diagram illustrating a cross section of an example of the photoreceptor of the present invention. FIG. 5 illustrates the layer structure of the photoreceptor including an electroconductive substrate 501, a photosensitive layer provided on the electroconductive substrate 501 which has a laminate structure formed of a charge generation layer 502 having a charge generation function and a charge transport layer 503 having a charge transport function, and a cross linked surface layer 504 provided on the charge transport layer 503.

Electroconductive Substrate

The electroconductive substrate 501 can be formed by using material having a volume resistance of not greater than $10^{10}\Omega\cdot$cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable. In addition, an endless nickel belt and an endless stainless belt described in JPP S52-36016 can be used as the electroconductive substrate. An electroconductive substrate formed by applying to the substrate mentioned above a liquid application in which electroconductive powder is dispersed in a suitable binder resin can be used as the electroconductive substrate for use in the present invention.

Specific examples of such electroconductive powders include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resins which are used together with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be used as the electroconductive substrate in the present invention. The heat contraction tube is formed of material such as polyvinyl chloride, polypropylene, polyester, polystyrene, polyvinylidene chloride, polyethylene, chloride rubber, and TEFLON®, which includes the electroconductive powder mentioned above.

Photosensitive Layer

Next, the photosensitive layer is described.

The photosensitive layer takes a single layer structure or a laminate structure.

The photosensitive layer is formed of a charge generation layer having a charge generation function and a charge transport layer having a charge transport function.

(1) Charge Generation Layer

The charge generation layer 502 is a layer mainly formed of charge generation material having a charge generation function and an optional binder resin. Inorganic material and organic material can be used as the charge generating material. Specific examples of the inorganic materials include, but are not limited to, crystal selenium, amorphous-selenium, selenium-tellurium-halogen, selenium-arsenic compounds, and amorphous-silicon. With regard to the amorphous-silicon, those in which a dangling-bond is terminated with a hydrogen atom or a halogen atom, and those in which boron atoms or phosphorous atoms are doped are preferably used. As for the organic material, any known material in the art can be used. Specific examples thereof include, but are not limited to, phthalocyanine pigments, for example, metal phthalocyanine and metal-free phthalocyanine; azulenium salt pigments; squaric acid methine pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bis-stilbene skeleton; azo pigments having a distilyloxadiazole skeleton; azo pigments having a distylylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments. These charge generation materials may be used alone or in combination.

Specific examples of the binder resin optionally used in the charge generation layer include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, and polyacrylamides. These binder resins may be used alone or may be used as a mixture of two or more. In addition to the binder resins specified above for the charge generation layer, polymerizable charge transport material having a charge transport function, for example, a polycarbonate resin, a polyester resin, a polyurethane resin, a polyether resin, a polysiloxane resin or an acrylic resin having an arylamine skeleton, a benzidine skeleton, a hydrazone skeleton, a carbazole skeleton, a stilbene skeleton or a pyrazoline skeleton; and polymerizable material having a polysilane skeleton, can be also used.

Specific examples of the former charge transport polymers include, but are not limited to, compounds described in JOPs H01-001728, H01-009964, H01-013061, H01-019049, H01-241559, H04-011627, H04-175337, H04-183719, H04-225014, H04-230767, H04-320420, H05-232727, H05-310904, H06-234836, H06-234837, H06-234838, H06-234839, H06-234840, H06-234840, H06-234841, H06-239049, H06-236050, H06-236051, H06-295077, H07-056374, H08-176293, H08-208820, H08-211640, H08-253568, H08-269183, H09-062019, H09043883, H09-71642, H09-87376, H09-104746, H09-110974, H09-110974, H09-110976, H09-157378, H09-221544, H09-227669, H09-221544, H09-227669, H09-235367, H09-241369, H09-268226, H09-272735, H09-272735, H09-302084, H09-302085 and H09-328539.

Specific examples of the latter charge transport polymers include, but are not limited to, polysiylene polymers described in JOPs 563-285552, H05-19497, H05-70595 and H10-73944. The charge generation layer optionally contains charge transport material having a low molecular weight. The charge transport material having a low molecular weight which can be used in combination in the charge generation layer is classified into positive hole transport material and electron transport material. Specific examples of such electron transport material include, but are not limited to, electron acceptance material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives. These charge transport material can be used alone or in combination.

The following electron donating material can be suitably used as the positive hole transport material.

Specific examples of such positive hole transport material include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials.

These positive hole transport materials can be used alone or in combination.

The charge generation layer is typically manufactured by a vacuum thin layer formation method or a casting method using a liquid dispersion system.

Specific examples of the vacuum thin layer formation methods include, but are not limited to, a vacuum evaporation method, a glow discharge decomposition method, an ion-plating method, a sputtering method, a reactive sputtering method, or a CVD method. The inorganic material and organic material specified above can be suitably used in these methods.

In the casting method, the above-mentioned inorganic or organic charge generation material is dispersed with an optional binder resin in a solvent, for example, tetrahydrofuran, dioxane, dioxsolan, toluene, dichloromethane, monochlorobenzene, dichloroethane, cyclohexanone, cyclopentanone, anisole, xylene, methylethylketone, acetone, ethylacetate, butylacetate using, for example, a ball mill, an attritor, a sand mill, or a beadmill. Thereafter, suitably diluted liquid dispersion is applied to the surface of the elctroconductive substrate to form the charge generation layer. Leveling agents such as dimethyl silicone oil, and methylphenyl silicone oil, can be optionally added. A dip coating method, a spray coating method, a bead coating method, a ring coating method, etc., can be used in application of the liquid application. The thickness of the thus provided charge generation layer is suitably from 0.01 to 5 μm and preferably from 0.05 to 2 μm.

(2) Charge Transport Layer

The charge transport layer is a layer having a charge transport function. The charge transport layer is formed by dissolving and/or dispersing charge transport material and a binder resin in a suitable solvent and applying the liquid to the charge generation layer followed by drying.

The electron transport materials, the positive hole transport materials and the charge transport polymer mentioned above in the description about the charge generation layer can be used as the charge transport material.

Using a charge transport polymer is particularly suitable in terms of the effect on reduction of the solubility of the layer provided below the surface layer when the surface layer is coated.

Specific examples of the binder resin include, but are not limited to, thermoplastic resins or thermocuring resins, for example, polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins, ethyl cellulose resins, polyvinyl butyral, polyvinyl formal, polyvinyl toluene, poly-N-vinylcarbozole, acrylic resin, silicone resins, epoxy resins, melamine resins, urethane resins, phenol resins, and alkyd resins. The content of the charge transport material is from 20 to 300 parts by weight and preferably from 40 to 150 parts by weight based on 100 parts by weight of the binder resin. The charge transport polymer can be used alone or in combination with the binder resin. The same solvent as specified for the charge generation layer can be used as the solvent for use in application of the charge transport layer. These solvents can be used alone or in combination. In addition, the same method as in the case of the charge generation layer can be used to form the charge transport layer. In addition, a plasticizing agent and/or a leveling agent can be added, if desired. Specific examples of the plasticizing agent for use in the charge transport layer include known resins such as dibutyl phthalate and dioctyl phthalate. The addition amount of the plasticizing agent is preferably from 0 to 30 parts by weight based on 100 parts by weight of the binder resin.

Specific examples of the leveling agent for use in the charge transport layer include, but are not limited to, silicone oils, for example, dimethyl silicone oil and methyl phenyl silicone oil, and polymers or oligomers having perfluoroalkyl groups in its side chain. The addition amount of the leveling agent is preferably from 0 to 1 part by weight based on 100 parts by weight of the binder resin.

The thickness of the thus obtained charge transport layer is suitably from about 5 to about 40 μm and preferably from about 10 to about 30 μm.

Undercoating Layer

In the photoreceptor of the present invention, an undercoating layer can be provided between the electroconductive substrate and the photosensitive layer.

Typically, such an undercoating layer is mainly made of a resin. Considering that a photosensitive layer is applied to such an undercoating layer (i.e., resin) in a form of solvent, the resin is preferably hardly soluble in a known organic solvent.

Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenol resins, alkyd-melamine resins and epoxy resins. In addition, fine powder pigments of metal oxide, such as titanium oxides, silica, alumina, zirconium oxides, tin oxides and indium oxides can be added to the undercoating layer to prevent moiré and reduce the residual voltage.

The undercoating layer described above can be formed by using a suitable solvent and a suitable coating method as described for the photosensitive layer. Silane coupling agents, titanium coupling agents and chromium coupling agents can be used in the undercoating layer.

Furthermore, the undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method.

Any other known methods can be also available. The layer thickness of such an undercoating layer is suitably from 0 to 5 μm. Addition of Anti-Oxidizing Agent to Each Layer Furthermore, in the present invention, an anti-oxidizing agent can be added to each layer, i.e., the surface layer, the charge generation layer, the charge transport layer, the undercoating layer, other layers such as an intermediate layer to improve the environmental resistance, in particular, to prevent the degradation of sensitivity and the rise in residual potential.

Specific examples of the anti-oxidizing agent include, but are not limited to, the following:

Phenol Compounds 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

Paraphenylene Diamines N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organic Sulfur Compounds

Dilauryl-3,3'-thiodipropionate, distearyl-3,3'-thiodipropyonate, dimyristyl-3,3'-thiodipropionate, ditetradecyl-3,3'-thiodipropyonate and pentaerythritol tetrakis(3-laurylthio propionate).

Organic Phosphorous Compounds triphenylphosphate, tri(nonylphenyl)phosphate, tri(dinonylphenyl)phosphate, tris(2-ethylhexyl)phosphate, tridecyl phosphate, tris(tridecyl)phosphate, diphenylmono(2-ethylhexyl) phosphate, diphenylmonodecyl phosphate, tris(2,4,di-t-butylphenyl) phosphate, distearylpentaerythritol diphosphate, bis(2,4,di-t-butylphenyl)pentaerythritol phosphate, 2,2-methylenebis(4,6-di-t-butylphenyl)octyl phosphate, tetrakis(2,4-di-t-butylphenyl)4,4'-biphenylene-diphosphonite, dilaurylhydrogen phosphate, diphenylhydrogen phosphate, tetraphenyl dipropyleneglycol diphosphate, tetraphenyltetra(tridecyl)pentaerythritol tetraphosphite, tetra(tridecyl)-4,4'isopropylidene diphenyl diphosphate, bis(nonylphenyl)pentaerylthritol diphosphate, and hydrogenerated bisphenol A.pentaerythritol phosphate polymer.

These compounds are known as anti-oxidizing agents for rubbers, plastics, and oils, and commercial products thereof are readily available. The addition amount of the anti-oxidizing agent is preferably 0.01 to 10 parts by weight based on the total weight of the layer to which the anti-oxidizing agent is added.

Image Formation Method and Image Forming Apparatus The image formation method and the image forming apparatus of the present invention are described next with reference to the accompanying drawings.

Figure 6:
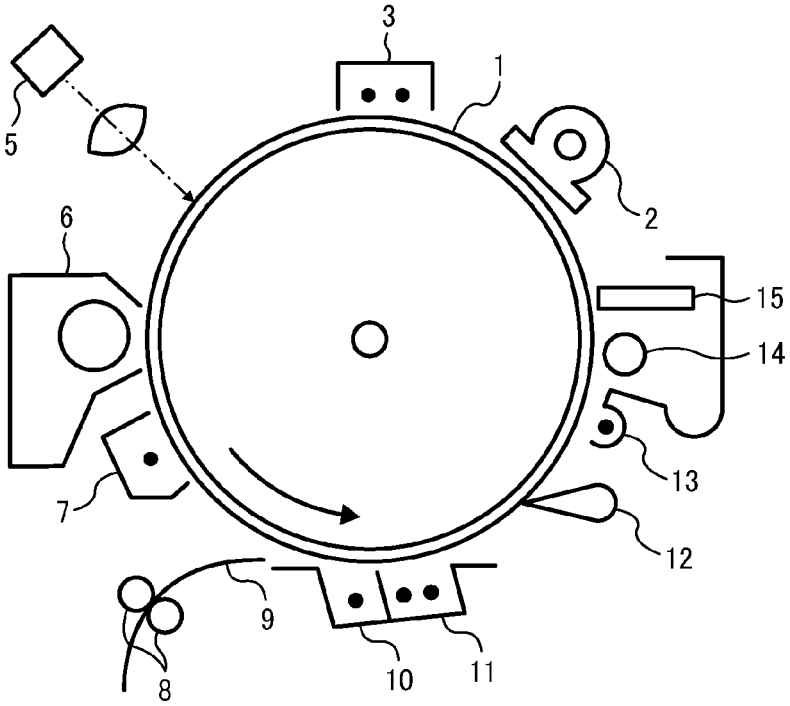
FIG. 6 is a schematic diagram illustrating an example of the image forming apparatus of the present invention.

The image formation method and the image forming apparatus of the present invention use a photoreceptor having a specific cross linked surface layer. The image formation method and the image forming apparatus include, but are not limited to, processes (devices) of: charging the photoreceptor of the present invention; irradiating the photoreceptor with light to form a latent electrostatic image; developing the latent image with toner; transferring the toner image to an image carrying body (transfer medium); fixing the toner image; and cleaning the surface of the photoreceptor. The processes described above are not necessarily applied to the image formation method in which a latent electrostatic image is directly transferred to a transfer body followed by development process. FIG. 6 is a schematic diagram illustrating an example of the image forming apparatus. A charging device 3 is used as a device to uniformly charge a photoreceptor 1. Specific examples of the charging device 3 include, but are not limited to, a corotron device, a scorotron device, a solid discharging element, a needle electrode device, a roller charger, and an electroconductive brush device, and any known method can be used.

A method in which a charger provided in contact with or in the vicinity of the photoreceptor 1 applies a voltage having a DC component and an AC component overlapped therewith is preferably used in terms of power consumption and charging uniformity of the photoreceptor 1.

Next, an image irradiation portion 5 irradiates the uniformly charged photoreceptor 1 to form a latent electrostatic image thereon.

Typical illuminating materials, for example, a fluorescent lamp, a tungsten lamp, a halogen lamp, a mercury lamp, a sodium lamp, a light emitting diode (LED), a semiconductor laser (LD), and electroluminescence (EL) can be used as the light source of the image irradiation portion 5. Various kinds of optical filters, for example, a sharp cut filter, a band-pass filter, a near infrared filter, a dichroic filter, a coherent filter and a color conversion filter, can be used to irradiate an image bearing member with light having only a particular wavelength. Next, a developing unit 6 develops and visualizes the latent electrostatic image formed on the photoreceptor 1. As the development method, there are a one-component developing method and a two-component development method using a dry toner, and a wet-developing method using a wet toner.

When the photoreceptor 1 is positively (or negatively) charged and irradiated, a positive (or negative) latent electrostatic image is formed on the photoreceptor 1.

When the latent electrostatic image is developed with a negatively (or positively) charged toner (volt-detecting fine particles), a positive image is formed. When the latent electrostatic image is developed using a positively (or negatively) charged toner, a negative image is formed. A transfer charging device 10 transfers the toner image visualized on the photoreceptor 1 to a transfer medium 9. The reference numeral 8 represents a pair of registration rollers.

A pre-transfer charging device 7 can be used to improve the transferring. An electrostatic transfer system using a transfer charger or a bias roller, a mechanical transfer system using an adhesive transfer method, a pressure transfer method, etc., and a magnetic transfer system can be used. The charging device described above can be used in the electrostatic transfer system.

Next, a separation charging device 11 and a separation pawl 12 are used to separate the transfer medium 9 from the photoreceptor 1. Other separation methods that can be used are, for example, electrostatic sucking induction separation, side edge belt separation, front edge grip conveyance and curvature separation. The charging device described above can be used as the separation charging device 11. A fur brush 14 and/or a cleaning blade 15 are used to remove toner remaining on the photoreceptor 1 after transfer. A pre-cleaning charging device 13 can be used for efficient cleaning performance.

There are a web system and a magnet brush system as the other cleaning methods. These systems can be employed alone or in combination.

A discharging unit can be optionally used to remove the latent electrostatic image on the photoreceptor 1. As the discharging unit, a discharging lamp 2 or a discharging charging device can be used. The irradiation light source and the charging device mentioned above can be used. In addition, with regard to the processes that are performed not in the vicinity of the photoreceptor 1, i.e., reading an original, sheet-feeding, fixing, and paper-discharging, known devices and methods in the art can be used.

The present invention provides the image forming apparatus and the image formation method that use the photoreceptor of the present invention in the image formation unit as described above.

Figure 7:
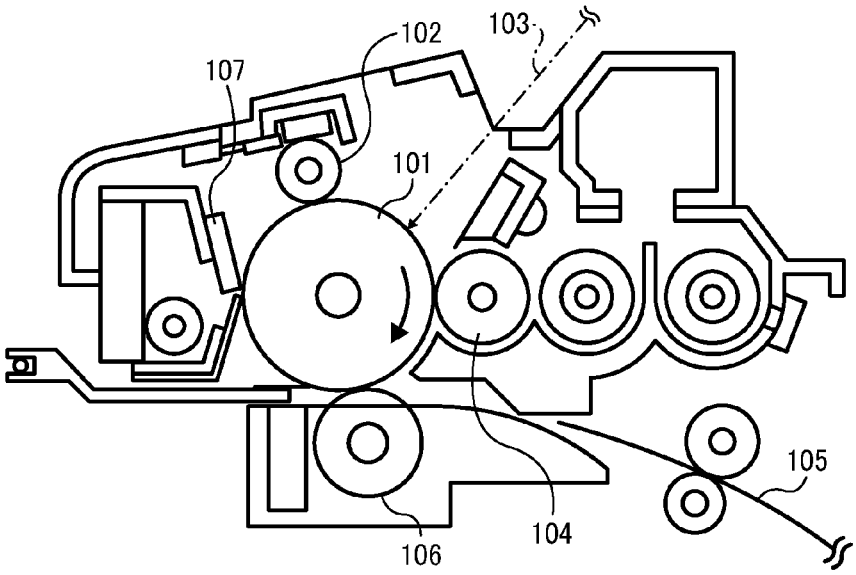
FIG. 7 is a schematic diagram illustrating an example of the process cartridge for use in the image forming apparatus of the present invention.

The image formation unit may be fixed in and incorporated into a photocopier, a facsimile machine, or a printer, or may be detachably attachable to such devices in a form of a process cartridge. FIG. 7 is a diagram illustrating an example of the process cartridge.

The process cartridge for use in an image forming apparatus is a device (or component) that integrates a photoreceptor (image bearing member) 101 therein, includes at least one device selected from a charging device 102, a development device 104, a transfer device 106, a cleaning device 107 and a discharging device (not shown) and is detachably mounted to the main body of an image forming apparatus.

The image formation process by the apparatus illustrated in FIG. 7 is described next. While the photoreceptor 101 rotates in the direction indicated by an arrow in FIG. 7, a latent electrostatic image corresponding to the exposure image is formed on the surface of the photoreceptor 101 through charging and irradiating the surface thereof by the charging device 102 and an irradiation device 103. This latent electrostatic image is developed with toner by the development device 104, and the toner image is transferred to a transferring medium 105 by the transfer device 106.

Then, the surface of the photoreceptor 101 is cleaned after the image transfer by a cleaning device 107 and discharged by a discharging device (not shown) to be ready for the next image formation cycle.

The present invention provides the process cartridge for use in image formation which includes the photoreceptor having a polymer charge transport layer and a cross linked surface layer integrated with at least one of the charging device, the development device, the transfer device, the cleaning device and the discharging device.

As seen in the description above, the photoreceptor of the present invention can be used not only in an electrophotographic photocopier but also in an applied electrophotography field, for example, a laser beam printer, a CRT printer, an LED printer, a liquid crystal printer and a laser printing.

Synthesis Example of Compound Having Charge Transport Structure

The compound having a charge transport structure for use in the present invention can be synthesized by, for example, the method described in Japanese patent No. (hereinafter referred to as JP) 3164426. A specific example is described below.

(1) Synthesis of Hydroxy Group Substituted Triarylamine Compound (Chemical Structure B)

240 ml of sulfolane is added to 113.85 g (0.3 mol) of a methoxy group-substituted triarylamine compound (represented by the following chemical structure A), and 138 g (0.92 mol) of sodium iodide. The resultant is heated to 60° C. in nitrogen atmosphere. 99 g (0.91 mol) of trimethylchlorosilane is dropped to the resultant solution in one hour. Thereafter, the solution is stirred for 4.5 hours at around 60° C. and the reaction is terminated.

Approximately 1,500 ml of toluene is added to the obtained reaction liquid. Subsequent to cooling down to the room temperature, the liquid reaction is repetitively washed with water and a sodium carbonate aqueous solution.

Then, the solvent is removed from the toluene solution, and the solution is purified by column chromatography (absorption medium: silica gel; developing solvent:toluene:ethyl acetate=20:1). Cyclohexane is added to the obtained cream-colored oil to precipitate crystals. 88.1 g (yield constant: 80.4%) of the white-color crystal represented by the following chemical structure B is thus obtained. Melting point: 64.0 to 66.0° C.

TABLE 1

| Element Analysis | | | |
|---|---|---|---|
| | C | H | H |
| Measured | 85.06 | 6.41 | 3.73 |
| Calculation | 85.44 | 6.34 | 3.83 |

Chemical structure A

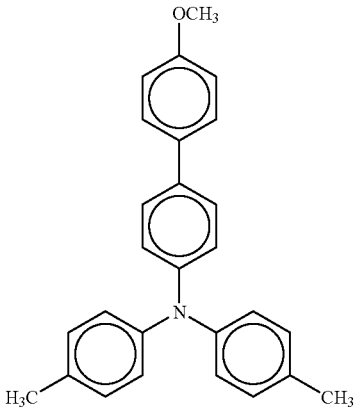

-continued

Chemical Structure B

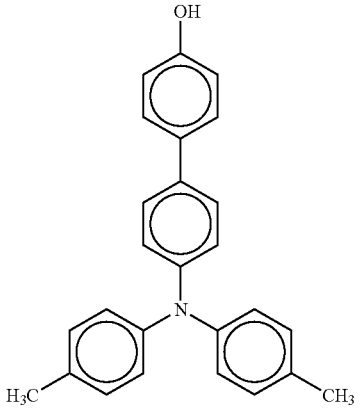

(2) Synthesis of Triarylamine Group-Substituted Acrylate Compound (Compound Example No. 54 Illustrated Above)

82.9 g (0.227 mol) of the hydroxy group-substituted triarylamine compound obtained in (1) (Chemical structure B) is dissolved in 400 ml of tetrahydrofuran, and a sodium hydroxide solution (NaOH: 12.4 g, water: 100 ml) is dropped into the dissolved solution in a nitrogen atmosphere. The solution is cooled down to 5° C., and 25.2 g (0.272 mol) of acrylic acid chloride is dropped thereto in 40 minutes. The reaction liquid is poured to water followed by extraction by toluene. The extracted liquid is repetitively washed with a sodium hydrogen carbonate aqueous solution and water.

Thereafter, the solvent is removed from the toluene solution, and the solution is purified by column chromatography (absorption medium: silica gel; developing solvent: toluene). Then, n-hexane is added to the obtained colorless oil to precipitate crystals. 80.73 g (yield constant: 84.8%) of white-color crystals of Compound Example No. 54 illustrated above is thus obtained.

Melting point: 117.5 to 119.0° C.

TABLE 2

| | C | H | H |
|---|---|---|---|
| Measured | 83.13 | 6.01 | 3.16 |
| Calculation | 83.02 | 6.00 | 3.33 |

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The test and the measuring method relating to the present invention are described first.

(1) Measuring Method of Photoreceptor Surface Roughness

In the present invention, Rz and Sm along the mother line (rotation axis of a photoreceptor) of the photoreceptor are measured by a surface texture measuring instrument (SURFCOM 1400D, manufactured by TOKYOSEIMITSU CO., LTD.).

In the present invention, Rz and Sm along the circumference direction of the photoreceptor are measured by a laser microscope (VK-8500, manufactured by Keyence Corporation).

Five points selected at random are measured for Rz along the rotation axis of the photoreceptor and along the circumference direction and the average thereof is determined as the measuring value.

(2) Measuring and Evaluation Method on Toner Slip-through Measuring Method

Figure 8:
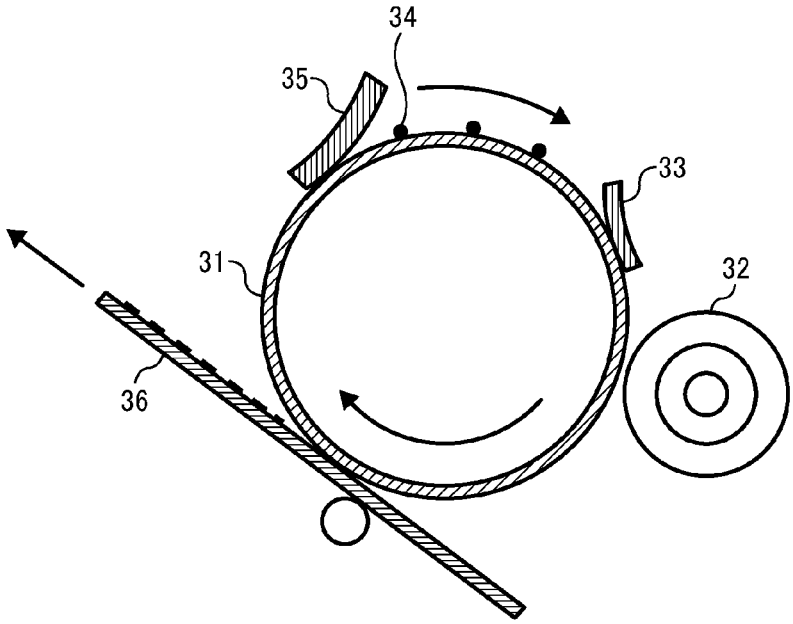
FIG. 8 is a diagram illustrating a layout of the photoreceptor and devices therearound to measure the slip through intensity.

Measurement of toner 34 slip-through in the present invention is described with reference to FIG. 8. Toner slip-through is measured by the process of collecting toner attached to a photoreceptor 31 by a cleaning blade 35.

The toner 34 that slips through the cleaning blade 35 is collected by a white felt (hereinafter referred to as a slip-through toner catcher 33, manufactured by the Tsuchiya Group) having a size of 8 mm×310 mm with a thickness of 1 mm fixed in contact with the photoreceptor 31 on the downstream side relative to the cleaning blade 35 and on the upstream side of the opening mouth of a development device (development roller) 32. The measurement is performed according to the following procedure. The cleaning brush, the charging roller cleaner, and zinc stearate having a stick form are removed from the photoreceptor set of imagio Neo C455 manufactured by Ricoh Co., Ltd. to obtain a photoreceptor set for measuring toner slip through strength. This photoreceptor set is located at the black development station (refer to FIG. 8). DC bias of the charging roller application biases of imagio Neo C455 is adjusted such that the charging voltage of the photoreceptor 31 is −700 V. The amount of writing light is adjusted such that the irradiation portion voltage is −250 V. Thereafter, a solid pattern is written varying the development bias.

Toner attached to the photoreceptor 31 before transfer is collected by a transparent adhesive tape (Printac C, manufactured by Nitto Denko Corporation) and the image density of the tape that collects toner is measured by a reflection densitometer (X-RITE 939, manufactured by Canon i-tech Inc.). The development bias is changed such that this density is 1.0.

The slip through toner catcher 33 is attached to the upper portion of the opening mouth of the development device (roller) 32 via a sponge tape (Scotch tape 4016, manufactured by Sumitomo 3M limited) having a thickness of 2 mm. This is attached to the photoreceptor 31.

A new proper cleaning blade of imagio Neo C455 is attached to the cleaned photoreceptor drum. A test pattern having a size of A4 with an image density of 5% is continuously printed on photocopy paper 36 (My Paper, A4, manufactured by Ricoh Business Expert Ltd.) with a run length of 50 sheets in an environment of 23° C. and 55% RH. Proper polymerization toner (IPSIO toner, type 9800) is used.

Evaluation Method

The slip through toner catcher 33 is retrieved after printing, and the contamination level of the felt is observed with naked eyes. The evaluation criteria are as follows:

B (bad): Clearly contaminated:

G (good): no problem

F (fair): between B and G.

(3) Blade Abrasion Measuring Method

Figure 9:
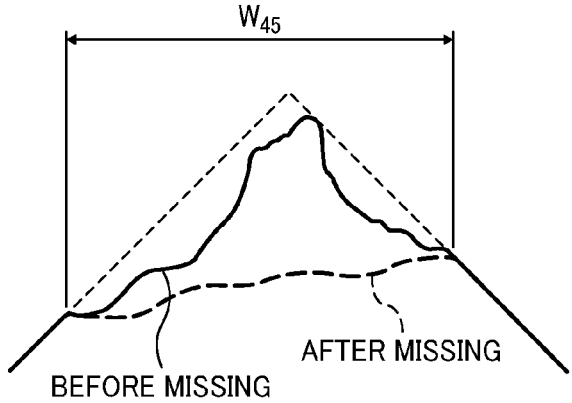
FIG. 9 is a diagram illustrating the width of blade abrasion.

The abrasion of the blade is observed with a laser microscope (VK-8500, manufactured by Keyence Corporation). With regard to the abrasion width of the blade, the blade edge portion is observed and the width of the chipped portion missing from the initial state (refer to $W_{45}$ of FIG. 9) is measured.

(4) Method of Measuring Abrasion Amount of Photoreceptor

The amount of abrasion of the photoreceptor layer is measured by an eddy current film thickness measuring instrument (Fischer Instruments K.K.)

Example 1

Liquid application having the following recipe is applied to an aluminum substrate (outer diameter: 30 mmϕ) by a dip coating method to form an undercoating layer having a layer thickness of 3.5 μm after drying.

| Liquid Application for Undercoating Layer | |
|---|---|
| Alkyd resin (Beckozole 1307-60-EL, manufactured by Dainippon Ink and Chemicals, Inc.) | 6 parts |
| Melamine resin (Super-beckamine G-821-60, manufactured by Dainippon Ink and Chemicals, Inc.) | 4 parts |
| Titanium oxide (CR-El, manufactured by Ishiahara Sangyo Kaisha Ltd.) | 40 parts |
| Methylethylketone | 50 parts |

Liquid application for charge generation layer containing the bisazo pigment represented by the following chemical formula 5 is applied to the undercoating layer by a dip coating followed by heating and drying to form a charge generation layer having a layer thickness of 0.2 μm.

| Liquid Application for Charge Generation Layer | |
|---|---|
| Bisazo pigment represented by the following chemical formula 5 | 2.5 parts |

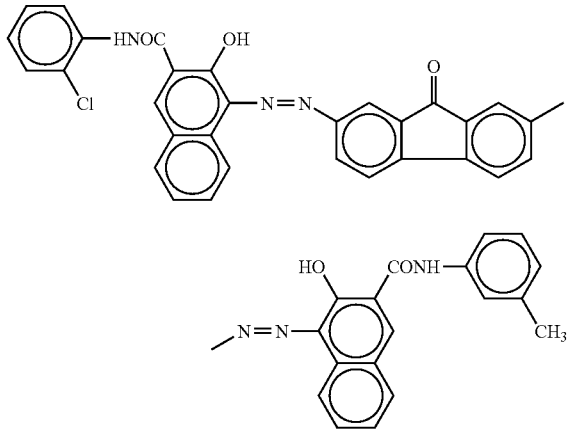

Chemical formula 5

| | |
|---|---|
| Polyvinyl butyral {XYHL, manufactured by Union Carbide Corporation (UCC) } | 0.05 parts |
| Cyclohexane | 200 parts |
| Methylethyl ketone | 80 parts |

Liquid application for charge transport layer containing the charge transport material represented by the following chemical formula 6 is applied to the charge generation layer by a dip coating followed by heating and drying to form a charge transport layer having a layer thickness of 22 μm.

| Liquid Application for Charge Transport Layer | |
|---|---|
| Bisphenol Z type polycarbonate | 10 parts |
| Charge Transport Material having a low molecular weight represented by the following chemical formula 6 | 10 parts |

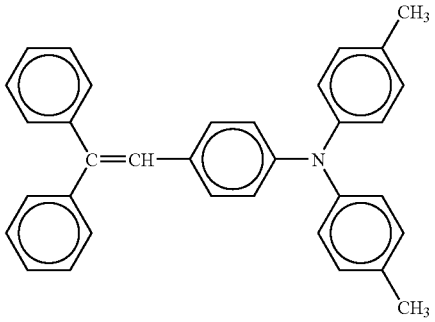

Chemical formula 6

| | |
|---|---|
| Tetrahydrofuran | 80 parts |
| Tetrahydrofuran solution of 1% Silicone oil (KF50-100CS, manufactured by Shin-Etsu Chemical Co., Ltd.) | 0.2 parts |

Liquid application for cross linked surface layer having the following recipe is applied to the charge transport layer by a spray coating followed by irradiation by a metal halide lamp with an irradiation intensity of 700 mW/cm$^2$ for 20 seconds, and curing treatment by drying at 130° C. for 30 minutes to obtain a cross linked surface layer having a thickness of 4.0 μm. A photoreceptor is thus obtained.

| Liquid Application for Cross Linked Surface Layer Radical polymerizable monomer having at least three functional groups without having a charge transport structure Trimethyl propane triacrylate (KAYARAD TMPTA, manufactured by Nippon Kayaku Co., Ltd., molecular weight: 382, number of functional groups: 3, molecular weight/number of functional groups = 99) | |
|---|---|
| Radical polymerizable monomer having a charge transport structure (illustrated Compound No. 54) | 9 parts |
| Photo polymerization initiator {1-hydroxy-cyclohexyl-phenyl-ketone (IRGACURE 184, manufactured by Chiba Specialty Chemicals)} | 2 parts |
| Aluminum particulates (AA03, manufactured by Sumitomo Chemical Co., Ltd., average primary particle diameter: 0.37 μm) | 5 parts |
| Tetrahydrofuran | 100 parts |

Linear scar is formed on the surface of the photoreceptor manufactured as described above. The linear scar is formed as follows. Wrapping film (manufactured by Sumitomo 3M limited) holding aluminum on the surface thereof as abrasive grain is prepared.

The photoreceptor is set in an originally made photoreceptor abrasion testing machine and the wrapping film is automatically fed in to provide roughness on the circumferential phase of the photoreceptor.

Figure 10:
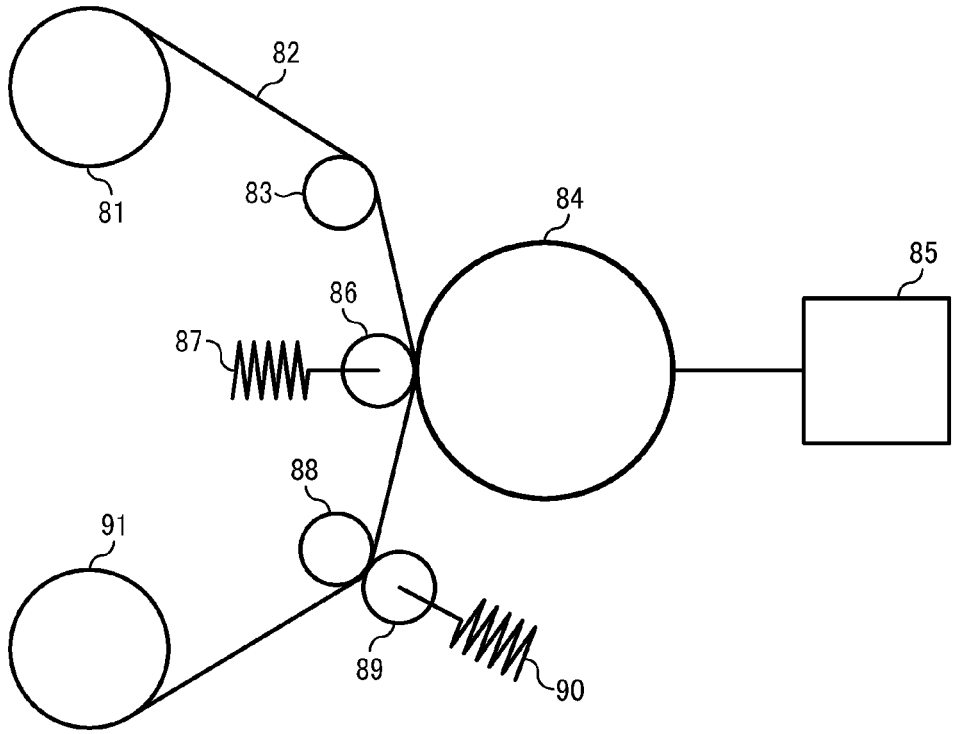
FIG. 10 is a diagram illustrating an example of the method of forming linear scar.

FIG. 10 is a diagram illustrating the mechanism. Numeral references 81, 82, 83, 84, 85, 86, 87, 88, 89, 90 and 91 represent a wrapping film feeding roller, wrapping film, a sending roller, organic photoconductor, photoconductor rotation driving meter, a pressure roller, a pressure roller loader, a sending roller, a pinching roller, a pinching roller loader, and a wrapping film reeling roller, respectively. The degree of roughness is adjusted by the surface roughness (Ra) of the wrapping film, pressure roller rubber hardness, wrapping film feeding speed (m/h), and drum rotation speed (rpm).

The cross linked surface layer is abraded with a width of 340 mm along the axis direction for 10 minutes under the following conditions according to the above-mentioned method.

TABLE 3

| Condition on Linear Scar Formation | |
|---|---|
| Factor | Condition |
| Pressure roller rubber hardness | 60° |
| Pressure roller outer diameter deflection accuracy | 30 μm |
| Wrapping film surface layer Ra (μm) | 5 |
| Wrapping film abrasive grain | aluminum |
| Feeding speed of wrapping film (m/h) | 2 |
| Rotation power during abrasion (kgf/cm$^2$) (adjustable by load of pressure roller) | 3 + or − 0.2 |
| Stop condition | When the rotation force is 2.5 kgf or lower |
| Drum rotation speed (rpm) | 200 |

Example 2

The photoreceptor is manufactured in the same manner as in Example 1 except that the wrapping film is changed to wrapping film having an Ra of 2 μm in the linear scar formation process.

Example 3

The photoreceptor is manufactured in the same manner as in Example 1 except that the wrapping film is changed to wrapping film having an Ra of 1 μm in the linear scar formation process.

Example 4

The photoreceptor is manufactured in the same manner as in Example 1 except that the wrapping film is changed to wrapping film having an Ra of 12 μm in the linear scar formation process.

Example 5

The photoreceptor is manufactured in the same manner as in Example 1 except that the filler particulates added to the liquid application for the cross linked surface layer are changed to AA07 (manufactured by Sumitomo Chemical Co., Ltd., average primary particle diameter: 0.74 μm).

Example 6

The photoreceptor is manufactured in the same manner as in Example 1 except that the filler particulates added to the liquid application for the cross linked surface layer are changed to AA01 (manufactured by Sumitomo Chemical Co., Ltd., average primary particle diameter: 0.15 μm).

Comparative Example 1

The photoreceptor is manufactured in the same manner as in Example 1 except that the liquid application for the cross linked surface layer of claim 1 is replaced with the liquid application for the surface layer having the following recipe

| | |
|---|---|
| Charge transport material having a low molecular weight for use in the charge transport layer | 2 parts |
| Bisphenol Z type polycarbonate | 2 parts |
| Aluminum particulates (AA03, manufactured by Sumitomo Chemical Co., Ltd.) | 1 part |
| Tetrahydrofuran | 70 parts |
| Cyclohexane | 25 parts |

Comparative Example 2

The photoreceptor is manufactured in the same manner as in Comparative Example 1 except that the photoreceptor is manufactured without being subject to the linear scar formation process.

Comparative Example 3

The photoreceptor is manufactured in the same manner as in Comparative Example 1 except that no filler particulates are added to the liquid application for the cross linked surface layer.

Comparative Example 4

The photoreceptor is manufactured in the same manner as in Comparative Example 3 except that the photoreceptor is manufactured without being subject to the linear scar formation process Comparative Example 5

The photoreceptor is manufactured in the same manner as in Example 1 except that the photoreceptor is manufactured without being subject to the linear scar formation process.

Comparative Example 6

The photoreceptor is manufactured in the same manner as in Example 1 except that no filler particulates are added to the liquid application for the cross linked surface layer.

Comparative Example 7

The photoreceptor is manufactured in the same manner as in Comparative Example 6 except that the photoreceptor is manufactured without being subject to the linear scar formation process Comparative Example 8

The photoreceptor is manufactured in the same manner as in Example 1 except that the wrapping film is changed to wrapping film having an Ra of 03 μm in the linear scar formation process.

Comparative Example 9

The photoreceptor is manufactured in the same manner as in Example 1 except that the wrapping film is changed to wrapping film having an Ra of 30 μm in the linear scar formation process.

Comparative Example 10

The photoreceptor is manufactured in the same manner as in Example 1 except that the filler particulates added to the liquid application for the cross linked surface layer are changed to AA15 (manufactured by Sumitomo Chemical Co., Ltd., average primary particle diameter: 1.5 μm).

Comparative Example 11

The photoreceptor is manufactured in the same manner as in Example 1 except that the filler particulates are added to the liquid application for the cross linked surface in an amount of 10 parts.

Measuring Results of Surface Roughness

The measuring results of Rz, and Sm of the manufactured photoreceptors along the direction of the rotation axis of the photoreceptor and the circumference direction of the photoreceptor are shown in Table 4

TABLE 4

| | Surface Roughness | | | |
|---|---|---|---|---|
| | Rz (μm) | | Sm (μm) | |
| | Direction of rotation axis | Circumference direction | Direction of rotation axis | Circumference direction |
| Example 1 | 0.42 | 0.24 | 32 | 29 |
| Example 2 | 0.31 | 0.24 | 26 | 30 |
| Example 3 | 0.17 | 0.23 | 21 | 27 |
| Example 4 | 1.73 | 0.25 | 68 | 31 |
| Example 5 | 0.44 | 0.43 | 37 | 38 |
| Example 6 | 0.40 | 0.13 | 29 | 11 |
| Comparative Example 1 | 0.42 | 0.25 | 32 | 30 |
| Comparative Example 2 | 0.38 | 0.26 | 280 | 270 |
| Comparative Example 3 | 0.41 | 0.11 | 33 | 44 |
| Comparative Example 4 | 0.12 | 0.12 | 510 | 370 |
| Comparative Example 5 | 0.49 | 0.25 | 280 | 270 |
| Comparative Example 6 | 0.40 | 0.11 | 35 | 41 |
| Comparative. Example 7 | 0.13 | 0.12 | 530 | 410 |
| Comparative Example 8 | 0.15 | 0.23 | 18 | 34 |
| Comparative Example 9 | 2.10 | 0.24 | 52 | 28 |
| Comparative Example 10 | 0.47 | 0.53 | 44 | 40 |
| Comparative Example 11 | 0.48 | 0.31 | 28 | 9 |

A running machine test with a run length of 50,000 (A4, My paper, manufactured by Ricoh Business Expert Ltd, the charging voltage at the time of start: −700 V) is performed by using Imagio Neo C455 (zinc stearate having a stick form functioning as the lubricant agent in the process cartridge is removed) in which the manufactured photoreceptor is set. The photoreceptor is evaluated on toner slip through, abrasion amount of the blade, and the abrasion amount of the photoreceptor.

The results are shown in Table 5.

TABLE 5

| | Toner slip through | | | Abrasion width of blade (μm) | | Abrasion amount of photoreceptor (μm) | |
|---|---|---|---|---|---|---|---|
| | Start | 5,000 sheets | 50,000 sheets | 5,000 sheets | 50,000 sheets | 5,000 sheets | 50,000 sheets |
| Example 1 | G | G | G | 0.3 | 3 | 0.04 | 0.14 |
| Example 2 | G | G | G | 0.4 | 4 | 0.05 | 0.14 |
| Example 3 | G | G | G | 0.5 | 3 | 0.05 | 0.15 |
| Example 4 | G | G | G | 0.5 | 5 | 0.05 | 0.15 |
| Example 5 | G | G | G | 0.5 | 4 | 0.05 | 0.15 |
| Example 6 | G | G | G | 0.4 | 4 | 0.04 | 0.16 |
| Comparative Example 1 | G | G | G | 0.5 | 6 | 0.4 | Dis-appeared |
| Comparative Example 2 | G | G | G | 4 | 30 | 0.4 | Dis-appeared |
| Comparative Example 3 | G | F | B | 0.5 | 7 | 0.6 | Dis-appeared |
| Comparative Example 4 | G | F | B | 3 | 25 | 0.6 | Dis-appeared |
| Comparative Example 5 | G | G | G | 8 | 27 | 0.04 | 0.18 |
| Comparative Example 6 | G | F | B | 0.5 | 7 | 0.05 | 0.2 |
| Comparative. Example 7 | G | F | B | 12 | 26 | 0.05 | 0.19 |
| Comparative Example 8 | B | F | F | 2 | 20 | 0.05 | 0.15 |
| Comparative Example 9 | B | B | B | 0.4 | 10 | 0.05 | 0.15 |
| Comparative Example 10 | G | G | G | 0.6 | 16 | 0.05 | 0.14 |
| Comparative Example 11 | G | F | F | 0.6 | 6 | 0.04 | 0.13 |

Since the surface layer of the photoreceptors of Comparative Examples 1 to 4 is not cross linked, the abrasion amount of the photoreceptor increases over time, and thus the surface layer disappears when a run length of 50,000 is complete.

Since the contact area between the circumference surface of the photoreceptors of Comparative Examples 2, 4, 5, 7, and 8 and the cleaning blade is large, the cleaning blade significantly deteriorates in comparison with the photoreceptor having linear scars.

Since the photoreceptors of Comparative Examples 9 and 10 have a large surface roughness (meaning that the convex portions are emphasized), the abrasion amount of the edge portion of the cleaning blade increases.

Since the photoreceptors of Comparative Examples 3 and 6 have no filler particulates in the linear scar, the amount of toner slip through is not reduced.

Since the contact area between the circumference surface of the photoreceptors of Comparative Examples 4, 7, and 8 and the cleaning blade is excessively large, the amount of abrasion of the cleaning blade is large.

This abrasion degrades the cleaning performance, which results in an increase in the amount of toner slip through.

Since a large amount of the filler is added to the photoreceptor of Comparative Example 11, the electric characteristics thereof deteriorate, which causes problems such as reduction of the image density and appearance of residual image in comparison with the other photoreceptors.

Thus, the filler particulates are dispersed in the cross linked surface layer in the present invention, thereby forming linear scar along the circumference direction. The photoreceptor of the present invention is found to have a long working life with high performance while producing good images for a long period of time because the filler exists in the groove formed by the scar.

In addition, the image formation process, the image forming apparatus, the process cartridge for use in the image forming apparatus which use the photoreceptor of the present invention are found to be highly reliable and high-performance.

This document claims priority and contains subject matter related to Japanese Patent Application No. 2008-286102, filed on Nov. 7, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A photoreceptor comprising:

an electroconductive substrate;

a photosensitive layer located overlying the electroconductive substrate; and a cross linked surface layer located overlying the photosensitive layer, wherein the surface layer is a cross linked surface layer comprising filler particulates on which linear scar is formed along a circumference direction and the filler particulates form concave portions on a groove formed by the linear scar, and wherein a ten point average roughness Rz along a direction of a rotation axis of the photoreceptor measured on a circumference surface thereof is from 0.17 to 2.00 μm and an average distance Sm of concavities and convexities along the direction of the rotation axis of the photoreceptor measured on the circumference surface thereof is from 20 to 500 μm, and a ten point average roughness Rz along the circumference direction of the photoreceptor measured on the circumference surface thereof is from 0.13 to 0.50 μm and an average distance Sm of concavities and convexities along the circumference direction of the photoreceptor measured on the circumference surface thereof is from 10 to 40 μm.

2. The photoreceptor according to claim 1, wherein the filler particulates have an average primary particle diameter of from 0.1 to 1.0 μm.

3. The photoreceptor according to claim 1, wherein the surface layer is formed by curing a radical polymerizable monomer having no charge transport structure and a radical polymerizable monomer having a charge transport structure and the radical polymerizable monomer having no charge transport structure has at least three radical polymerizable functional groups.

4. The photoreceptor according to claim 1, wherein the surface layer is formed by curing a radical polymerizable monomer having no charge transport structure and a radical polymerizable monomer having a charge transport structure and the radical polymerizable monomer having a charge transport structure has one radical polymerizable functional group.

5. The photoreceptor according to claim 1, wherein the surface layer is formed by curing a radical polymerizable monomer having no charge transport structure and a radical polymerizable monomer having a charge transport structure of a triaryl amine structure.

6. The photoreceptor according to claim 1, wherein the surface layer is formed by curing a radical polymerizable monomer having no charge transport structure and a radical polymerizable monomer having a charge transport structure, both of which have an acryloyloxy group or a methacryloyloxy group as a radical polymerizable functional group.

7. The photoreceptor according to claim 1, wherein the photoreceptor has a laminate structure comprising an undercoating layer, the photosensitive layer comprising a charge generation layer and a charge transport layer, and the cross linked surface layer.

8. An image formation method comprising:

charging the photoreceptor of claim 1;

irradiating the photoreceptor to form a latent electrostatic image on a surface thereon;

developing the latent electrostatic image to obtain a visualized image;

transferring the visualized image to a recording medium; and cleaning the surface of the photoreceptor after transferring.

9. The image formation method according to claim 8, wherein the latent electrostatic image is developed with toner having a spherical form.

10. An image forming apparatus comprising:

a charging device configured to charge the photoreceptor of claim 1;

an irradiation device configured to irradiate a surface of the photoreceptor to obtain a latent electrostatic image;

a development device configured to develop the latent electrostatic image to obtain a visualize image;

a transfer device configured to transfer the visualized image to a recording medium; and a cleaning device configured to clean the surface of the photoreceptor after the visualized image is transferred to the recording medium.

11. The image forming apparatus according to claim 10, wherein the latent electrostatic image is developed with toner having a spherical form.

12. A process cartridge comprising:

the photoreceptor of claim 1; and at least one device selected from the group consisting of a charging device, a development device, a transfer device, a cleaning device, and a discharging device, wherein the process cartridge is detachably attachable to an image forming apparatus.

* * * * *